US010380835B2

(12) United States Patent
Lutnick et al.

(10) Patent No.: US 10,380,835 B2
(45) Date of Patent: Aug. 13, 2019

(54) GAME WITH CHANCE ELEMENT OR EVENT SIMULATION

(71) Applicant: CFPH, LLC, New York, NY (US)

(72) Inventors: Howard W. Lutnick, New York, NY (US); Dean P. Alderucci, Westport, CT (US); Geoffrey M. Gelman, Brooklyn, NY (US)

(73) Assignee: CFPH, LLC, New York, NY (US)

( * ) Notice: Subject to any disclaimer, the term of this patent is extended or adjusted under 35 U.S.C. 154(b) by 632 days.

(21) Appl. No.: 14/594,249

(22) Filed: Jan. 12, 2015

(65) Prior Publication Data

US 2015/0179019 A1 Jun. 25, 2015

Related U.S. Application Data

(63) Continuation of application No. 11/869,368, filed on Oct. 9, 2007, now Pat. No. 8,932,131.

(51) Int. Cl.
*G07F 17/32* (2006.01)

(52) U.S. Cl.
CPC ..... *G07F 17/3225* (2013.01); *G07F 17/32* (2013.01); *G07F 17/3218* (2013.01); *G07F 17/3237* (2013.01); *G07F 17/3288* (2013.01); *G07F 17/3239* (2013.01)

(58) Field of Classification Search
CPC .. G07F 17/32; G07F 17/3218; G07F 17/3227; G07F 17/3237; G07F 17/3239
See application file for complete search history.

(56) References Cited

U.S. PATENT DOCUMENTS

| | | | | |
|---|---|---|---|---|
| 6,409,602 | B1 | 6/2002 | Wiltshire et al. | |
| 6,846,238 | B2 | 1/2005 | Wells | |
| 7,740,533 | B2 | 6/2010 | Walker et al. | |
| 8,282,490 | B2 | 10/2012 | Arezina et al. | |
| 2002/0142846 | A1 | 10/2002 | Paulsen | |
| 2002/0151366 | A1 | 10/2002 | Walker et al. | |
| 2003/0109306 | A1 | 6/2003 | Karmarkar | |
| 2003/0199313 | A1 | 10/2003 | Gonen et al. | |
| 2003/0228906 | A1* | 12/2003 | Walker | G07F 17/32 463/40 |
| 2004/0005919 | A1 | 1/2004 | Walker et al. | |
| 2005/0170890 | A1 | 8/2005 | Rowe et al. | |
| 2005/0209003 | A1 | 9/2005 | Adams | |
| 2006/0052148 | A1 | 3/2006 | Blair et al. | |
| 2006/0068895 | A1* | 3/2006 | Nguyen | G07F 17/32 463/25 |
| 2006/0217195 | A1 | 9/2006 | Walker et al. | |
| 2006/0252551 | A1 | 11/2006 | Walker | |
| 2007/0054738 | A1 | 3/2007 | Muir | |

(Continued)

FOREIGN PATENT DOCUMENTS

| | | |
|---|---|---|
| JP | H5-228259 | 9/1993 |
| JP | 2002-06973 | 1/2002 |

(Continued)

OTHER PUBLICATIONS

U.S. PTO Office Action for U.S. Appl. No. 11/869,368; dated Dec. 1, 2011; 15 pages.

(Continued)

*Primary Examiner* — Damon J Pierce

(57) ABSTRACT

In various embodiments, a player may view a list of popular games.

30 Claims, 14 Drawing Sheets

(56) References Cited

U.S. PATENT DOCUMENTS

| | | | | |
|---|---|---|---|---|
| 2008/0020845 | A1* | 1/2008 | Low | G07F 17/32 463/42 |
| 2008/0214287 | A1 | 9/2008 | Lutnick | |
| 2009/0093290 | A1 | 4/2009 | Lutnick | |
| 2013/0190084 | A1 | 7/2013 | Lutnick | |

FOREIGN PATENT DOCUMENTS

| | | |
|---|---|---|
| JP | 2002-73894 | 3/2002 |
| JP | 2003-22328 | 1/2003 |
| JP | 2005-270649 | 10/2005 |
| JP | 2006-99234 | 4/2006 |
| JP | 2006-187638 | 7/2006 |
| WO | WO 2005/028056 | 3/2005 |

OTHER PUBLICATIONS

U.S. PTO Office Action for U.S. Appl. No. 11/680,866; dated Aug. 31, 2010; 16 pages.
AU Examination Report for AU Application No. 2008223144; 2 pages; dated Jul. 2, 2010.
U.S. PTO Office Action for U.S. Appl. No. 11/869,368; dated Oct. 4, 2013; 18 pages.
U.S. PTO Office Action for U.S. Appl. No. 11/869,368; dated Mar. 29, 2013; 18 pages.
U.S. PTO Office Action for U.S. Appl. No. 11/869,368; dated Jul. 31, 2012; 15 pages.
U.S. PTO Final Office Action for U.S. Appl. No. 11/680,866; dated Jul. 23, 2013; 20 pages.
U.S. PTO Office Action for U.S. Appl. No. 13/792,773; dated Sep. 24, 2013; 11 pages.
AU Examination Report No. 1 for AU App. No. 2012201757; dated Dec. 19, 2013, 3 pages.
CA Examination Report for CA App. No. 2,679,860; dated Sep. 10, 2012; 4 pages.
CA Examination Report for CA App. No. 2,679,860; dated Nov. 28, 2013; 2 pages.
JP Office Action for JP App. No. 2009-551848; dated Feb. 21, 2012; 11 pages. (w/English translation).
JP Office Action for JP App. No. 2009-551848; dated Apr. 25, 2013; 9 pages (w/English translation).
JP Office Action for JP App. No. 2012-182700; dated Apr. 2, 2013; 12 pages (w/English translation).
JP Office Action for JP App. No. 2009-551848; dated Apr. 15, 2014; 6 pages (w/English translation).
JP Office Action for JP App. No. 2012-182700; dated Apr. 15, 2014; 6 pages (w/English translation).
U.S. PTO Final Office Action for U.S. Appl. No. 11/869,368; dated Jul. 2, 2014; 15 pages.
U.S. PTO Office Action for U.S. Appl. No. 13/792,773; dated Jul. 18, 2014; 10 pages.
U.S. PTO Office Action for U.S. Appl. No. 11/869,368; dated May 5, 2011; 9 pages.
PCT Search Report and Written Opinion for International Application No. PCT/US08/55284; dated Sep. 29, 2008; 13 pages.
CA Examiner's Requisition for App. No. 2,679,860; dated Feb. 16, 2015; 4 pages.
JP Office Action for JP App. No. 2014-165478; dated Dec. 15, 2015; 8 pages (w/English translation).
Canadian Exam Report for Application No. 2,679,860 dated Jan. 15, 2016 (4 pages).
Australian First Exam Report for Application No. 2015207878 dated Jul. 25, 2016 (6 pages).
CA Examination Report for CA App. No. 2,679,860; dated Jan. 12, 2017; 4 pages.
Australian Second Exam Report for Application No. 2015207878 dated Jun. 2, 2017 (4 pages).
Australian Notice of Acceptance for Application No. 2015207878 dated Jun. 28, 2017 (3 pages).
CA Final Action for CA App. No. 2,679,860; dated Mar. 5, 2018; 6 pages.
Australian First Exam Report for Application No. 2017225067 dated Aug. 23, 2018 (7 pages).
Windows Mobile 5.0—Smartphone Screen Shots (2). Chris De Herrera's Windows CE Website. Copyright 2005; Version 1.00 Revised May 10, 2005. Retrieved: Aug. 28, 2018.
Windows CE Website- Table of Contents (2). Chris De Herrera's Windows CE Website. Retrieved: Aug. 28, 2018.
Windows Mobile 5.0 Emulator(2). Chris De Herrera's Windows CE Website. Retrieved: Aug. 28, 2018.

* cited by examiner

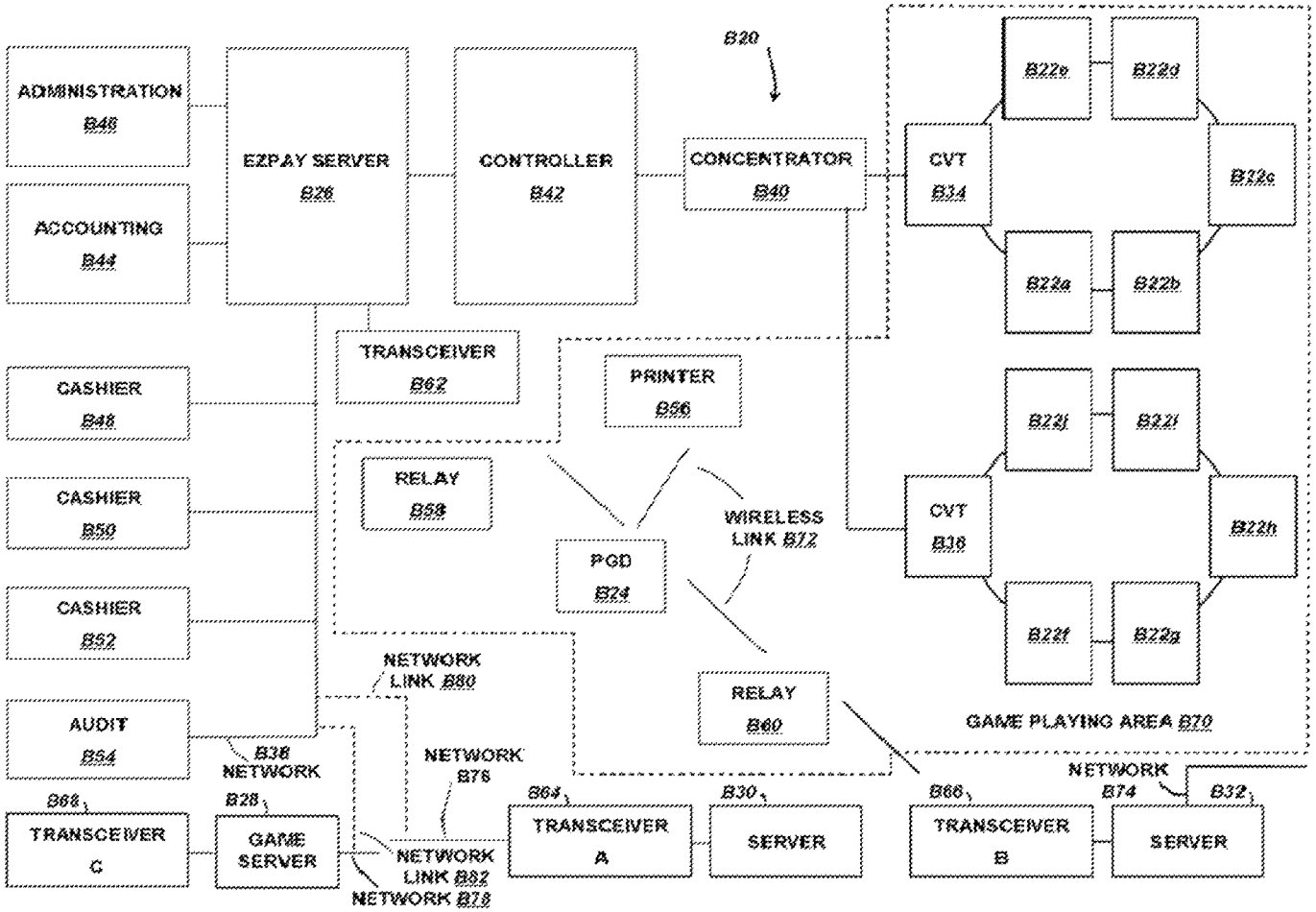
B20
CONCENTRATOR B40
CONTROLLER B42
EZPAY SERVER B28
ADMINISTRATION B48
ACCOUNTING B44
CASHIER B46
CASHIER B50
CASHIER B52
AUDIT B54
TRANSCEIVER C
B66
B38 NETWORK
B28
GAME SERVER
TRANSCEIVER B62
RELAY B58
PRINTER B56
PGD B24
WIRELESS LINK B72
NETWORK LINK B80
NETWORK B76
NETWORK LINK B82
NETWORK B78
RELAY B60
GAME PLAYING AREA B70
CVT B14
CVT B18
B22a
B22b
B22c
B22d
B22e
B22f
B22g
B22h
B22i
B22j
B22k
B22l
B22m
B22n
B22o
B22p
B22q
B22r
B22s
B22t
B22u
B22v
B22w
B22x
B22y
B22z
B22aa
B22ab
B22ac
B22ad
B22ae
B22af
B22ag
B22ah
B22ai
B22aj
B22ak
B22al
B22am
B22an
B22ao
B22ap
B22aq
B22ar
B22as
B22at
B22au
B22av
B22aw
B22ax
B22ay
B22az
B22ba
B22bb
B22bc
B22bd
B22be
B22bf
B22bg
B22bh
B22bi
B22bj
B22bk
B22bl
B22bm
B22bn
B22bo
B22bp
B22bq
B22br
B22bs
B22bt
B22bu
B22bv
B22bw
B22bx
B22by
B22bz
B22ca
B22cb
B22cc
B22cd
B22ce
B22cf
B22cg
B22ch
B22ci
B22cj
B22ck
B22cl
B22cm
B22cn
B22co
B22cp
B22cq
B22cr
B22cs
B22ct
B22cu
B22cv
B22cw
B22cx
B22cy
B22cz
B22da
B22db
B22dc
B22dd
B22de
B22df
B22dg
B22dh
B22di
B22dj
B22dk
B22dl
B22dm
B22dn
B22do
B22dp
B22dq
B22dr
B22ds
B22dt
B22du
B22dv
B22dw
B22dx
B22dy
B22dz
B22ea
B22eb
B22ec
B22ed
B22ee
B22ef
B22eg
B22eh
B22ei
B22ej
B22ek
B22el
B22em
B22en
B22eo
B22ep
B22eq
B22er
B22es
B22et
B22eu
B22ev
B22ew
B22ex
B22ey
B22ez
B22fa
B22fb
B22fc
B22fd
B22fe
B22ff
B22fg
B22fh
B22fi
B22fj
B22fk
B22fl
B22fm
B22fn
B22fo
B22fp
B22fq
B22fr
B22fs
B22ft
B22fu
B22fv
B22fw
B22fx
B22fy
B22fz
B22ga
B22gb
B22gc
B22gd
B22ge
B22gf
B22gg
B22gh
B22gi
B22gj
B22gk
B22gl
B22gm
B22gn
B22go
B22gp
B22gq
B22gr
B22gs
B22gt
B22gu
B22gv
B22gw
B22gx
B22gy
B22gz
B22ha
B22hb
B22hc
B22hd
B22he
B22hf
B22hg
B22hh
B22hi
B22hj
B22hk
B22hl
B22hm
B22hn
B22ho
B22hp
B22hq
B22hr
B22hs
B22ht
B22hu
B22hv
B22hw
B22hx
B22hy
B22hz
B22ia
B22ib
B22ic
B22id
B22ie
B22if
B22ig
B22ih
B22ii
B22ij
B22ik
B22il
B22im
B22in
B22io
B22ip
B22iq
B22ir
B22is
B22it
B22iu
B22iv
B22iw
B22ix
B22iy
B22iz
B22ja
B22jb
B22jc
B22jd
B22je
B22jf
B22jg
B22jh
B22ji
B22jj
B22jk
B22jl
B22jm
B22jn
B22jo
B22jp
B22jq
B22jr
B22js
B22jt
B22ju
B22jv
B22jw
B22jx
B22jy
B22jz
B22ka
B22kb
B22kc
B22kd
B22ke
B22kf
B22kg
B22kh
B22ki
B22kj
B22kk
B22kl
B22km
B22kn
B22ko
B22kp
B22kq
B22kr
B22ks
B22kt
B22ku
B22kv
B22kw
B22kx
B22ky
B22kz
B22la
B22lb
B22lc
B22ld
B22le
B22lf
B22lg
B22lh
B22li
B22lj
B22lk
B22ll
B22lm
B22ln
B22lo
B22lp
B22lq
B22lr
B22ls
B22lt
B22lu
B22lv
B22lw
B22lx
B22ly
B22lz
B22ma
B22mb
B22mc
B22md
B22me
B22mf
B22mg
B22mh
B22mi
B22mj
B22mk
B22ml
B22mm
B22mn
B22mo
B22mp
B22mq
B22mr
B22ms
B22mt
B22mu
B22mv
B22mw
B22mx
B22my
B22mz
B22na
B22nb
B22nc
B22nd
B22ne
B22nf
B22ng
B22nh
B22ni
B22nj
B22nk
B22nl
B22nm
B22nn
B22no
B22np
B22nq
B22nr
B22ns
B22nt
B22nu
B22nv
B22nw
B22nx
B22ny
B22nz
B22oa
B22ob
B22oc
B22od
B22oe
B22of
B22og
B22oh
B22oi
B22oj
B22ok
B22ol
B22om
B22on
B22oo
B22op
B22oq
B22or
B22os
B22ot
B22ou
B22ov
B22ow
B22ox
B22oy
B22oz
B22pa
B22pb
B22pc
B22pd
B22pe
B22pf
B22pg
B22ph
B22pi
B22pj
B22pk
B22pl
B22pm
B22pn
B22po
B22pp
B22pq
B22pr
B22ps
B22pt
B22pu
B22pv
B22pw
B22px
B22py
B22pz
B22qa
B22qb
B22qc
B22qd
B22qe
B22qf
B22qg
B22qh
B22qi
B22qj
B22qk
B22ql
B22qm
B22qn
B22qo
B22qp
B22qq
B22qr
B22qs
B22qt
B22qu
B22qv
B22qw
B22qx
B22qy
B22qz
B22ra
B22rb
B22rc
B22rd
B22re
B22rf
B22rg
B22rh
B22ri
B22rj
B22rk
B22rl
B22rm
B22rn
B22ro
B22rp
B22rq
B22rr
B22rs
B22rt
B22ru
B22rv
B22rw
B22rx
B22ry
B22rz
B22sa
B22sb
B22sc
B22sd
B22se
B22sf
B22sg
B22sh
B22si
B22sj
B22sk
B22sl
B22sm
B22sn
B22so
B22sp
B22sq
B22sr
B22ss
B22st
B22su
B22sv
B22sw
B22sx
B22sy
B22sz
B22ta
B22tb
B22tc
B22td
B22te
B22tf
B22tg
B22th
B22ti
B22tj
B22tk
B22tl
B22tm
B22tn
B22to
B22tp
B22tq
B22tr
B22ts
B22tt
B22tu
B22tv
B22tw
B22tx
B22ty
B22tz
B22ua
B22ub
B22uc
B22ud
B22ue
B22uf
B22ug
B22uh
B22ui
B22uj
B22uk
B22ul
B22um
B22un
B22uo
B22up
B22uq
B22ur
B22us
B22ut
B22uu
B22uv
B22uw
B22ux
B22uy
B22uz
B22va
B22vb
B22vc
B22vd
B22ve
B22vf
B22vg
B22vh
B22vi
B22vj
B22vk
B22vl
B22vm
B22vn
B22vo
B22vp
B22vq
B22vr
B22vs
B22vt
B22vu
B22vv
B22vw
B22vx
B22vy
B22vz
B22wa
B22wb
B22wc
B22wd
B22we
B22wf
B22wg
B22wh
B22wi
B22wj
B22wk
B22wl
B22wm
B22wn
B22wo
B22wp
B22wq
B22wr
B22ws
B22wt
B22wu
B22wv
B22ww
B22wx
B22wy
B22wz
B22xa
B22xb
B22xc
B22xd
B22xe
B22xf
B22xg
B22xh
B22xi
B22xj
B22xk
B22xl
B22xm
B22xn
B22xo
B22xp
B22xq
B22xr
B22xs
B22xt
B22xu
B22xv
B22xw
B22xx
B22xy
B22xz
B22ya
B22yb
B22yc
B22yd
B22ye
B22yf
B22yg
B22yh
B22yi
B22yj
B22yk
B22yl
B22ym
B22yn
B22yo
B22yp
B22yq
B22yr
B22ys
B22yt
B22yu
B22yv
B22yw
B22yx
B22yy
B22yz
B22za
B22zb
B22zc
B22zd
B22ze
B22zf
B22zg
B22zh
B22zi
B22zj
B22zk
B22zl
B22zm
B22zn
B22zo
B22zp
B22zq
B22zr
B22zs
B22zt
B22zu
B22zv
B22zw
B22zx
B22zy
B22zz
B22aaa
B22aab
B22aac
B22aad
B22aae
B22aaf
B22aag
B22aah
B22aai
B22aaj
B22aak
B22aal
B22aam
B22aan
B22aao
B22aap
B22aaq
B22aar
B22aas
B22aat
B22aau
B22aav
B22aaw
B22aax
B22aay
B22aaz
B22aba
B22abb
B22abc
B22abd
B22abe
B22abf
B22abg
B22abh
B22abi
B22abj
B22abk
B22abl
B22abm
B22abn
B22abo
B22abp
B22abq
B22abr
B22abs
B22abt
B22abu
B22abv
B22abw
B22abx
B22aby
B22abz
B22aca
B22acb
B22acc
B22acd
B22ace
B22acf
B22acg
B22ach
B22aci
B22acj
B22ack
B22acl
B22acm
B22acn
B22aco
B22acp
B22acq
B22acr
B22acs
B22act
B22acu
B22acv
B22acw
B22acx
B22acy
B22acz
B22ada
B22adb
B22adc
B22add
B22ade
B22adf
B22adg
B22adh
B22adi
B22adj
B22adk
B22adl
B22adm
B22adn
B22ado
B22adp
B22adq
B22adr
B22ads
B22adt
B22adu
B22adv
B22adw
B22adx
B22ady
B22adz
B22aea
B22aeb
B22aec
B22aed
B22aee
B22aef
B22aeg
B22aeh
B22aei
B22aej
B22aek
B22ael
B22aem
B22aen
B22aeo
B22aep
B22aeq
B22aer
B22aes
B22aet
B22aeu
B22aev
B22aew
B22aex
B22aey
B22aez
B22afa
B22afb
B22afc
B22afd
B22afe
B22aff
B22afg
B22afh
B22afi
B22afj
B22afk
B22afl
B22afm
B22afn
B22afo
B22afp
B22afq
B22afr
B22afs
B22aft
B22afu
B22afv
B22afw
B22afx
B22afy
B22afz
B22aga
B22agb
B22agc
B22agd
B22age
B22agf
B22agg
B22agh
B22agi
B22agj
B22agk
B22agl
B22agm
B22agn
B22ago
B22agp
B22agq
B22agr
B22ags
B22agt
B22agu
B22agv
B22agw
B22agx
B22agy
B22agz
B22aha
B22ahb
B22ahc
B22ahd
B22ahe
B22ahf
B22ahg
B22ahh
B22ahi
B22ahj
B22ahk
B22ahl
B22ahm
B22ahn
B22aho
B22ahp
B22ahq
B22ahr
B22ahs
B22aht
B22ahu
B22ahv
B22ahw
B22ahx
B22ahy
B22ahz
B22aia
B22aib
B22aic
B22aid
B22aie
B22aif
B22aig
B22aih
B22aii
B22aij
B22aik
B22ail
B22aim
B22ain
B22aio
B22aip
B22aiq
B22air
B22ais
B22ait
B22aiu
B22aiv
B22aiw
B22aix
B22aiy
B22aiz
B22aja
B22ajb
B22ajc
B22ajd
B22aje
B22ajf
B22ajg
B22ajh
B22aji
B22ajj
B22ajk
B22ajl
B22ajm
B22ajn
B22ajo
B22ajp
B22ajq
B22ajr
B22ajs
B22ajt
B22aju
B22ajv
B22ajw
B22ajx
B22ajy
B22ajz
B22aka
B22akb
B22akc
B22akd
B22ake
B22akf
B22akg
B22akh
B22aki
B22akj
B22akk
B22akl
B22akm
B22akn
B22ako
B22akp
B22akq
B22akr
B22aks
B22akt
B22aku
B22akv
B22akw
B22akx
B22aky
B22akz
B22ala
B22alb
B22alc
B22ald
B22ale
B22alf
B22alg
B22alh
B22ali
B22alj
B22alk
B22all
B22alm
B22aln
B22alo
B22alp
B22alq
B22alr
B22als
B22alt
B22alu
B22alv
B22alw
B22alx
B22aly
B22alz
B22ama
B22amb
B22amc
B22amd
B22ame
B22amf
B22amg
B22amh
B22ami
B22amj
B22amk
B22aml
B22amm
B22amn
B22amo
B22amp
B22amq
B22amr
B22ams
B22amt
B22amu
B22amv
B22amw
B22amx
B22amy
B22amz
B22ana
B22anb
B22anc
B22and
B22ane
B22anf
B22ang
B22anh
B22ani
B22anj
B22ank
B22anl
B22anm
B22ann
B22ano
B22anp
B22anq
B22anr
B22ans
B22ant
B22anu
B22anv
B22anw
B22anx
B22any
B22anz
B22aoa
B22aob
B22aoc
B22aod
B22aoe
B22aof
B22aog
B22aoh
B22aoi
B22aoj
B22aok
B22aol
B22aom
B22aon
B22aoo
B22aop
B22aoq
B22aor
B22aos
B22aot
B22aou
B22aov
B22aow
B22aox
B22aoy
B22aoz
B22apa
B22apb
B22apc
B22apd
B22ape
B22apf
B22apg
B22aph
B22api
B22apj
B22apk
B22apl
B22apm
B22apn
B22apo
B22app
B22apq
B22apr
B22aps
B22apt
B22apu
B22apv
B22apw
B22apx
B22apy
B22apz
B22aqa
B22aqb
B22aqc
B22aqd
B22aqe
B22aqf
B22aqg
B22aqh
B22aqi
B22aqj
B22aqk
B22aql
B22aqm
B22aqn
B22aqo
B22aqp
B22aqq
B22aqr
B22aqs
B22aqt
B22aqu
B22aqv
B22aqw
B22aqx
B22aqy
B22aqz
B22ara
B22arb
B22arc
B22ard
B22are
B22arf
B22arg
B22arh
B22ari
B22arj
B22ark
B22arl
B22arm
B22arn
B22aro
B22arp
B22arq
B22arr
B22ars
B22art
B22aru
B22arv
B22arw
B22arx
B22ary
B22arz
B22asa
B22asb
B22asc
B22asd
B22ase
B22asf
B22asg
B22ash
B22asi
B22asj
B22ask
B22asl
B22asm
B22asn
B22aso
B22asp
B22asq
B22asr
B22ass
B22ast
B22asu
B22asv
B22asw
B22asx
B22asy
B22asz
B22ata
B22atb
B22atc
B22atd
B22ate
B22atf
B22atg
B22ath
B22ati
B22atj
B22atk
B22atl
B22atm
B22atn
B22ato
B22atp
B22atq
B22atr
B22ats
B22att
B22atu
B22atv
B22atw
B22atx
B22aty
B22atz
B22aua
B22aub
B22auc
B22aud
B22aue
B22auf
B22aug
B22auh
B22aui
B22auj
B22auk
B22aul
B22aum
B22aun
B22auo
B22aup
B22auq
B22aur
B22aus
B22aut
B22auu
B22auv
B22auw
B22aux
B22auy
B22auz
B22ava
B22avb
B22avc
B22avd
B22ave
B22avf
B22avg
B22avh
B22avi
B22avj
B22avk
B22avl
B22avm
B22avn
B22avo
B22avp
B22avq
B22avr
B22avs
B22avt
B22avu
B22avv
B22avw
B22avx
B22avy
B22avz
B22awa
B22awb
B22awc
B22awd
B22awe
B22awf
B22awg
B22awh
B22awi
B22awj
B22awk
B22awl
B22awm
B22awn
B22awo
B22awp
B22awq
B22awr
B22aws
B22awt
B22awu
B22awv
B22aww
B22awx
B22awy
B22awz
B22axa
B22axb
B22axc
B22axd
B22axe
B22axf
B22axg
B22axh
B22axi
B22axj
B22axk
B22axl
B22axm
B22axn
B22axo
B22axp
B22axq
B22axr
B22axs
B22axt
B22axu
B22axv
B22axw
B22axx
B22axy
B22axz
B22aya
B22ayb
B22ayc
B22ayd
B22aye
B22ayf
B22ayg
B22ayh
B22ayi
B22ayj
B22ayk
B22ayl
B22aym
B22ayn
B22ayo
B22ayp
B22ayq
B22ayr
B22ays
B22ayt
B22ayu
B22ayv
B22ayw
B22ayx
B22ayy
B22ayz
B22aza
B22azb
B22azc
B22azd
B22aze
B22azf
B22azg
B22azh
B22azi
B22azj
B22azk
B22azl
B22azm
B22azn
B22azo
B22azp
B22azq
B22azr
B22azs
B22azt
B22azu
B22azv
B22azw
B22azx
B22azy
B22azz
B22baa
B22bab
B22bac
B22bad
B22bae
B22baf
B22bag
B22bah
B22bai
B22baj
B22bak
B22bal
B22bam
B22ban
B22bao
B22bap
B22baq
B22bar
B22bas
B22bat
B22bau
B22bav
B22baw
B22bax
B22bay
B22baz
B22bba
B22bbb
B22bbc
B22bbd
B22bbe
B22bbf
B22bbg
B22bbh
B22bbi
B22bbj
B22bbk
B22bbl
B22bbm
B22bbn
B22bbo
B22bbp
B22bbq
B22bbr
B22bbs
B22bbt
B22bbu
B22bbv
B22bbw
B22bbx
B22bby
B22bbz
B22bca
B22bcb
B22bcc
B22bcd
B22bce
B22bcf
B22bcg
B22bch
B22bci
B22bcj
B22bck
B22bcl
B22bcm
B22bcn
B22bco
B22bcp
B22bcq
B22bcr
B22bcs
B22bct
B22bcu
B22bcv
B22bcw
B22bcx
B22bcy
B22bcz
B22bda
B22bdb
B22bdc
B22bdd
B22bde
B22bdf
B22bdg
B22bdh
B22bdi
B22bdj
B22bdk
B22bdl
B22bdm
B22bdn
B22bdo
B22bdp
B22bdq
B22bdr
B22bds
B22bdt
B22bdu
B22bdv
B22bdw
B22bdx
B22bdy
B22bdz
B22bea
B22beb
B22bec
B22bed
B22bee
B22bef
B22beg
B22beh
B22bei
B22bej
B22bek
B22bel
B22bem
B22ben
B22beo
B22bep
B22beq
B22ber
B22bes
B22bet
B22beu
B22bev
B22bew
B22bex
B22bey
B22bez
B22bfa
B22bfb
B22bfc
B22bfd
B22bfe
B22bff
B22bfg
B22bfh
B22bfi
B22bfj
B22bfk
B22bfl
B22bfm
B22bfn
B22bfo
B22bfp
B22bfq
B22bfr
B22bfs
B22bft
B22bfu
B22bfv
B22bfw
B22bfx
B22bfy
B22bfz
B22bga
B22bgb
B22bgc
B22bgd
B22bge
B22bgf
B22bgg
B22bgh
B22bgi
B22bgj
B22bgk
B22bgl
B22bgm
B22bgn
B22bgo
B22bgp
B22bgq
B22bgr
B22bgs
B22bgt
B22bgu
B22bgv
B22bgw
B22bgx
B22bgy
B22bgz
B22bha
B22bhb
B22bhc
B22bhd
B22bhe
B22bhf
B22bhg
B22bhh
B22bhi
B22bhj
B22bhk
B22bhl
B22bhm
B22bhn
B22bho
B22bhp
B22bhq
B22bhr
B22bhs
B22bht
B22bhu
B22bhv
B22bhw
B22bhx
B22bhy
B22bhz
B22bia
B22bib
B22bic
B22bid
B22bie
B22bif
B22big
B22bih
B22bii
B22bij
B22bik
B22bil
B22bim
B22bin
B22bio
B22bip
B22biq
B22bir
B22bis
B22bit
B22biu
B22biv
B22biw
B22bix
B22biy
B22biz
B22bja
B22bjb
B22bjc
B22bjd
B22bje
B22bjf
B22bjg
B22bjh
B22bji
B22bjj
B22bjk
B22bjl
B22bjm
B22bjn
B22bjo
B22bjp
B22bjq
B22bjr
B22bjs
B22bjt
B22bju
B22bjv
B22bjw
B22bjx
B22bjy
B22bjz
B22bka
B22bkb
B22bkc
B22bkd
B22bke
B22bkf
B22bkg
B22bkh
B22bki
B22bkj
B22bkk
B22bkl
B22bkm
B22bkn
B22bko
B22bkp
B22bkq
B22bkr
B22bks
B22bkt
B22bku
B22bkv
B22bkw
B22bkx
B22bky
B22bkz
B22bla
B22blb
B22blc
B22bld
B22ble
B22blf
B22blg
B22blh
B22bli
B22blj
B22blk
B22bll
B22blm
B22bln
B22blo
B22blp
B22blq
B22blr
B22bls
B22blt
B22blu
B22blv
B22blw
B22blx
B22bly
B22blz
B22bma
B22bmb
B22bmc
B22bmd
B22bme
B22bmf
B22bmg
B22bmh
B22bmi
B22bmj
B22bmk
B22bml
B22bmm
B22bmn
B22bmo
B22bmp
B22bmq
B22bmr
B22bms
B22bmt
B22bmu
B22bmv
B22bmw
B22bmx
B22bmy
B22bmz
B22bna
B22bnb
B22bnc
B22bnd
B22bne
B22bnf
B22bng
B22bnh
B22bni
B22bnj
B22bnk
B22bnl
B22bnm
B22bnn
B22bno
B22bnp
B22bnq
B22bnr
B22bns
B22bnt
B22bnu
B22bnv
B22bnw
B22bnx
B22bny
B22bnz
B22boa
B22bob
B22boc
B22bod
B22boe
B22bof
B22bog
B22boh
B22boi
B22boj
B22bok
B22bol
B22bom
B22bon
B22boo
B22bop
B22boq
B22bor
B22bos
B22bot
B22bou
B22bov
B22bow
B22box
B22boy
B22boz
B22bpa
B22bpb
B22bpc
B22bpd
B22bpe
B22bpf
B22bpg
B22bph
B22bpi
B22bpj
B22bpk
B22bpl
B22bpm
B22bpn
B22bpo
B22bpp
B22bpq
B22bpr
B22bps
B22bpt
B22bpu
B22bpv
B22bpw
B22bpx
B22bpy
B22bpz
B22bqa
B22bqb
B22bqc
B22bqd
B22bqe
B22bqf
B22bqg
B22bqh
B22bqi
B22bqj
B22bqk
B22bql
B22bqm
B22bqn
B22bqo
B22bqp
B22bqq
B22bqr
B22bqs
B22bqt
B22bqu
B22bqv
B22bqw
B22bqx
B22bqy
B22bqz
B22bra
B22brb
B22brc
B22brd
B22bre
B22brf
B22brg
B22brh
B22bri
B22brj
B22brk
B22brl
B22brm
B22brn
B22bro
B22brp
B22brq
B22brr
B22brs
B22brt
B22bru
B22brv
B22brw
B22brx
B22bry
B22brz
B22bsa
B22bsb
B22bsc
B22bsd
B22bse
B22bsf
B22bsg
B22bsh
B22bsi
B22bsj
B22bsk
B22bsl
B22bsm
B22bsn
B22bso
B22bsp
B22bsq
B22bsr
B22bss
B22bst
B22bsu
B22bsv
B22bsw
B22bsx
B22bsy
B22bsz
B22bta
B22btb
B22btc
B22btd
B22bte
B22btf
B22btg
B22bth
B22bti
B22btj
B22btk
B22btl
B22btm
B22btn
B22bto
B22btp
B22btq
B22btr
B22bts
B22btt
B22btu
B22btv
B22btw
B22btx
B22bty
B22btz
B22bua
B22bub
B22buc
B22bud
B22bue
B22buf
B22bug
B22buh
B22bui
B22buj
B22buk
B22bul
B22bum
B22bun
B22buo
B22bup
B22buq
B22bur
B22bus
B22but
B22buu
B22buv
B22buw
B22bux
B22buy
B22buz
B22bva
B22bvb
B22bvc
B22bvd
B22bve
B22bvf
B22bvg
B22bvh
B22bvi
B22bvj
B22bvk
B22bvl
B22bvm
B22bvn
B22bvo
B22bvp
B22bvq
B22bvr
B22bvs
B22bvt
B22bvu
B22bvv
B22bvw
B22bvx
B22bvy
B22bvz
B22bwa
B22bwb
B22bwc
B22bwd
B22bwe
B22bwf
B22bwg
B22bwh
B22bwi
B22bwj
B22bwk
B22bwl
B22bwm
B22bwn
B22bwo
B22bwp
B22bwq
B22bwr
B22bws
B22bwt
B22bwu
B22bwv
B22bww
B22bwx
B22bwy
B22bwz
B22bxa
B22bxb
B22bxc
B22bxd
B22bxe
B22bxf
B22bxg
B22bxh
B22bxi
B22bxj
B22bxk
B22bxl
B22bxm
B22bxn
B22bxo
B22bxp
B22bxq
B22bxr
B22bxs
B22bxt
B22bxu
B22bxv
B22bxw
B22bxx
B22bxy
B22bxz
B22bya
B22byb
B22byc
B22byd
B22bye
B22byf
B22byg
B22byh
B22byi
B22byj
B22byk
B22byl
B22bym
B22byn
B22byo
B22byp
B22byq
B22byr
B22bys
B22byt
B22byu
B22byv
B22byw
B22byx
B22byy
B22byz
B22bza
B22bzb
B22bzc
B22bzd
B22bze
B22bzf
B22bzg
B22bzh
B22bzi
B22bzj
B22bzk
B22bzl
B22bzm
B22bzn
B22bzo
B22bzp
B22bzq
B22bzr
B22bzs
B22bzt
B22bzu
B22bzv
B22bzw
B22bzx
B22bzy
B22bzz
B22caa
B22cab
B22cac
B22cad
B22cae
B22caf
B22cag
B22cah
B22cai
B22caj
B22cak
B22cal
B22cam
B22can
B22cao
B22cap
B22caq
B22car
B22cas
B22cat
B22cau
B22cav
B22caw
B22cax
B22cay
B22caz
B22cba
B22cbb
B22cbc
B22cbd
B22cbe
B22cbf
B22cbg
B22cbh
B22cbi
B22cbj
B22cbk
B22cbl
B22cbm
B22cbn
B22cbo
B22cbp
B22cbq
B22cbr
B22cbs
B22cbt
B22cbu
B22cbv
B22cbw
B22cbx
B22cby
B22cbz
B22cca
B22ccb
B22ccc
B22ccd
B22cce
B22ccf
B22ccg
B22cch
B22cci
B22ccj
B22cck
B22ccl
B22ccm
B22ccn
B22cco
B22ccp
B22ccq
B22ccr
B22ccs
B22cct
B22ccu
B22ccv
B22ccw
B22ccx
B22ccy
B22ccz
B22cda
B22cdb
B22cdc
B22cdd
B22cde
B22cdf
B22cdg
B22cdh
B22cdi
B22cdj
B22cdk
B22cdl
B22cdm
B22cdn
B22cdo
B22cdp
B22cdq
B22cdr
B22cds
B22cdt
B22cdu
B22cdv
B22cdw
B22cdx
B22cdy
B22cdz
B22cea
B22ceb
B22cec
B22ced
B22cee
B22cef
B22ceg
B22ceh
B22cei
B22cej
B22cek
B22cel
B22cem
B22cen
B22ceo
B22cep
B22ceq
B22cer
B22ces
B22cet
B22ceu
B22cev
B22cew
B22cex
B22cey
B22cez
B22cfa
B22cfb
B22cfc
B22cfd
B22cfe
B22cff
B22cfg
B22cfh
B22cfi
B22cfj
B22cfk
B22cfl
B22cfm
B22cfn
B22cfo
B22cfp
B22cfq
B22cfr
B22cfs
B22cft
B22cfu
B22cfv
B22cfw
B22cfx
B22cfy
B22cfz
B22cga
B22cgb
B22cgc
B22cgd
B22cge
B22cgf
B22cgg
B22cgh
B22cgi
B22cgj
B22cgk
B22cgl
B22cgm
B22cgn
B22cgo
B22cgp
B22cgq
B22cgr
B22cgs
B22cgt
B22cgu
B22cgv
B22cgw
B22cgx
B22cgy
B22cgz
B22cha
B22chb
B22chc
B22chd
B22che
B22chf
B22chg
B22chh
B22chi
B22chj
B22chk
B22chl
B22chm
B22chn
B22cho
B22chp
B22chq
B22chr
B22chs
B22cht
B22chu
B22chv
B22chw
B22chx
B22chy
B22chz
B22cia
B22cib
B22cic
B22cid
B22cie
B22cif
B22cig
B22cih
B22cii
B22cij
B22cik
B22cil
B22cim
B22cin
B22cio
B22cip
B22ciq
B22cir
B22cis
B22cit
B22ciu
B22civ
B22ciw
B22cix
B22ciy
B22ciz
B22cja
B22cjb
B22cjc
B22cjd
B22cje
B22cjf
B22cjg
B22cjh
B22cji
B22cjj
B22cjk
B22cjl
B22cjm
B22cjn
B22cjo
B22cjp
B22cjq
B22cjr
B22cjs
B22cjt
B22cju
B22cjv
B22cjw
B22cjx
B22cjy
B22cjz
B22cka
B22ckb
B22ckc
B22ckd
B22cke
B22ckf
B22ckg
B22ckh
B22cki
B22ckj
B22ckk
B22ckl
B22ckm
B22ckn
B22cko
B22ckp
B22ckq
B22ckr
B22cks
B22ckt
B22cku
B22ckv
B22ckw
B22ckx
B22cky
B22ckz
B22cla
B22clb
B22clc
B22cld
B22cle
B22clf
B22clg
B22clh
B22cli
B22clj
B22clk
B22cll
B22clm
B22cln
B22clo
B22clp
B22clq
B22clr
B22cls
B22clt
B22clu
B22clv
B22clw
B22clx
B22cly
B22clz
B22cma
B22cmb
B22cmc
B22cmd
B22cme
B22cmf
B22cmg
B22cmh
B22cmi
B22cmj
B22cmk
B22cml
B22cmm
B22cmn
B22cmo
B22cmp
B22cmq
B22cmr
B22cms
B22cmt
B22cmu
B22cmv
B22cmw
B22cmx
B22cmy
B22cmz
B22cna
B22cnb
B22cnc
B22cnd
B22cne
B22cnf
B22cng
B22cnh
B22cni
B22cnj
B22cnk
B22cnl
B22cnm
B22cnn
B22cno
B22cnp
B22cnq
B22cnr
B22cns
B22cnt
B22cnu
B22cnv
B22cnw
B22cnx
B22cny
B22cnz
B22coa
B22cob
B22coc
B22cod
B22coe
B22cof
B22cog
B22coh
B22coi
B22coj
B22cok
B22col
B22com
B22con
B22coo
B22cop
B22coq
B22cor
B22cos
B22cot
B22cou
B22cov
B22cow
B22cox
B22coy
B22coz
B22cpa
B22cpb
B22cpc
B22cpd
B22cpe
B22cpf
B22cpg
B22cph
B22cpi
B22cpj
B22cpk
B22cpl
B22cpm
B22cpn
B22cpo
B22cpp
B22cpq
B22cpr
B22cps
B22cpt
B22cpu
B22cpv
B22cpw
B22cpx
B22cpy
B22cpz
B22cqa
B22cqb
B22cqc
B22cqd
B22cqe
B22cqf
B22cqg
B22cqh
B22cqi
B22cqj
B22cqk
B22cql
B22cqm
B22cqn
B22cqo
B22cqp
B22cqq
B22cqr
B22cqs
B22cqt
B22cqu
B22cqv
B22cqw
B22cqx
B22cqy
B22cqz
B22cra
B22crb
B22crc
B22crd
B22cre
B22crf
B22crg
B22crh
B22cri
B22crj
B22crk
B22crl
B22crm
B22crn
B22cro
B22crp
B22crq
B22crr
B22crs
B22crt
B22cru
B22crv
B22crw
B22crx
B22cry
B22crz
B22csa
B22csb
B22csc
B22csd
B22cse
B22csf
B22csg
B22csh
B22csi
B22csj
B22csk
B22csl
B22csm
B22csn
B22cso
B22csp
B22csq
B22csr
B22css
B22cst
B22csu
B22csv
B22csw
B22csx
B22csy
B22csz
B22cta
B22ctb
B22ctc
B22ctd
B22cte
B22ctf
B22ctg
B22cth
B22cti
B22ctj
B22ctk
B22ctl
B22ctm
B22ctn
B22cto
B22ctp
B22ctq
B22ctr
B22cts
B22ctt
B22ctu
B22ctv
B22ctw
B22ctx
B22cty
B22ctz
B22cua
B22cub
B22cuc
B22cud
B22cue
B22cuf
B22cug
B22cuh
B22cui
B22cuj
B22cuk
B22cul
B22cum
B22cun
B22cuo
B22cup
B22cuq
B22cur
B22cus
B22cut
B22cuu
B22cuv
B22cuw
B22cux
B22cuy
B22cuz
B22cva
B22cvb
B22cvc
B22cvd
B22cve
B22cvf
B22cvg
B22cvh
B22cvi
B22cvj
B22cvk
B22cvl
B22cvm
B22cvn
B22cvo
B22cvp
B22cvq
B22cvr
B22cvs
B22cvt
B22cvu
B22cvv
B22cvw
B22cvx
B22cvy
B22cvz
B22cwa
B22cwb
B22cwc
B22cwd
B22cwe
B22cwf
B22cwg
B22cwh
B22cwi
B22cwj
B22cwk
B22cwl
B22cwm
B22cwn
B22cwo
B22cwp
B22cwq
B22cwr
B22cws
B22cwt
B22cwu
B22cwv
B22cww
B22cwx
B22cwy
B22cwz
B22cxa
B22cxb
B22cxc
B22cxd
B22cxe
B22cxf
B22cxg
B22cxh
B22cxi
B22cxj
B22cxk
B22cxl
B22cxm
B22cxn
B22cxo
B22cxp
B22cxq
B22cxr
B22cxs
B22cxt
B22cxu
B22cxv
B22cxw
B22cxx
B22cxy
B22cxz
B22cya
B22cyb
B22cyc
B22cyd
B22cye
B22cyf
B22cyg
B22cyh
B22cyi
B22cyj
B22cyk
B22cyl
B22cym
B22cyn
B22cyo
B22cyp
B22cyq
B22cyr
B22cys
B22cyt
B22cyu
B22cyv
B22cyw
B22cyx
B22cyy
B22cyz
B22cza
B22czb
B22czc
B22czd
B22cze
B22czf
B22czg
B22czh
B22czi
B22czj
B22czk
B22czl
B22czm
B22czn
B22czo
B22czp
B22czq
B22czr
B22czs
B22czt
B22czu
B22czv
B22czw
B22czx
B22czy
B22czz
B22daa
B22dab
B22dac
B22dad
B22dae
B22daf
B22dag
B22dah
B22dai
B22daj
B22dak
B22dal
B22dam
B22dan
B22dao
B22dap
B22daq
B22dar
B22das
B22dat
B22dau
B22dav
B22daw
B22dax
B22day
B22daz
B22dba
B22dbb
B22dbc
B22dbd
B22dbe
B22dbf
B22dbg
B22dbh
B22dbi
B22dbj
B22dbk
B22dbl
B22dbm
B22dbn
B22dbo
B22dbp
B22dbq
B22dbr
B22dbs
B22dbt
B22dbu
B22dbv
B22dbw
B22dbx
B22dby
B22dbz
B22dca
B22dcb
B22dcc
B22dcd
B22dce
B22dcf
B22dcg
B22dch
B22dci
B22dcj
B22dck
B22dcl
B22dcm
B22dcn
B22dco
B22dcp
B22dcq
B22dcr
B22dcs
B22dct
B22dcu
B22dcv
B22dcw
B22dcx
B22dcy
B22dcz
B22dda
B22ddb
B22ddc
B22ddd
B22dde
B22ddf
B22ddg
B22ddh
B22ddi
B22ddj
B22ddk
B22ddl
B22ddm
B22ddn
B22ddo
B22ddp
B22ddq
B22ddr
B22dds
B22ddt
B22ddu
B22ddv
B22ddw
B22ddx
B22ddy
B22ddz
B22dea
B22deb
B22dec
B22ded
B22dee
B22def
B22deg
B22deh
B22dei
B22dej
B22dek
B22del
B22dem
B22den
B22deo
B22dep
B22deq
B22der
B22des
B22det
B22deu
B22dev
B22dew
B22dex
B22dey
B22dez
B22dfa
B22dfb
B22dfc
B22dfd
B22dfe
B22dff
B22dfg
B22dfh
B22dfi
B22dfj
B22dfk
B22dfl
B22dfm
B22dfn
B22dfo
B22dfp
B22dfq
B22dfr
B22dfs
B22dft
B22dfu
B22dfv
B22dfw
B22dfx
B22dfy
B22dfz
B22dga
B22dgb
B22dgc
B22dgd
B22dge
B22dgf
B22dgg
B22dgh
B22dgi
B22dgj
B22dgk
B22dgl
B22dgm
B22dgn
B22dgo
B22dgp
B22dgq
B22dgr
B22dgs
B22dgt
B22dgu
B22dgv
B22dgw
B22dgx
B22dgy
B22dgz
B22dha
B22dhb
B22dhc
B22dhd
B22dhe
B22dhf
B22dhg
B22dhh
B22dhi
B22dhj
B22dhk
B22dhl
B22dhm
B22dhn
B22dho
B22dhp
B22dhq
B22dhr
B22dhs
B22dht
B22dhu
B22dhv
B22dhw
B22dhx
B22dhy
B22dhz
B22dia
B22dib
B22dic
B22did
B22die
B22dif
B22dig
B22

GAME WITH CHANCE ELEMENT OR EVENT SIMULATION

CROSS REFERENCE TO RELATED APPLICATIONS

This application is a continuation of U.S. patent application Ser. No. 11/869,368 filed Oct. 9, 2007 which is hereby incorporated by reference herein in its entirety.

BRIEF DESCRIPTION OF THE FIGURES

FIG. 8 is a block diagram of a gaming system in accordance with some embodiments.

FIG. 11(*b*) is a flow diagram of a particular method of using the portable gaming device by a player, according to some embodiments.

DETAILED DESCRIPTION

Figure 1:
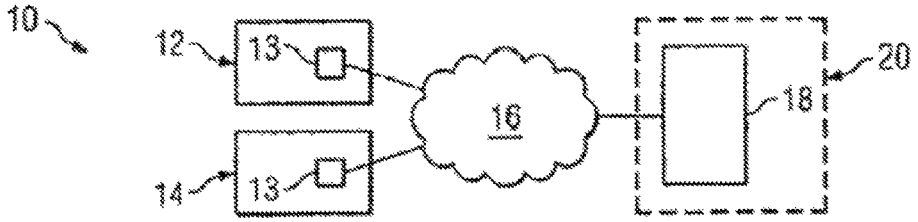
FIG. 1 shows a gaming system according to some embodiments.

In various embodiments, a player may prepare for using a mobile gaming device. In various embodiments, a player may practice using a simulation of mobile gaming device. The player may practice using the simulation over a network, such as over the Internet. By practicing use of the mobile gaming device, a player may be less intimidated or frustrated when he tries using a real mobile gaming device for the first time. In various embodiments, a player may customize a simulated version of a mobile gaming device. Customizations made by the player may be subsequently realized on a real mobile gaming device. For example, customize the screen on the simulated mobile gaming device to look one way. Subsequently, the player may receive a real mobile gaming device with the screen already configured, or readily configurable, to look the same way.

The Simulation

In various embodiments, a player may play a simulation of a game on the Web or over some other network. The simulation may include graphics which depict or are otherwise similar to graphics that would be used in a real gaming environment. In various embodiments, the player himself may not be in a legal gaming environment, or in an environment where he can gamble with real money. Thus, while playing a game over the network, the player may be confined to using points, currency, credits, play money, or other tokens with no real value.

In various embodiments, a simulation may include sounds that are the same or similar to sounds used in a game played with real money. In various embodiments, a simulation may depict a mobile gaming device. For example, a player's computer screen may show a depiction of a mobile gaming device. The depiction of the mobile gaming device may show the mobile gaming device to include a screen of its own, with graphics presented on the screen. Thus, the graphics on the screen of the mobile gaming device will appear to the player who is playing over the Internet as a picture within a picture. The mobile gaming device itself would just be a picture, in various embodiments. A picture, image, or depiction of a mobile gaming device may include depictions of input devices, such as buttons. The depiction of the mobile gaming device may include depictions of speakers, microphones, antenna, and any other hardware features of the actual mobile gaming device being depicted. In various embodiments, the player playing or watching the simulation may have the opportunity to manipulate the viewing angle of the mobile gaming device. For example, the player may have the opportunity to manipulate the image of the mobile gaming device so that he is watching from the top, from the side, from the bottom, or from any other angle.

In various embodiments, a player watching or playing a simulation may have the opportunity to interact with simulated buttons. For example, a graphic on his computer screen may represent a button of the mobile gaming device. The player may activate the button by clicking while his mouse cursor is situated over the button. For example, to make a bet, a player may move his mouse cursor over a depiction of a "bet" button and click with his mouse.

In various embodiments, keys on a computer key-board may be co-opted to function like keys on the mobile gaming device. Thus, in playing on a simulated mobile gaming device, a player may press keys on his keyboard to indicate decisions such as whether to hit or stand, how much to bet, which cards to hold, and so on.

In various embodiments, a simulation may utilize real or actual outcomes that have been previously generated, such as at a mobile gaming device. A player may watch a simulation over the Web. The simulation may reenact a game that had occurred at a mobile gaming device, where such game was played with real money at risk. The simulation may be recreated from data received from the real game. For example, data indicative of the type of game played, the outcome generated and the payout may be transmitted to the player's personal computer, or other player device. Software on the personal computer (e.g., software previously downloaded from the casino Website) may use the received data to create a reenactment of the game which had been previously played with real money at risk. In various embodiments, the casino server may recreate or reenact a game using the data. The casino server may then transmit to the player's personal computer (or other player device) a sequence of images which depict the game. In various embodiments, a mobile gaming device that conducts a game with real money at risk may transmit images from the game to a casino server. The casino server may then transmit such images to a player's personal computer (or other player device) in order to allow the computer to recreate the game.

In various embodiments, a player who is viewing a simulation over the Internet may also participate in the game being simulated. The player may make bets consisting of play money (i.e., money with no value). A simulation of the game and its resolution may then be shown to the player. The player may then receive more play money if his bet was a winning bet.

In various embodiments, a player may view a video or other depiction of real games that had been played at a mobile gaming device. The video may hide or obscure one or more features e.g., for privacy reasons. For example, a video may depict another player playing a mobile gaming device. However, the face of the other player may be blocked out so that the player watching the video cannot readily identify the other player. The video may include a video captured from security cameras in a casino, and later broadcast to the player's computer, or other player device, over the Internet.

In various embodiments, typical play patterns of a player in a simulation may be analyzed. Play patterns may include how many credits the player bets per game, how much money the player bets per game, which bets the player makes (e.g., which color does the player usually bet on; e.g., in craps, does the player usually bet pass or don't pass), what strategy a player typically uses, how many pay lines a player typically uses, or any other play patterns. A play pattern may include a manner in which a player views a game. The play pattern may include, for example, whether a player views a game in a 2-D or in a 3-D perspective.

A play pattern may be ported to a mobile gaming device. For example, typical decisions made by a player in a simulation may be set as default decisions for a player on a mobile gaming device when playing for real money. For example, the mobile gaming device may be configured so that a player can simply start a game without explicitly specifying a bet size. The actual bet size used may be based on the preferred bet size used by the player.

Customizable Options

In various embodiments, a player may customize one or more of the following aspects of a mobile gaming device: (a) the overall size of the mobile gaming device; (b) the weight of the mobile gaming device; (c) the color of the mobile gaming device; (d) a sound made by the mobile gaming device; (e) a sound made by the mobile gaming device when a game is won; (f) a sound made by the mobile gaming device when a game is lost; (g) a sound made by the mobile gaming device when a player is being paid; (h) a sound made by the mobile gaming device when the mobile gaming device reaches a zone where gaming is not permissible; (i) a size of a button on the mobile gaming device; (j) a screen size on the mobile gaming device; (k) a type of input device used on the mobile gaming device (e.g., the player may determine whether a touch pad is used, whether a thumb wheel is used, whether a button is used, or whether any other device is used); (l) a battery life of the mobile gaming device; (m) the type of screen to be used on the mobile gaming device; (n) a graphic to appear on the housing of the mobile gaming device; (o) a graphic that will appear on the screen of the mobile gaming device; (p) a color of a button or other input device on the mobile gaming device; (q) a power at which the mobile gaming device will be capable of transmitting; (r) the location of a button or other input device; or any other aspect of the mobile gaming device.

Customize the Play of the Game:

In various embodiments, a player may customize one or more features game play. A player may customize: (a) a sound level; (b) a speed of play (e.g., the player may indicate whether play should proceed at 5 games per minute or at 8 games per minute); (c) the betting denomination to be used in a game (e.g., 5-cent bets, e.g., 25 cent bets); (d) the number of pay lines to be used in a game (e.g., the player may indicate that he wishes to use five pay lines in a game); (e) the type of game (e.g., video poker; e.g., slot machine; e.g., blackjack); (f) the look of one or more game indicia (e.g., the player may choose whether he would prefer a two-color card deck or a four-color card deck); (g) whether or not a mobile gaming device will play automatically for a player; (h) whether a mobile gaming device will allow a player to participate in newly generated games for the player, or whether the mobile gaming device will allow the player to bet on the events or outcomes of other people's games; and any other features of game play.

In various embodiments, a player may indicate one or more friends, relatives, associates, or other people. Such people may constitute a buddy list, for example. The player may customize his mobile gaming device so that he can communicate with other people he has designated, so that he can see the images or avatars of other people, so that he and others can show each other outcomes they have received, so that the player can be aware of the location of others, so that others can be aware of the player's location, so that the player may transfer money to others or receive money from others, or so that the player may in any way interact with others.

Registering and Identifying Himself in the Real Casino

In various embodiments, a player may provide a name, social security number, a handle, a player tracking card number or any other identifying information. The player may provide such information in conjunction with commencing or engaging in a practice session with a simulated mobile gaming device. For example, a player may visit a Web site of a casino. The player may indicate that he wishes to practice play with a simulated mobile gaming device. The player may then be given the opportunity to play a game on his computer which represents or mimics the way play would occur on a mobile gaming device at a casino. Before playing, while playing, or after finishing play, the player may be asked for identifying information. The player may provide such information to the casino. In some embodiments, the casino may provide a player with a password, handle, or other unique identifier.

When a player later wishes to check out a real mobile gaming device, e.g., upon visiting a casino, the player may submit his name, social security number, or other associated identifier. The identifier submitted by the player may be one chosen by the player or one provided to him by the casino. Once submitted, the player's identifier may be matched to prior identifiers associated with people who had practiced through the Web. In this fashion, the casino may be able to associate a player who asks to use a real mobile gaming device with a practice session that occurred on the Web. Presumably, in various embodiments, the player who had practiced through the Web is the same person that is now seeking to check out a real mobile gaming device.

When a real mobile gaming device is then provided to the player, the real mobile gaming device may be configured to be familiar or comfortable to the player based on the practice session already played by the player on the Web. For example, the mobile gaming device given to the player may be loaded with similar games to those already played by the player in simulated versions on the Web. As another example, a player may be provided with a mobile gaming device with a similar button arrangement, form factor, or other appearance which matches the appearance of a simulated mobile gaming device which had been shown to the player on the Web.

In various embodiments, a player may provide an identifier in the form of biometric data. The identifier may be provided over the Web, in person when checking out a mobile gaming device, or on both occasions. For example, the player may make a voice recording on his personal computer and send the resulting sound file to the casino server. The sound file may be analyzed for unique voice characteristics of the player. When the player subsequently visits a casino to check out a mobile gaming device, he may also provide a voice sample. The new voice sample may be analyzed and ultimately found to match the old one, thus identifying the visiting player as the same player who submitted his voice over the Web. Other biometric identifiers may be based on finger prints, retinal scans, images of a player's face (e.g., allowing facial recognition), DNA sequences, or based on any other feature that may be tied to a person.

In various embodiments, a player may first identify himself, or be identified, at a stationary gaming device, such as at a slot machine or video poker machine. For example, the player may have his player tracking card inserted into a slot machine. The player may further play a game at the slot machine which can also be played on the mobile gaming device. The game played at the slot machine may be for real money or it may be with no money at risk. In various embodiments, the player may later wish to receive a mobile gaming device. The player may once again identify himself (e.g., to a casino attendant responsible for giving out mobile gaming devices). The casino may recognize that the player who is being given the mobile gaming device is the same player as the player who was identified at the slot machine or other stationary device. Therefore, the mobile gaming device may be configured in accordance with any preferences or playing patterns established by the player at the stationary device. For example, if the player typically bet 3 credits per game at the stationary device, the player may be provided with a mobile gaming device whose default bet is 3 credits per game.

Practice Device

In various embodiments, a player may be sent a practice device. The player may provide a mailing address, such as a postal mailing address. A practice device may be shipped to the player's mailing address. The device may have a similar appearance to that of a mobile gaming device. The device may further function in a manner similar to that of a mobile gaming device. For example, the practice device may have a similar color, similar size, and similar button arrangements to that of a real mobile gaming device. Further the practice device may show games which use similar graphics to that of a mobile gaming device. Further the games on the practice device may play out in the same way as do games on a mobile gaming device. Buttons or other input devices may have similar functions on the practice device as do buttons on an actual mobile gaming device. For example, a first button on a practice device may allow a player to place a bet. A similarly looking and similarly situated button on a mobile gaming device may also allow a player to bet.

In various embodiments, a practice device may have one or more distinguishing features that marks the device as a practice device. The device may have text printed on its housing which says, "for amusement only", "not for real money", "for practice only", or the like. Similar text or messages may be displayed on a screen of the practice device during play of a game. In various embodiments, a balance of credits, points, or other currency that is displayed on the practice device may be labeled in a different way from the way in which currency with monetary value would be labeled. For example, a balance may be labeled as "practice dollars". Graphics depicting currency may take on differing appearances depending on whether the currency has monetary value or not.

In various embodiments, a practice device may be an actual mobile gaming device which has been disabled in some way. For example, a casino employee may have extracted a first program chip and inserted a second program chip, the second program chip allowing the use of the device only for practice reasons. In various embodiments, the practice device may constitute a real mobile gaming device. However, the practice device may be unusable for games with real money at risk to the player because the player may be situated in a location in which gaming is not permitted. Thus, location sensors (e.g., GPS sensors) within the device may ensure that the device can only be used for practice.

Winning Real Prizes

Figure 14:
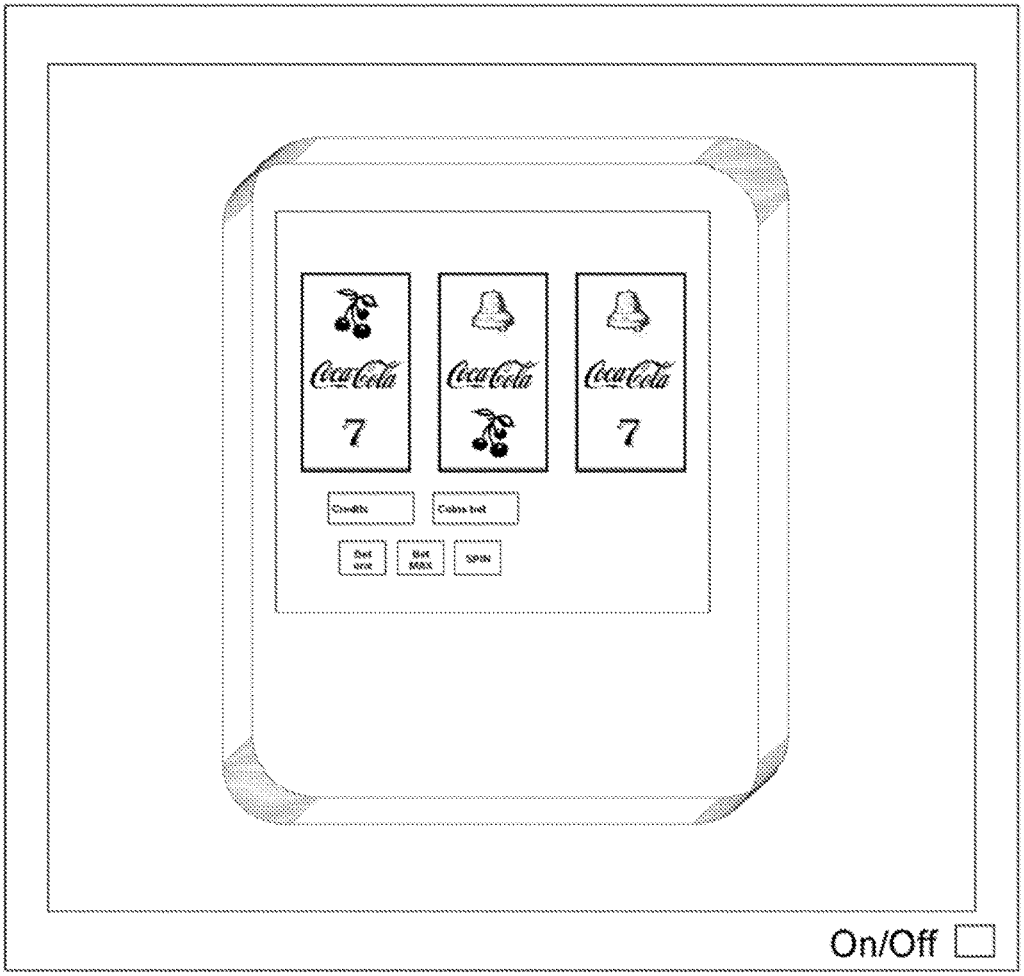
FIG. 14 is a mobile gaming device as viewed on a computer screen according to some embodiments.

In various embodiments, a player may play a simulation with no money at risk. In various embodiments, a player may have the opportunity to win real money, real prizes, or other items of real value. The player may be given such opportunity without risking the loss of any of his own money. In various embodiments, the advertisements or other promotions may be shown on the simulated version of the mobile gaming device. In various embodiments, promotions may appear on another area of the player's computer screen, in which the other area is not the area where the simulated mobile gaming device is located. An advertiser may be willing to sponsor prizes for the player to win in return for the opportunity to present such promotions to the player. Thus, if a player plays a simulation of a game at a mobile gaming device, and views advertisements, the player may win real prizes from the play. For example, of three "Coca-Cola" symbols are lined up, the player may win a $100 gift certificate for Coca-Cola. See FIG. 14, for example.

The following are embodiments, not claims:

A. A method comprising:

receiving a player identifier from a player device, wherein the player device is a computer operable to communicate via the Internet;

receiving an indication of a first bet from the player device;

transmitting to the player device first data which encodes a first graphic used in a first game;

generating a first outcome of the first game;

transmitting to the player device an indication of the first outcome of the first game;

determining a first payout for the first game based on the first bet and based on the first outcome;

transmitting to the player device an indication of the first payout;

receiving the player identifier from a casino device;

receiving an indication of a mobile gaming device provided to the player;

transmitting to the mobile gaming device third data which encodes a third graphic, wherein the third graphic has an appearance that is based on the appearance of the first graphic;

receiving an indication of a second bet from the mobile gaming device;

generating a second outcome of a second game, wherein the second game uses the third graphic;

transmitting to the mobile gaming device an indication of the second outcome of the second game;

determining a second payout based on the second outcome and the second bet; and adjusting a balance associated with the player based on the second bet and based on the second payout.

B. The method of embodiment A in which the first bet has approximately zero monetary value and in which the first payout has approximately zero monetary value.

C. The method of embodiment A further including:

transmitting to the player device second data which encodes a second graphic that depicts a particular type of mobile gaming device; and transmitting to the casino device an indication of instructions to provide the player with the mobile gaming device, wherein the mobile gaming devices is of the particular type.

D. The method of embodiment A further including storing fourth data associated with the first game.

E. The method of embodiment D in which fourth data indicates the type of game of the first game.

F. The method of embodiment D in which fourth data indicates the amount of the first bet.

G. The method of embodiment D in which fourth data indicates a decision made in the first game.

H. The method of embodiment D in which fourth data indicates whether or not a decision made in the first game was made by the player.

I. The method of embodiment D in which fourth data indicates whether or not a decision made in the first game was made by the player device.

J. The method of embodiment D in which fourth data indicates whether or not a decision made in the first game was consistent with an optimal strategy.

K. The method of embodiment A further including:

receiving an indication of a selection of a particular type of game from the player device, in which the particular type of game is selected from among two or more types of games; and storing, in association with the first game, fourth data indicative of the particular type of game.

L. The method of embodiment A wherein the second bet has non-zero monetary value.

M. The method of embodiment A wherein the second payout has non-zero monetary value.

N. A method comprising:

receiving a player identifier from a player device, wherein the player device is a computer operable to communicate via the Internet;

receiving an indication of a first bet from the player device;

transmitting to the player device first data which encodes a first graphic used in a first game;

generating a first outcome of the first game;

transmitting to the player device an indication of the first outcome of the first game;

determining a first payout for the first game based on the first bet and based on the first outcome;

transmitting to the player device an indication of the first payout;

receiving the player identifier from a casino device;

receiving an indication of a mobile gaming device provided to the player; and transmitting to the mobile gaming device instructions describing how to access third data, wherein third data encodes a third graphic, wherein the third graphic has an appearance that is based on the appearance of the first graphic.

O. An apparatus operable to perform the steps of claim 1.

View Other People Who are Playing

In various embodiments, two or more people may engage in practice play or simulated play at once. The people may be playing completely different games, the same type of game, or the same game against one another, for example. For example, numerous people may be able to log into the Website of a casino and try out different games. In various embodiments, two or more people may engage in practice play or simulated play over a network. In some embodiments, for example, some people may engage in practice play from home (e.g., using their personal computers and while logged into the Internet) while some people may engage in practice play at a casino. In some embodiments, two or more people may engage in play for real money (e.g., where people can win or lose real money). Such people may play games over a network, such as the Internet, or such as a casino network. In some embodiments, some people may engage in practice play while other people engage in play for real money.

In various embodiments, statistics or other indicators of current game play may be published, posted, or broadcast. For example, a casino may post on its Website a list of games together with an indication of how many people are currently playing each game. For example, the game "Extreme Gold Exploration" may be listed as having 30 people playing, while the game "Diamond Avalanche" may be listed as having 24 people playing. A quantity of people listed may represent a quantity of people currently in the middle of a game, a quantity of people who have played in the last X minutes (e.g., in the last two minutes), people who have software running for playing the game, people who have played more than Y times in the last Z minutes, or the quantity may represent any other reality. In various embodiments, a quantity of people listed next to a game may indicate the quantity of people playing the same kind of game (e.g., the game with the same rules and the same graphics), but not in the actual same game (e.g., the players are not opponents or cooperating in the same game. In some embodiments, a statistic does show a number of people participating in the actual same game. For example, a statistic may show the number of people playing at the same virtual blackjack table (e.g., the quantity of people playing against the same virtual dealer and using the same virtual deck).

In various embodiments, a casino or other entity may publish or post a listing of games, where the list is ordered according to one or more criteria. In various embodiments, games may be listed according to the number of people currently playing the game. In various embodiments, games may be ordered according to the number of times the game has been played in some period of time, such as in the last five minutes, the last hour, the last day, the last week, the last month, etc. In some embodiments, games may be ordered according to the total amounts of time that players have spent playing the game in some period of time, such as the last five minutes, the last hour, the last day, the last week, etc. In some embodiments, games may be ordered according to changes in how much the game has been played. For example, the game listed first may be the game which has seen the greatest percentage increase in play over the last week (e.g., in terms of the number of times the game has been played in a given week). In some embodiments, games may be ordered according to how much virtual or valueless currency has been wagered on them. In some embodiments, games may be ordered according to how much real money has been wagered on them.

In some embodiments, games may be ordered based on outcomes of the games. Games may be ordered based on the number of winning outcomes which have occurred. For example, the type of game for which there was the most winning outcomes in the last five minutes may be listed first. Games may be ordered based on the occurrence of outcomes which pay more than a certain amount. For example, the game for which the most outcomes paying 10 times the original bet were won may be listed first. Games may be ordered based on outcomes which have resulted in a bonus round. For example, the game which has resulted in the most bonus rounds in the last five minutes may be listed first. In some embodiments, games may ordered based on which have had the most losing outcomes, e.g., in some period of time.

In various embodiments, two or more lists of games may be posted. The separate lists may represent lists of games which have been segmented or selected based on certain criteria. For example, different lists of games may represent different overarching categories of games. For example, one list of games may represent card games while another list of games may represent reel slot machine games. In some embodiments, one list of games may represent strategy games while another represents games with no decisions to be made by a player.

In some embodiments, separate lists may correspond to different categories of players who are engaged in game play. For example, one list may list the games being played most by women. Another list may list the games being played most by men. Such lists may allow, for example, a man to find a game that he might like based on what other men find popular, and similarly such lists may allow a woman to find a game that she might like based on what other women find popular. In various embodiments, a list of games may represent games played by players falling within a certain age range, living in a certain area (e.g., North Carolina), speaking a particular language, having a certain occupation, having an income within certain range, and/or exhibiting any other characteristic. In some embodiments, different lists of games may represent games played by players with different experience levels. For example, a first list may represent games played by players who have played at least 1000 games at the Website, while a second list may represent games played by players who have played less than 1000 games at the Website.

In various embodiments, a person may find or select a list of games that are being played by a type or category of players of interest to the person. For example, the person may be a retiree and may wish to find games which are popular with other retirees. Therefore, the person may view a list of the games which have been played the most by retirees.

In various embodiments, a person may search for lists of games. The person may input criteria (e.g., type in criteria, e.g., select criteria from a menu) that define a list. For example, the person may input an overarching game category, a demographic characteristic of players playing the games on a list, or any other criteria. The list may then be, e.g., downloaded to the player's computer and displayed for the player. The list may then be otherwise presented to the player. In various embodiments, a player may input custom criteria, such as criteria which define a list which has not yet been created. The casino server may use the criteria provided by the player to create a customized list for the player. For example, the casino may determine all games that are currently played as well as information about the players playing the game. The casino may then access information about the games (e.g., information describing the category of game; e.g., information describing how often the game has been played in the last hour). The casino may then filter all the information based on the player's criteria for the customized list. For example, the casino may discount any games played by players of a demographic other than that desired by the player making the request for the customized list. The casino may then generate the customized list and may post it to its Website, download it to the requesting player's device, or otherwise provide the list.

In various embodiments, a person may view a list or customized list that pertains to other people with the same characteristics as the player. For example, a given person may view a list of the most popular games among people from the same geographic area as the person. In some embodiments, the casino may receive information about the given person and may automatically display lists of games popular with other people who are somehow similar to the given person. The casino may receive information about the given person, for example, by asking the person to register with the casino Website, by having the person sign up for a player tracking card, or by some other means. In various embodiments, the casino may derive or infer information about the player, such as by mapping the internet protocol (IP) address of the player to a particular geographic location.

In various embodiments, a person may view lists related to players. A person may view a list of player names, aliases, or other identifiers. The names may be ordered based on which player has played the most games, which player has played for the longest period of time, which player has won the most virtual or real currency, or by any other criteria.

In various embodiments, a casino or other entity may post a list of game categories. The list may be ordered by the number of people playing each category of games, by the number of games in the category played in the last month, or by any other criteria. For example, a list may show table games as the most played, 5-reel slot games as the next most played, 3-reel slot games as the next most played, video poker games as the next most played, and so on.

In various embodiments, various meta games may be played by players interacting with a casino server or otherwise playing. Meta games may include bets on what will happen in other games, or bets on what will happen in groups of games. For example, a meta game may include a bet that 5 or more "red" outcomes will occur over the next ten roulette games. As another example, a meta game may include a bet that three aces will be dealt to a player playing a game of blackjack.

In various embodiments, a list may include information about meta games. For example, the list may indicate which are the most played meta games, either currently or during some recent period of time.

In various embodiments, a Website (or other area where information is posted) may indicate what games are currently being played. An indicated game may be being played by only one person. An indicated game may be being played by two or more people. In various embodiments, a Website may indicate a category of games, such that at least one game in the category is currently being played. For example, a Website may indicate that a card game is currently being played.

Recommendations

In various embodiments, a Website or other information source may provide recommendations to a player. The Website may recommend certain games to the player. The Website may recommend games to the player based on personal information about the player (e.g., age, income, occupation, etc.), based on stated preferences of the player, based on games previously played by the player, or based on any other factor.

In various embodiments, a Website may recommend games to a player based on games that other players with common or similar characteristics have played. For example, if a player is a single male in this fifties, the Website may recommend games that have been popular (e.g., games which have been played more than other games) with other single males in their fifties. If a player is a lawyer, the Website may recommend other games that have been popular with lawyers. In various embodiments, a Website may recommend games that are currently being played by other players with similar characteristics.

In various embodiments, a Website may recommend a game that somehow relates to characteristics of a player. For example, if a player is a fisherman, the Website may recommend a game that features fish as symbols or graphics.

In various embodiments, a Website may recommend games based on the stated preference of a player. For example, a player may key in a preference, select a preference, or otherwise indicate a preference when initially visiting the Website. For example, if a player has stated a preference for games with a strategy component, Website may recommend a game with a strategy component, such as blackjack or video poker.

In various embodiments, a player may state various preferences for a game. A player may state a preference for games with: (a) particular types of graphics; (b) action sequences (e.g., games with many visual effects, such as explosive battle scenes); (c) particular sound effects (e.g., the player may state preferences for games with no sound; (d) games of a certain time duration (e.g., games that take no more than 5 seconds each); (e) games that are based on real casino games; (f) games that are based on real casino games that can be played at a mobile gaming device in a casino; (g) games that are based on real casino games that can be played at a stationary gaming device in a casino; (h) games with a certain payout table structure (e.g., games with top payouts of over 1000 times the initial wager); (i) games that have been developed by a certain developer (e.g., by WMS); (j) games that are currently widespread in casinos (e.g., games that are playable on more than 1000 slot machines currently in casinos); (k) games that are available in real casinos; (l) games that are coming soon to real casinos; or games with any other characteristics.

In various embodiments, a Website may recommend games to a player based on games that the player has already played. If the player has played a first game, then the Website may recommend a second game that has a characteristic in common with the first game. For example, if the player has played a first five-reel slot machine game, then the Website may recommend a second five-reel slot machine game. A Website may recommend a second game that has a characteristic in common with a first game if there is evidence that the player has enjoyed the first game. For example, if the player has played the first game for a lengthy period of time (e.g., for more than half an hour) or if the player has played the first game many times (e.g., more than twenty times), then the Website may recommend other games that have characteristics in common with the first game. In various embodiments, if it appears that a player does not enjoy a particular game, then the Website may recommend games that do not have many, or any common characteristics with the first game.

In various embodiments, if a player has played a first game, the Website may recommend to the player games that have been played by other players who have also played the first game. In some embodiments, the Website may recommend to the player games that have, apparently, been enjoyed by other players who played the first game. For example, if a first player has played a first game, and a second player has played the first game and has played a second game for more than half an hour, then the Website may recommend the second game to the first player. In some embodiments, the Website may recommend a second game to a first player if the second game has, apparently, been enjoyed by a second player, and the first game has also, apparently, been enjoyed by the second player. For example, if a second player has played a first game for more than half an hour, and if the second player has also played a second game for more than half an hour, then the Website may recommend the second game to a first player who has played the first game. In various embodiments, the Website may recommend a second game to a first player based on a first game played by the first player if the first player has appeared to enjoy the game (e.g., has played for more than five minutes; e.g., has won more than 20 units of virtual currency).

In various embodiments, more complicated of sophisticated algorithms may be used to recommend games to a first player based on is prior play patterns and based on the play patterns of other players. For example, a neural network may be trained to determine, in general, new games that any given player will like based on old games he has liked. The neural network may then be used to make recommendations to a new player based on the new player's play patterns.

Website can Feature Many Different Games

In various embodiments, a Website may feature games which are previews, practice versions, trial versions, or free versions of games that can actually be played in a casino and/or games that can actually be played for real money. Games featured on a Website may be practice versions of games that can be played at a slot machine, games that can be played at a video poker game, games that can be played at a live table game (e.g., at a craps table), games that can be played on a mobile gaming device, or any other games. In various embodiments, games featured on a Website may include free or practice versions of games that can be played for real money over the Internet or over some other network.

In various embodiments, a Website featuring games may belong to a casino. The casino may be a virtual casino (e.g., a casino with no physical place to gamble) or the casino may have a physical presence where players can play physical games in person.

In various embodiments, a casino may include physical games, such as slot machines and mobile gaming devices. The casino may further include a Website. The casino may post on its Website lists of actual physical games. The lists may indicate any metric discussed herein, such as which are the most played physical games, which are the games at which people have won the most, what are the top ten most played games by people of a certain demographic. Thus, in various embodiments, a player may log onto a Website, see which are the most played games at a physical casino, and then choose to play free or practice versions of those same games on the Website.

The following is a list of embodiments, not claims:

A. An apparatus comprising a processor operable to:

receive, from a first gaming device located within a casino, a first indication that the first gaming device has been played (e.g., an indication that a player has played one or more games at the gaming device; e.g., an indication that money has been bet at the gaming device;

receive, from a second gaming device located within the casino, a second indication that the second gaming device has been played;

determine a first game that is played at the first gaming device (e.g., the first gaming device may be a gaming device that allows the play of Jacks or Better video poker; e.g., the first gaming device may be a gaming device that allows the play of Crazy Coffin Raiders slot game);

determine a second game that is played at the second gaming device;

determine, based on the first indication, a first number of times that the first game has been played within the casino during a predetermined period of time (e.g., the first indication may show how many times the first gaming device has been played in the last hour—this information may be combined with other information received from other gaming devices featuring the same game to arrive at a total number of times the game has been played throughout the casino);

determine, based on the second indication, a second number of times that the second game has been played within the casino during the predetermined period of time;

post to a website a list which includes a name of the first game and a name of the second game, in which the names are ordered within the list based on the first number of times and based on the second number of times (e.g., the list may show the most popular games, such as games played the most number of times throughout a casino in the last hour);

receive, from a player device, a selection of the name of the first game from the list (e.g., a player may click on the listed name of the first game); and conduct for the player a version of the first game that does not require a bet of monetary value (e.g., the player may play a free version of the first game on his personal computer or on some other device).

The apparatus may be a casino server for example.

B. The apparatus of embodiment A in which the first game is available for play on multiple different gaming devices within the casino. Thus, for example, gaming devices other than the first gaming device may feature the first game.

C. The apparatus of embodiment A in which to receive a selection of the name of the first game includes to receive, from a personal computer belonging to a player, a selection of the name of the first game from the list.

D. The apparatus of embodiment A in which the predetermined period of time is the most recent 24-hour period. The predetermined time period could also be the most recent hour, the most recent five minutes, or a time period that has ended in the past.

E. An apparatus comprising a computing device operable to:

determine a first indicator of play of a first game;

determine a second indicator of play of a second game;

determine an order of the first game and of the second game based on the first indicator and based on the second indicator;

post a list to a website, in which the list includes a first identifier of the first game and a second identifier of the second game and in which the identifiers are shown according to the determined order. Posting a list to a website may include creating an html file or other type of file, saving the file in a server, and allowing the file to be accessed by other computers connected via a network (e.g., via the Internet, to the server).

F. The apparatus of embodiment E in which to determine a first indicator includes to determine a number of times the first game has been played during a particular period of time.

G. The apparatus of embodiment E in which to determine a first indicator includes to determine a number of times the first game has been played during a particular period of time.

H. The apparatus of embodiment E in which to determine a first indicator includes to determine a number of players who have played the first game during a particular period of time.

I. The apparatus of embodiment E in which to determine a first indicator includes to determine the number of times that a given category of outcome has occurred during a particular period of time.

J. The apparatus of embodiment I in which to determine a first indicator includes to determine the number of times that an outcome occurs which returns more than a predetermined multiple of the amount bet.

K. The apparatus of embodiment E in which to determine an order includes to place the first game first in the order if the first indicator is greater than the second indicator.

L. The apparatus of embodiment E in which the first identifier is the name of the first game and in which the second identifier is the name of the second game.

M. The apparatus of embodiment E in which to post a list includes to post a list to a Website, in which the list includes the first identifier of the first game, the first indicator, the second identifier of the second game, and the second indicator, and in which the identifiers are shown according to the determined order.

N. The apparatus of embodiment E in which to determine a first indicator includes to determine a first indicator of play of a first game by players of a particular demographic, and in which to determine a second indicator includes to determine a second indicator of play of a second game by players of the particular demographic. Thus, for example, the apparatus may determine how many times the first game has been played by people with children, and how many times the second game has been played by people with children.

O. The apparatus of embodiment N in which the computing device is further operable to:

receive a request to post a list of games that are ordered based on play of the games by players of the particular demographic.

P. The apparatus of embodiment E in which the computing device is further operable to post a description of the list, the description describing the list as a list of the most popular games. The description may be a title of the list, a heading of the list, or any other descriptor of the list. A title might read, for example, "Most Popular Games".

Q. An apparatus comprising a computing device operable to:

determine a first game played by a first player;

determine a first amount that the first player has played the first game;

determine a second player who has played the first game;

determine a second amount that the second player has played the first game;

determine a second game played by the second player;

determine a third amount that the second player has played the second game; and provide to the first player a recommendation to play the second game if the first amount is greater than a first predetermined quantity, if the second amount is greater than a second predetermined quantity, and if the third amount is greater than a third predetermined quantity.

R. The apparatus of embodiment Q in which to determine a first amount includes to determine a first amount of time that the first player has played the first game.

S. The apparatus of embodiment Q in which to determine a first amount includes to determine a first number of times that the first player has played the first game.

T. The apparatus of embodiment Q in which to provide to the first player a recommendation includes to post on a website accessed by the first player a link to the second game if the first amount is greater than a first predetermined quantity, if the second amount is greater than a second predetermined quantity, and if the third amount is greater than a third predetermined quantity. A link to the second game may include an address on a server or an address on a network where the second game can be accessed. The address may be understandable by a Web browser.

In various embodiments, a distributed gaming system enables participants to engage in gaming activities from remote and/or mobile locations. The possible gaming activities include gambling, such as that provided by casinos. Gambling activities may include any casino-type gambling activities including, but not limited to, slot machines, video poker, table games (e.g., craps, roulette, blackjack, pai gow poker, Caribbean stud poker, baccarat, etc), the wheel of fortune game, keno, sports betting, horse racing, dog racing, jai alai, and other gambling activities. The gaming activities can also include wagering on any type of event. Events can include, for example, sporting events, such as horse or auto racing, and athletic competitions such as football, basketball, baseball, golf, etc. Events can also include such things that do not normally involve wagering. Such events may include, without limitation, political elections, entertainment industry awards, and box office performance of movies. Gaming can also include non-wagering games and events. Gaming can also include lotteries or lottery-type activities such as state and interstate lotteries. These can include all forms of number-selection lotteries, "scratch-off" lotteries, and other lottery contests. The gaming system may be implemented over a communications network such as a cellular network or a private wireless and/or wireline network. Examples of the latter include WiFi and WiMax networks. In some embodiments, the gaming system communications network is entirely independent of the Internet. In some embodiments, the gaming system operation makes minimal use of the Internet, such that only information for which there are no security issues is transmitted via the Internet and/or such that information may be encrypted. In various embodiments, the communications network enables players to participate in gaming from remote locations (e.g., outside of the gaming area of a casino). Also, the system may enable players to be mobile during participation in the gaming activities. In various embodiments, the system has a location verification or determination feature, which is operable to permit or disallow gaming from the remote location depending upon whether or not the location meets one or more criteria. The criterion may be, for example, whether the location is within a pre-defined area in which gaming is permitted by law.

As shown in FIG. 1, for example, gaming system 10 may include at least one user 12. The system may include additional users such that there is at least a first user 12 and a second user 14. Multiple users may access a first gaming system 10, while other multiple users access a second gaming system (not shown) in communication with first gaming system 10. Users 12 and 14 may access system 10 by way of a gaming communication device 13. Gaming communication device 13 may comprise any suitable device for transmitting and receiving electronic communications. Examples of such devices include, without limitation, mobile phones, personal data assistants (PDAs), computers, mini-computers, etc. Gaming communication devices 13 transmit and receive gaming information to and from communications network 16. Gaming information is also transmitted between network 16 and a computer 18, such as a server, which may reside within the domain of a gaming service provider 20. The location of computer 18 may be flexible, however, and computer 18 may reside adjacent to or remote from the domain of gaming service provider 20. Various embodiments may not include a gaming service provider. The computer 18 and/or gaming service provider 20 may reside within, adjacent to, or remote from a gaming provider (not shown in FIG. 1). The gaming service provider may be an actual controller of games, such as a casino. As an example, a gaming service provider may be located on the grounds of a casino and the computer 18 may be physically within the geographic boundaries of the gaming service provider. As discussed, however, other possibilities exist for remote location of the computer 18 and the gaming service provider 20. Computer 18 may function as a gaming server. Additional computers (not expressly shown) may function as database management computers and redundant servers, for example.

In various embodiments, software resides on both the gaming communication device 13 and the computer 18. Software resident on gaming communication device 13 may be operable to present information corresponding to gaming activities (including gambling and non-gambling activities discussed herein) to the user. The information may include, without limitation, graphical representations of objects associated with the activities, and presentation of options related to the activities and selectable by the user. The gaming communication device software may also be operable to receive data from the computer and data input by the user. Software resident on the computer may be able to exchange data with the gaming communication device, access additional computers and data storage devices, and perform all of the functions described herein as well as functions common to known electronic gaming systems.

Gaming information transmitted across network 16 may include any information, in any format, which is necessary or desirable in the operation of the gaming experience in which the user participates. The information may be transmitted in whole, or in combination, in any format including digital or analog, text or voice, and according to any known or future transport technologies, which may include, for example, wireline or wireless technologies. Wireless technologies may include, for example, licensed or license-exempt technologies. Some specific technologies which may be used include, without limitation, Code Division Multiple Access (CDMA), Global System for Mobile Communication (GSM), General Packet Radio Service (GPRS), WiFi (802.11x), WiMax (802.16x), Public Switched Telephone Network (PSTN), Digital Subscriber Line (DSL), Integrated Services Digital Network (ISDN), or cable modem technologies. These are examples only and one of ordinary skill will understand that other types of communication techniques are also contemplated. Further, it will be understood that additional components may be used in the communication of information between the users and the gaming server. Such additional components may include, without limitation, lines, trunks, antennas, switches, cables, transmitters, receivers, computers, routers, servers, fiber optical transmission equipment, repeaters, amplifiers, etc.

In some embodiments, the communication of gaming information takes place without involvement of the Internet. However, in some embodiments, a portion of the gaming information may be transmitted over the Internet. Also, some or all of the gaming information may be transmitted partially over an Internet communications path. In some embodiments, some information is transmitted entirely or partially over the Internet, but the information is either not gaming information or is gaming information that does not need to be maintained secretly. For instance, data that causes a graphical representation of a table game on the users gaming communication device might be transmitted at least partially over the Internet, while wagering information transmitted by the user might be transmitted entirely over a non-Internet communications network.

Figure 2:
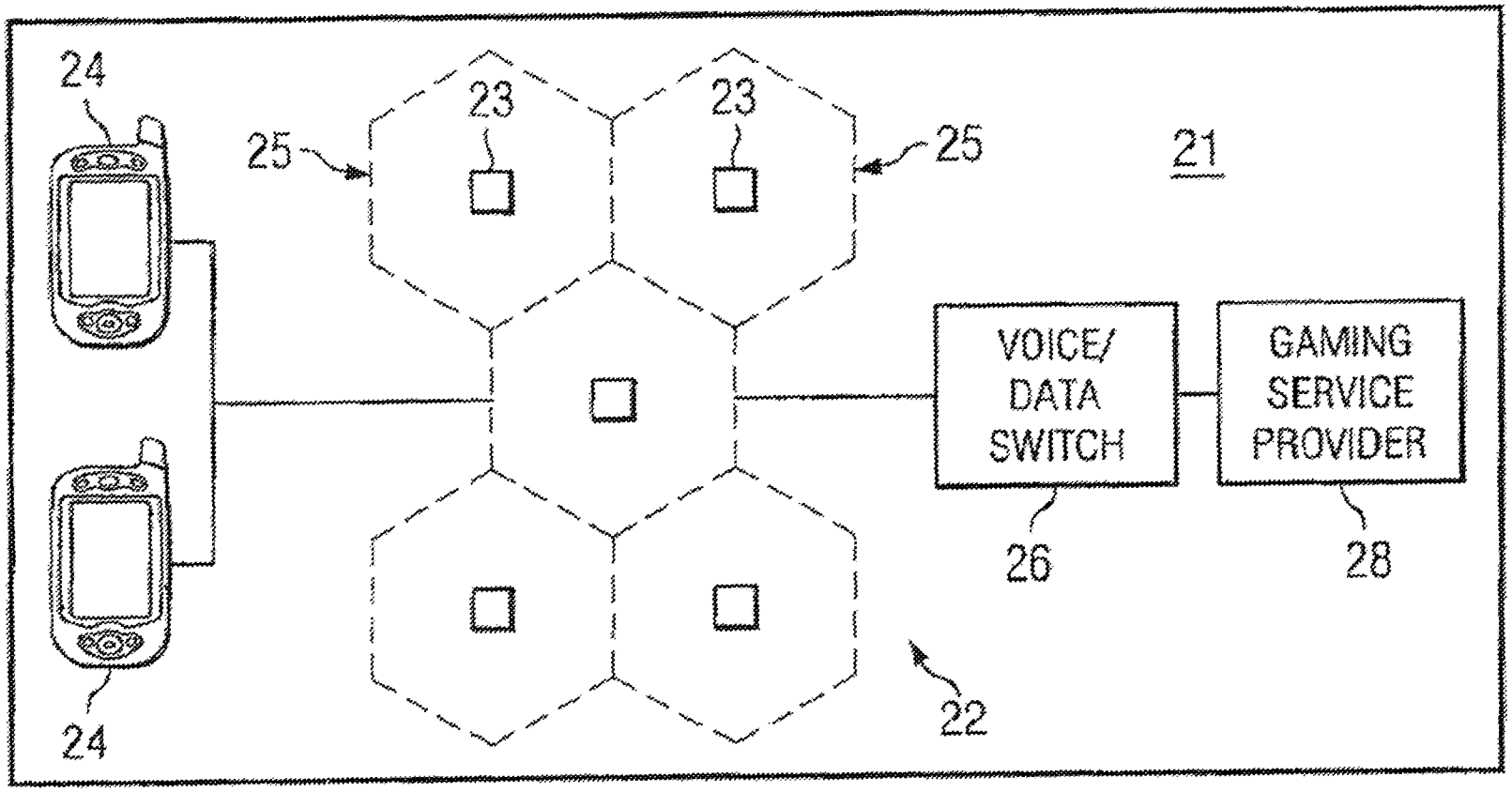
FIG. 2 shows a communications network according to some embodiments.

According to some embodiments, as shown in FIG. 2 for example, the communications network comprises a cellular network 22. Cellular network 22 comprises a plurality of base stations 23, each of which has a corresponding coverage area 25. Base station technology is generally known and the base stations may be of any type found in a typical cellular network. The base stations may have coverage areas that overlap. Further, the coverage areas may be sectorized or non-sectorized. The network also includes mobile stations 24, which function as the gaming communication devices used by users to access the gaming system and participate in the activities available on the gaming system. Users are connected to the network of base stations via transmission and reception of radio signals. The communications network also includes at least one voice/data switch, which may be connected to the wireless portion of the network via a dedicated, secure landline. The communications network may also include a gaming service provider, which is likewise connected to the voice/data switch via a dedicated, secure landline. The voice/data switch may be connected to the wireless network of base stations via a mobile switching center (MSC), for example and the landline may be provided between the voice/data switch and the MSC.

Users access the gaming system by way of mobile stations which are in communication with, and thus part of, the communications network. The mobile station may be any electronic communication device that is operable in connection with the network as described. For example, in this particular embodiment, the mobile station may comprise a cellular telephone.

In various embodiments, in the case of a cellular network for example, the gaming system is enabled through the use of a private label carrier network. Each base station is programmed by the cellular carrier to send and receive private secure voice and/or data transmissions to and from mobile station handsets. The handsets may be pre-programmed with both gaming software and the carriers authentication software. The base stations communicate via private T1 lines to a switch. A gaming service provider leases a private T1 or T3 line, which routes the calls back to gaming servers controlled by the gaming service provider. Encryption can be installed on the telephones if required by a gaming regulation authority, such as a gaming commission.

The cellular network may be a private, closed system. Mobile stations communicate with base stations and base stations are connected to a centralized switch located within a gaming jurisdiction. At the switch, voice calls are transported either locally or via long distance. Specific service provider gaming traffic is transported from the central switch to a gaming server at a host location, which can be a casino or other location.

As subscribers launch their specific gaming application, the handset will only talk to certain base stations with cells or sectors that have been engineered to be wholly within the gaming jurisdiction. For example, if a base station is close enough to pick up or send a signal across state lines, it will not be able to communicate with the device. When a customer uses the device for gaming, the system may prohibit, if desired, the making or receiving voice calls. Moreover, voice can be eliminated entirely if required. Further, the devices may not be allowed to "connect" to the Internet. This ensures a high level of certainty that bets/wagers originate and terminate within the boundaries of the gaming jurisdiction and the "private" wireless system cannot be circumvented or bypassed. Although in some embodiments some data and/or voice traffic may be communicated at least partially over the Internet, the communication path may not include the Internet in other embodiments. Alternatively, in some embodiments, certain non-gaming information may be transported over a path which includes the Internet, while other information relating to the gaming activities of the system is transported on a path that does not include the Internet.

Figure 3:
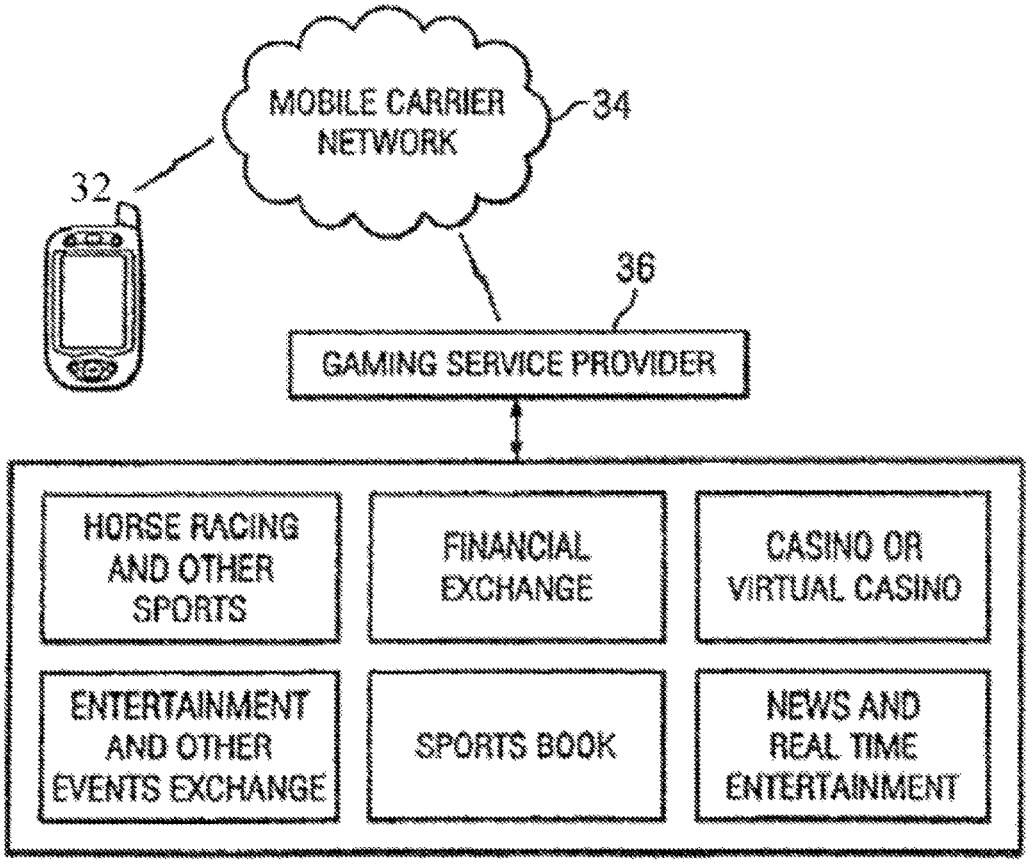
FIG. 3 shows a gaming service provider in communication with a gaming communication device according to some embodiments.

As shown in FIG. 3, a gaming communication device 32 is in communication with a gaming service provider over a network 34. The gaming service provider preferably has one or more servers, on which are resident various gaming and other applications. As shown in FIG. 3, some example gaming applications include horse racing and other sports, financial exchange, casino and/or virtual casino, entertainment and other events exchange, and news and real time entertainment. Each of these applications may be embodied in one or more software modules. The applications may be combined in any possible combination. Additionally, it should be understood that these applications are not exhaustive and that other applications may exist to provide an environment to the user that is associated with any of the described or potential activities.

Figure 4:
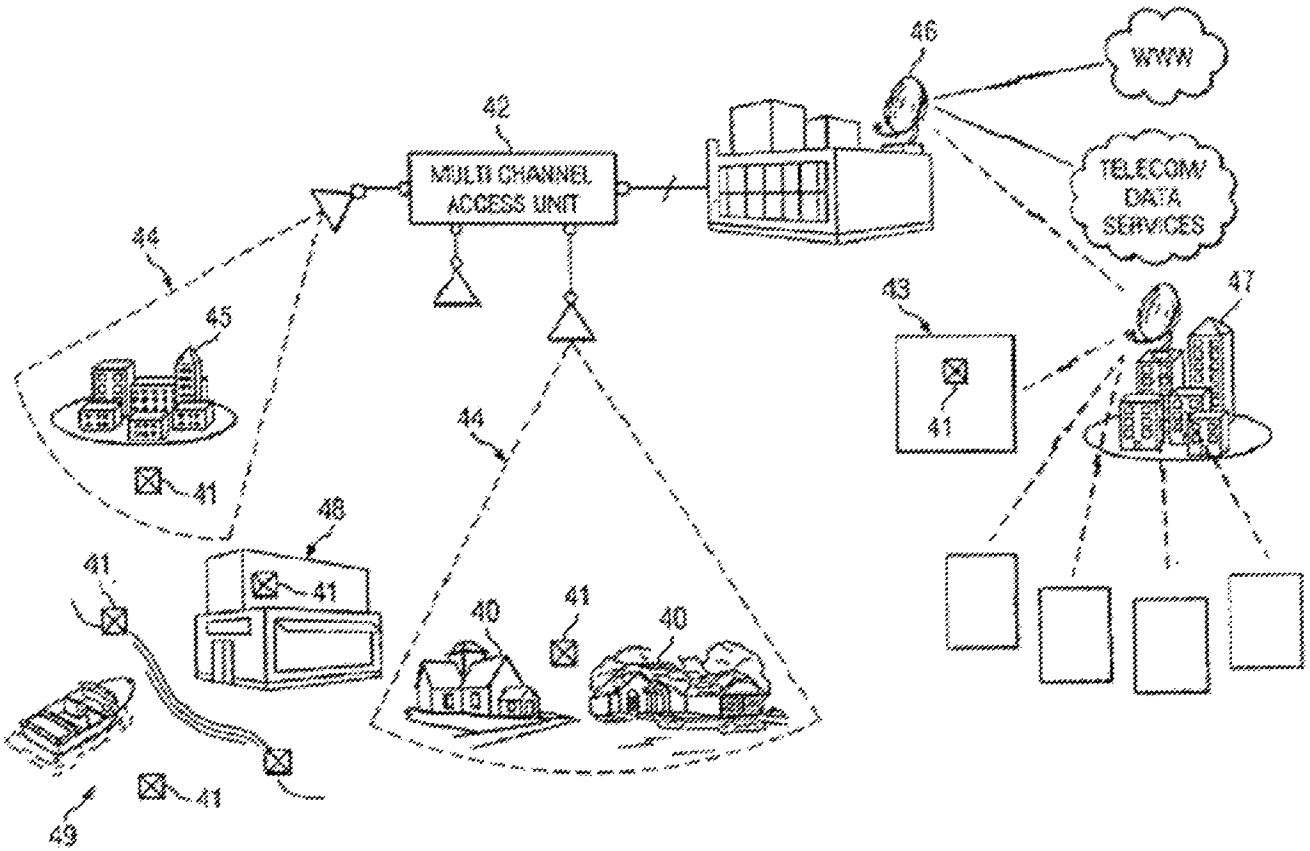
FIG. 4 shows a communications network according to some embodiments.

In another embodiment, as shown in FIG. 4, for example, the communications network comprises a private wireless network. The private wireless network may include, for example, an 802.11x (WiFi) network technology to cover "Game Spots" or "Entertainment Spots." In FIG. 4, various WiFi networks are indicated as networks 41. Networks 41 may use other communications protocols to provide a private wireless network including, but not limited to, 802.16x (WiMax) technology. Further, networks 41 may be interconnected. Also, a gaming system may comprise a combination of networks as depicted in FIG. 4. For example, there is shown a combination of private wireless networks 16, a cellular network comprising a multi-channel access unit or sectorized base station 42, and a satellite network comprising one or more satellites 46.

With respect to the private wireless network, because the technology may cover small areas and provide very high-speed throughput, the private wireless network is particularly well-suited for gaming commission needs of location and identity verification for the gaming service provider products. The gaming spots enabled by networks 41 may include a current casino area 48, new areas such as swimming pools, lakes or other recreational areas 49, guest rooms and restaurants such as might be found in casino 48 or hotels 45 and 47, residential areas 40, and other remote gaming areas 43. The configuration of the overall gaming system depicted in FIG. 4 is intended only as an example and may be modified to suit various embodiments.

In some embodiments, the system architecture for the gaming system includes:

(1) a wireless LAN (Local Access Network) component, which consists of mostly 802.11x (WiFi) and/or 802.16x WiMax technologies; robust security and authentication software; gaming software; mobile carrier approved handsets with Windows® or Symbian® operating systems integrated within; and (a) CDMA-technology that is secure for over-the-air data protection;

(b) at least two layers of user authentication, (that provided by the mobile carrier and that provided by the gaming service provider);

(c) compulsory tunneling (static routing) to gaming servers;

(d) end-to-end encryption at the application layer; and (e) state-of-the-art firewall and DMZ technologies;

(2) an MWAN (Metropolitan Wireless Access Network), which consists of licensed and license-exempt, point-to-point links, as well as licensed and license-exempt, point-to-multi-point technologies;

(3) private MAN (Metropolitan Access Network) T1 and T3 lines to provide connectivity where wireless services cannot reach; and (4) redundant private-line communications from the mobile switch back to the gaming server.

Each of the "Game Spots" or "Entertainment Spots" is preferably connected via the MWAN/MAN back to central and redundant game servers. For accessing the private wireless networks 41, the gaming communication devices may be WiFi- or WiMax-enabled PDAs or mini-laptops, and do not have to be managed by a third-party partner.

In various embodiments, the gaming system includes a location verification feature, which is operable to permit or disable gaming from a remote location depending upon whether or not the location meets one or more criteria. A criterion may be, for example, whether the location is within a pre-defined area in which gaming is permitted by law. As another example, a criterion may be whether the location is in a no-gaming zone, such as a school. The location verification technology used in the system may include, without limitation, "network-based" and/or "satellite-based" technology. Network-based technology may include such technologies as multilateration, triangulation and geo-fencing, for example. Satellite-based technologies may include global positioning satellite (GPS) technology, for example.

As previously discussed, the cellular approach preferably includes the use of at least one cellular, mobile, voice and data network. For gaming in certain jurisdictions, such as Nevada for example, the technology may involve triangulation, global positioning satellite (GPS) technology, and/or geo-fencing to avoid the potential for bets or wagers to be made outside Nevada state lines. In some embodiments, the network would not cover all of a particular jurisdiction, such as Nevada. For instance, the network would not cover areas in which cellular coverage for a particular base station straddled the state line or other boundary of the jurisdiction. This is done in order to permit the use of location verification to insure against the chance of bets originating or terminating outside of the state. Triangulation may be used as a method for preventing gaming from unapproved locations. Triangulation may be accomplished, for example, by comparing the signal strength from a single mobile station received at multiple base stations, each having GPS coordinates. This technology may be used to pinpoint the location of a mobile station. The location can then be compared to a map or other resource to determine whether the user of the mobile station is in an unapproved area, such as a school. Alternatively, GPS technology may be used for these purposes.

Figure 5:
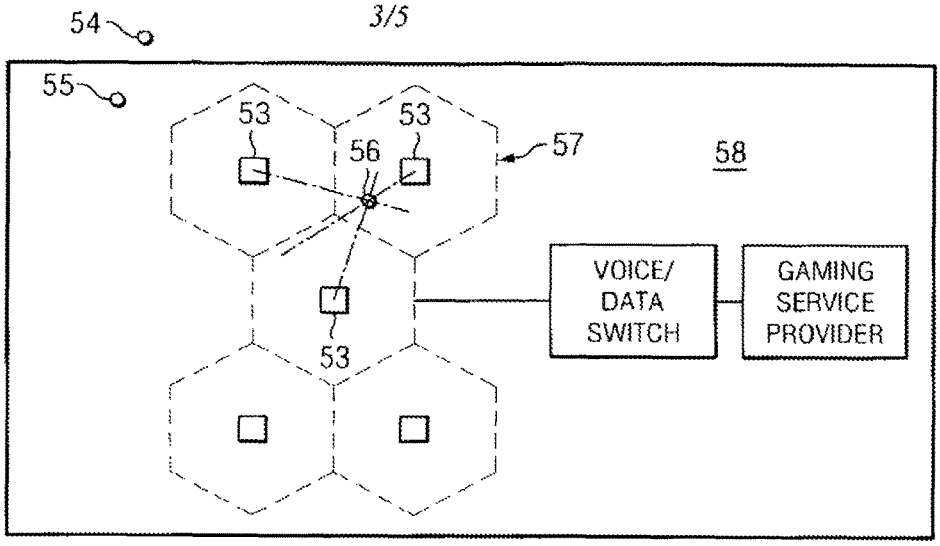
FIG. 5 shows a gaming system according to some embodiments.

As shown in FIG. 5, the gaming system includes a plurality of gaming communication devices 54, 55, and 56. Device 54 is located outside the gaming jurisdiction 58. Devices 55 and 56 are both located inside gaming jurisdiction 58. However only device 56 is located within geo-fence 57, which is established by the coverage areas of a plurality of base station 53. Thus, geo-fencing may be used to enable gaming via device 56 but disable gaming via devices 54 and 55. Even though some gaming communication devices that are within the gaming jurisdiction 58, such as device 55, are not permitted access to the gaming system, the geo-fence 57 ensures that no gaming communication devices outside jurisdiction 58, such as device 54, are permitted access.

Geo-fencing may not specify location. Rather, it may ensure that a mobile station is within certain boundaries. For instance, geo-fencing may be used to ensure that a mobile station beyond state lines does not access the gaming system. Triangulation on the other hand may specify a pinpoint, or near-pinpoint, location.

For example, as shown in FIG. 5, device 56 is triangulated between three of the base stations 53 to determine the location of device 56. Triangulation may be used to identify whether a device, such as a mobile station, is located in a specific spot where gambling is unauthorized (such as, for example, a school). Preferably, the location determination technology utilized in conjunction with the present invention meets the Federal Communication Commission's (FCC's) Phase 2 E911 requirements. Geological Institute Survey (GIS) mapping may also be utilized to compare identified coordinates of a gaming communication device with GIS map features or elements to determine whether a device is in an area not authorized for gaming. It should be noted that any type of location verification may be used such as triangulation, geo-fencing, global positioning satellite (GPS) technology, or any other type of location determining technology, which can be used to ensure, or provide an acceptable level of confidence, that the user is within an approved gaming area.

In various embodiments, location verification is accomplished using channel address checking or location verification using some other identifying number or piece of information indicative of which network or portion of a network is being accessed by the gaming communication device. Assuming the usage of an identifying number for this purpose, then according to one method of location checking, as an example, a participant accesses the gaming system via a mobile telephone. The identifying number of the mobile telephone, or of the network component being accessed by the mobile telephone, identifies the caller's connection to the mobile network. The number is indicative of the fact that the caller is in a defined area and is on a certain mobile network. A server application may be resident on the mobile telephone to communicate this information via the network to the gaming service provider. In a some embodiments, the identifying number or information is passed from a first network provider to a second network provider. For example, a caller's home network may be that provided by the second provider, but the caller is roaming on a network (and in a jurisdiction) provided by the first provider. The first provider passes the identifying information through to the second provider to enable the second provider to determine whether the caller is in a defined area that does or does not allow the relevant gaming activity. In various embodiments, the gaming service provider either maintains, or has access to, a database that maps the various possible worldwide mobile network identifying numbers to geographic areas. Various embodiments contemplate using any number or proxy that indicates a network, portion of a network, or network component, which is being connected with a mobile telephone. The identifying number may indicate one or more of a base station or group of base stations, a line, a channel, a trunk, a switch, a router, a repeater, etc.

In various embodiments, when the user connects his mobile telephone to the gaming server, the gaming server draws the network identifying information and communicates that information to the gaming service provider. The software resident on the gaming communication device may incorporate functionality that will, upon login or access by the user, determine the user's location (based at least in part on the identifying information) and send a message to the gaming service provider. The identifying number or information used to determine location may be country-specific, state-specific, town-specific, or specific to some other definable boundaries.

In connection with any of the location determination methods, the gaming system may periodically update the location determination information. This may be done, for example, during a gaming session, at pre-defined time intervals to ensure that movement of the gaming communication device to an unauthorized area is detected during play, and not just upon login or initial access.

Thus, depending on the location determination technology being used, the decision whether to permit or prohibit a gaming activity may be made at the gaming communication device, at the gaming server, or at any of the components of the telecommunication network being used to transmit information between the gaming communication device and the gaming server (such as at a base station, for example).

An aspect of the private wireless network related to preventing gaming in unauthorized areas is the placement of sensors, such as Radio Frequency Identification (RFID) sensors on the gaming communication devices. The sensors trigger alarms if users take the devices outside the approved gaming areas. Further, the devices may be "tethered" to immovable objects. Users might simply log in to such devices using their ID and password.

Figure 6:
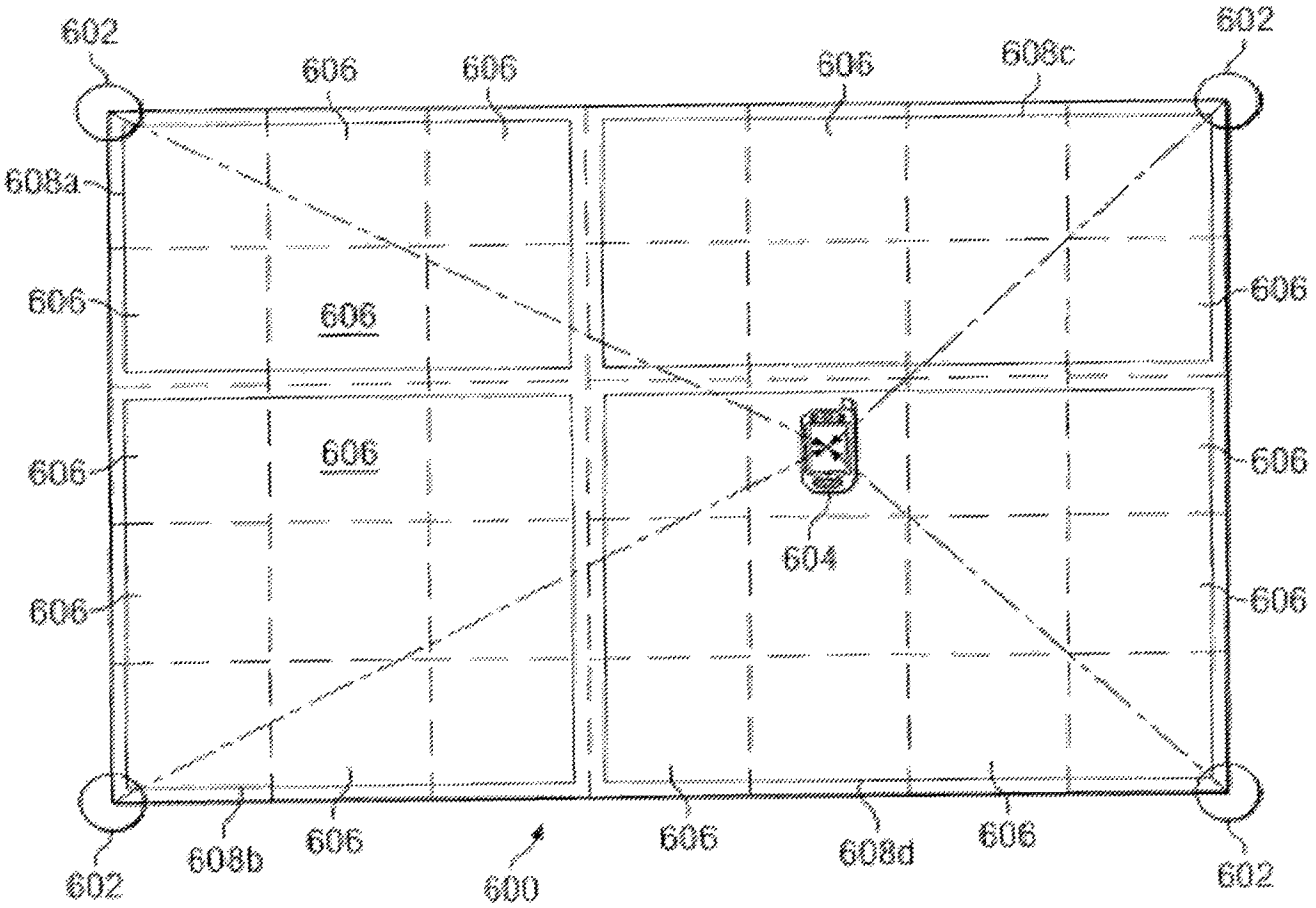
FIG. 6 shows a wireless gaming system according to some embodiments.
Figure 7:
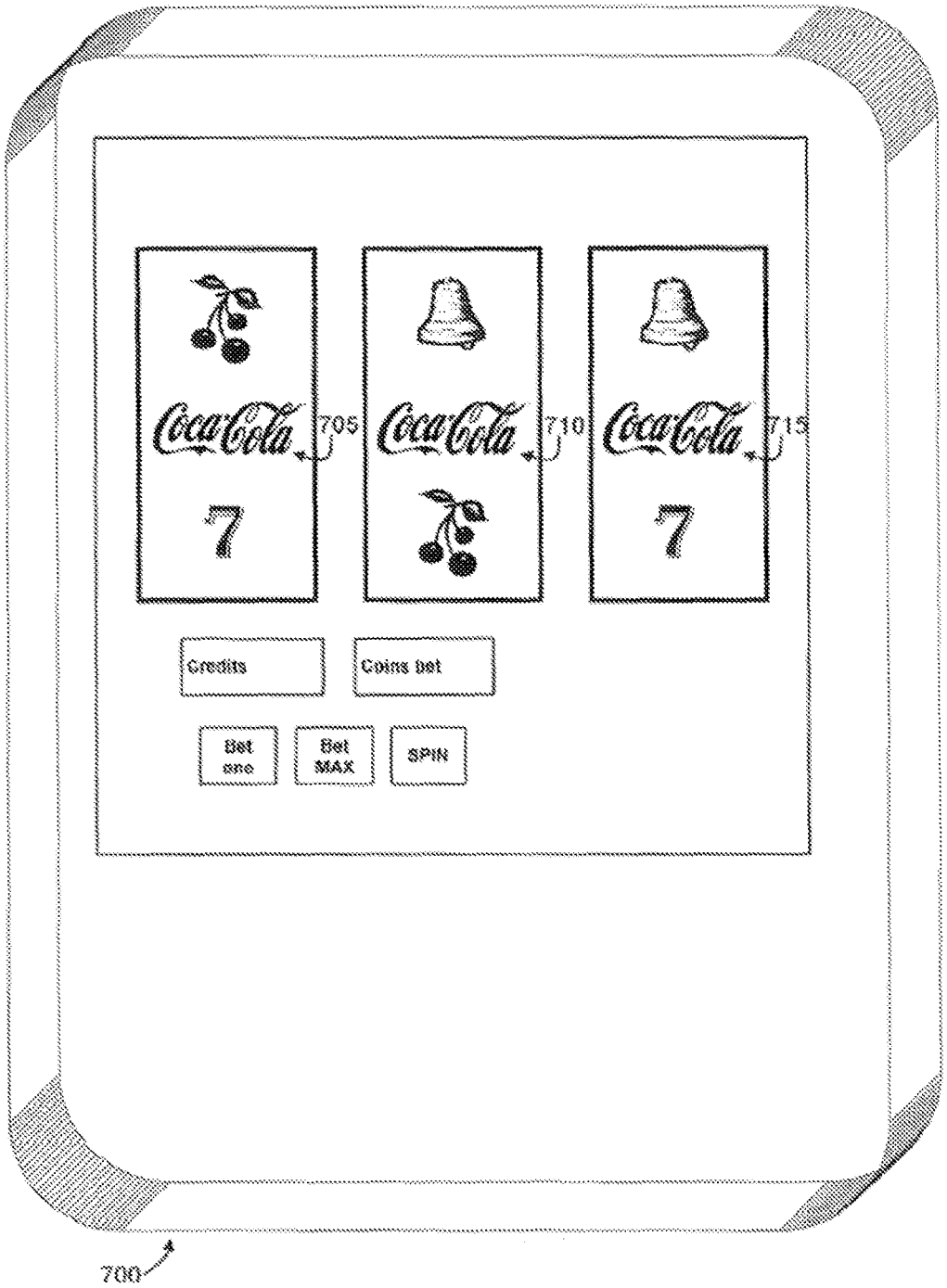
FIG. 7 shows a mobile gaming device with promotional content according to some embodiments.

In various embodiments, a gaming system may include the ability to determine the location of the gaming communication device within a larger property, such as a casino complex. This may allow certain functionalities of the device to be enabled or disabled based upon the location of the device within the property. For example, government regulations may prohibit using the device to gamble from the guest rooms of a casino complex. Therefore, particular embodiments may include the ability to determine the location of the device within the property and then disable the gambling functionality of the device from a guest room, or other area where gambling is prohibited. FIG. 6 illustrates an example of a wireless gaming system in which the location of a gaming communication device 604 may be determined in accordance various embodiments.

As shown in FIG. 6, a wireless gaming system comprises a wireless network that at least partially covers casino complex 600 in which one or more gaming communication devices 604 may be used to participate in a variety of gaming activities. The wireless network may comprise at least three signal detection devices 602, although various embodiments may include fewer or greater than three signal detection. As shown in FIG. 6, the wireless network comprises four signal detection devices 602, each located at one corner of casino complex 600. In various embodiments, these signal detection devices may comprise wireless access points, wireless routers, wireless base stations, satellites, or any other suitable signal detection device. Furthermore, although signal detection devices 602 are illustrated as being located on the boundaries of casino complex 600, signal detection devices may be located anywhere inside or outside of casino complex 600, provided the signal detection devices are operable to receive signals originating from a gaming communication device 604 inside casino complex 600. In various embodiments, signal detection devices 602 may also be used to transmit, as well as receive, signals to gaming communication device 604.

In various embodiments, casino complex 600 may be divided into one or more zones 608, which represent different areas of the casino complex, such as the lobby, guest rooms, restaurants, shops, entertainment venues, and pool areas. For example, as shown in FIG. 6, zone 608*a* may correspond to the casino lobby, zone 608*b* may correspond to guest rooms, zone 608*c* may correspond to restaurants, and zone 608*d* may correspond to the gaming floor of the casino. Each zone 608 may be further divided into one or more sub-zones 606, each specifying a particular location within zone 608. Sub-zones 606 may be arranged in a grid formation, each sub-zone 606 having a uniform size. In some embodiments, each sub-zone may comprise 9 square feet (i.e., 3 feet by 3 feet). In some embodiments, each sub-zone may comprise 100 square feet (i.e., 10 feet by 10 feet). The choice of the size of an area covered by a sub-zone may depend on administrator preferences, technical limitations of the wireless network, and governmental regulations, as well as other considerations.

Particular embodiments may use this mapping of casino complex 600 into a plurality of zones 608 and sub-zones 606 to determine the location of gaming communication device 604 within the complex. These embodiments may utilize the signal received by signal detection devices 602 from gaming communication device 604 to determine the location of the device.

In various embodiments, the location of gaming communication device 604 may be determined based upon the strength of the signal received by each signal detection device 602 from device 604. In various embodiments, this may be accomplished using a Received Signal Strength Indication (RSSI) value or any other suitable indication of signal strength. Generally, the closer a sub-zone is to a signal detection device, the stronger the signal the signal detection device will receive from a gaming communication device located in that sub-zone. Therefore, given a plurality of signal strength readings taken from different points in the casino complex (i.e., signal detection devices 602), these different signal strength readings may be used to determine the location of the device.

With this in mind, each sub-zone 606 of casino complex 600 may be associated with a reference set of signal strengths received by the signal detection devices from a device located in that particular sub-zone. Typically, these values are generated, and periodically recalibrated, by taking a reference reading from a gaming communication device located that sub-zone. After each sub-zone is associated with a reference set of signal strengths, these reference signal strengths may be compared with the signal strengths received by the signal detection devices from a gaming communication device. Since each sub-zone has a unique set of signal strengths, this comparison may be used to identify the particular zone in which the gaming communication device is located.

In various embodiments, the location of gaming communication device 604 may be determined based upon an elapsed time between the transmission of the signal from device 604 and the receipt of the signal by each signal detection device 602. In various embodiments, this elapsed time may be determined based on a Time Difference of Arrival (TDOA), or any other suitable technology. As before in the case of signal strengths, each sub-zone 606 may be associated with a predetermined, or reference, set of elapsed times from transmission to receipt of a signal from a gaming communication device. This set of elapsed times will be different for each sub-zone of the casino complex, as the time it takes a signal to reach each signal detection device will depend on the proximity of the sub-zone to each base station. By comparing the time from transmission to receipt of a signal received by the signal detection devices from a gaming communication device, the sub-zone in which the device is located may be determined.

Once the location of the gaming communication device has been determined, particular embodiments may then enable and/or disable particular functions of the device based on this determination. For example, as mentioned previously, particular embodiments may disable the gaming communication device's gambling functionality from a user's guest room, while still allowing the user to use other device functions, such as purchasing merchandise or services, or buying tickets to an entertainment event. Once the user leaves his or her guest room, the gambling functionality of the gaming communication device may be enabled. Similarly, particular embodiments may prevent the gaming communication device from being used to make financial transactions from the casino floor. Once the user leaves the casino floor, such functionality may be enabled. Similarly, other functionalities of the gaming communication device may be enabled or disabled based upon the location of the device within the property in accordance with various embodiments.

In various embodiments, the various functionalities of the gaming communication device may be enabled or disabled based upon the zone 608 in which the device is located. In such embodiments, each zone 608 of the casino complex may be associated with a set of allowed activities. For example, the "lobby" zone 608*a* of the casino complex may have all activities allowed, while the "guest room" zone 608*b* of the property may have all activities allowed except gambling. Based upon the gaming communication device's location, the functionality of the gaming communication device may be limited to the set of allowed activities for the zone in which the device is located. As the gaming communication device travels from zone to zone, the location of the device may be re-determined, and the functionality of the device may be updated to reflect the set of allowed activities for the zone in which the device is now located.

Various embodiments may also use the location determination to send location-specific information to the gaming communication device. For example, a reminder that an entertainment event to which the user has tickets is about to begin may be sent to the user's device if the device (and therefore the user) is located in a different part of the casino complex. In another embodiment, a user may be alerted that the user's favorite dealer is on the casino floor if the user is located in his or her guest room.

In various embodiments, the location of the gaming communication device may be used to deliver goods and services purchased or ordered by the user of the device. For example, in various embodiments, the user may purchase food and beverages using the device. The location of the device may then be used to deliver the food and beverages to the user, even if the user relocates to another sub-zone after placing his or her order.

The determination of the gaming communication device's location may also be used to provide the user with directions to another part of the casino complex. For example, a user that is located on the casino floor that wishes to go to a specific restaurant within the complex may be given direction based upon his or her location. These directions may then be updated as the user progresses towards his or her desired location. In the event the user gets off-course, the location determination, which may be updated during the user's travel, may be used to alert the user that he/she has gotten off-course and then plot a new course to the desired destination.

It should be understood that the foregoing descriptions encompass but some of the implementation technologies that may be used, according to various embodiments. Other technologies may be used and are contemplated, according to various embodiments. Various embodiments may be performed using any suitable technology, either a technology currently existing or a technology which has yet to be developed.

User Profiles

According to various embodiments, the wireless gaming system can incorporate a user profile element. One or more user profiles may be created, maintained, and modified, for example, on one or more of the servers of the gaming system. Generally, the user profiles include information relating to respective users. The information may be maintained in one or more databases. The information may be accessible to the gaming server and/or to one or more mobile devices. The devices which may access the information may, according to certain embodiments, include gaming devices or gaming management devices. Gaming management devices may include wireless devices used by casino staff to provide gaming services or gaming management services.

Various embodiments include software and/or hardware to enable the provision, modification, and maintenance of one or more user profiles. Thus, one or more user profiles may each comprise a set of data maintained in a data storage device. The data set(s) for each respective user profile may reflect any of a number of parameters or pieces of information, which relate to the particular user(s) corresponding to the profile(s). Although not intended to be exhaustive, such information may include, for example, gaming activity preferences, such as preferred game and/or game configuration, preferred screen configuration, betting preferences, gaming location preferences, dining and other service preferences, and so forth. The information may also include user identity information, such as name, home address, hotel name and room number, telephone numbers, social security numbers, user codes, and electronic files of fingerprint, voice, photograph, retina scan, or other biometric information. User profile information may also include information relating to the user, but not determined by the user or the user's activities. Such information may include any information associated with, or made part of, a profile. For example, an entity such as a casino, may include as part of a profile certain rules governing the distribution of promotions or offers to the user. User profile information can include any codes, account numbers, credit information, approvals, interfaces, applications, or any other information which may be associated with a user. Thus, user profile information may include any information that is particular to a given user. For example, profile information may include the location(s) at which a particular user has played, skill levels, success levels, types of games played, and betting styles, and trends of information relating to the user's activities.

In various embodiments, user profile information may include concierge or other service information that is associated with a user. Concierge services may include restaurant services, entertainment services, hotel services, money management services, or other appropriate services that may be offered to the user of a gaming device. For example, restaurant services may include, without limitation, services that allow the user to order drinks, order food, make reservations, or perform other restaurant related activities. As another example, entertainment services may include, without limitation, services that allow the user to purchase show tickets, arrange appointments or services, virtually shop, arrange transportation, or perform other entertainment related activities. Hotel services may include, for example, services that allow the user to check in, check out, make spa appointments, check messages, leave messages, review a hotel bill, or perform other guest-related activities. Money management services may include, for example, services that allow the user to transfer funds, pay bills, or perform other money management activities.

The gaming system may be configured to establish a new profile for any user who is using a gaming device for the first time. Alternatively, a new profile may be established for a prior user who has not played for a predetermined time period. The gaming system may set up the profile, monitor user activities, adjust the profile, and adjust information (such as graphics) displayed to the user. The gaming system may be configured to use the profile information to alter the presentation of gaming information to the user. For example, if a prior user has returned to the gaming system, the system may consult the profile for the user and determine that in the prior session of gaming the user lost money on craps but won money on blackjack. Based on this information, the system may adjust the default gaming screen and present a blackjack table for the user. As a further example, the profile information may indicate that the majority of the user's prior blackjack time was spent on $25 minimum tables. The system may, accordingly, make a further adjustment to the gaming environment and make the blackjack table being presented a $25 table. In this sense, the gaming system enables personalized wireless gaming based on one or more criteria maintained in a user profile.

The user profiles may be established, maintained, and periodically updated as necessary to enable a gaming provider to provide an enhanced, current, and/or customized gaming experience. Updates may be undertaken based on any suitable trigger, such as the occurrence of an event, the occurrence of a user activity, or the passage of a certain predetermined time period. Any or all of the profile information may be updated.

Alerts

In some embodiments, the gaming system may be configured to initiate one or more alerts to one or more users based on any number of criteria. For instance, an alert may be based on the location of a user. The system may also be configured to keep track of other non-location dependent parameters. The initiation of an alert may depend on a time parameter. Gaming alerts can also be based on this and/or other information maintained in a user profile. Alerts can be prioritized for presentation and the content and display of the alerts may be customized by the user or another entity. As a related concept, the system may be configured to provide directions and/or maps. Another related concept involves enabling a user to view a certain activity or area remotely. The alert may be generated in response to the existence of data within a user profile. Additionally, the content and presentation of the alert may be determined based on information in the user profile. Thus, when the alerts occur and what the alerts indicate may be customized or tailored according to user preferences (or any other information maintained about the user (e.g., in a user profile) .

In some embodiments, an alert may be presented or displayed to the user in a format determined, at least in part, by any of the parameters described or contemplated herein. For example, if the user is located outdoors, the display may be automatically brightened in order to allow the user to more easily view the alert. The alert may be presented in any one or a combination of textual, visual, oral, or other information exchange formats. Alerts presented to users on the screen of a gaming communication device, for example, may be configured in any desirable manner. Preferably, the information is displayed in a way as to most effectively utilize the screen real estate to convey the alert message. Thus, different alerts of differing types, or having differing priorities, can be displayed differently on the gaming device. For example, a more important alert can be displayed as a popup while secondary alerts scroll at the bottom of the screen. The player can register for alerts and determine his own particular alert configuration preferences.

According to some embodiments, directional information may be provided to one or more users. The directional information may be associated with an alert. The directional information may be based on any of the parameters described herein (e.g., profiles, alerts, locations, changes in play or other activities, etc). Directions may be given to activities, locations, seats, tables, recreational spots, restaurants, change cages, information booths, casinos, hotels, sports venues, theaters, etc. For example directions may be given to a particular table or gaming area, a casino other than the one where the user is presently located or where another user is located, a restaurant that is specified in a user profile, a sports book area of a casino, a hotel room, etc.

The directions can be presented orally, textually, and/or graphically (e.g., as map with zoom capabilities). An example of how directions would be provided involves a user profile indicating that the user likes to play high-limit blackjack on Saturday nights, but that the user does not have a particular casino preference. If the user enters any casino for which the system is operable, the system provides the user with an alert inviting the player to the high-limit blackjack tables and directional information in the form of a visual route. Another example involves a user leaving a sports book in a casino and the user has indicated that he wants to play craps. The device gives walking directions to the craps tables. Another example involves a user that has a preferred list of dinner restaurants. At a predetermined time (e.g., 8:00 pm), the system presents the user with the list, lets the user make a selection and a reservation. The system then provides the user with verbal directions from the user's current location to the selected restaurant. The system may also be configured to provide ancillary information based, at least in part, on the alert, the profile, or the directional information being provided. For example, the system may notify a user that the user will need a cab, or will need to take the tram, or will need a jacket and tie, or will need an umbrella, etc. depending on where the user is going and the route he is taking.

According to various embodiments, the system enables a user to view a certain activity or area remotely. For example, cameras (or other viewing devices) may be disposed throughout a casino property (or other relevant area). At kiosks, or on the wireless gaming devices, users can "peer" into one or more selected areas to see the activity in the selected area(s). For example, from the pool, a user can tell if the craps tables have changed limits or are filling up with people. From the craps table, a user can see if the restaurant or bar is becoming crowded.

According to various embodiments, the operation of the alerts module and the alerts methods are integrated with various techniques for managing user profile information. An example of this aspect is that the system may be configured to recognize that a user has certain preferred dealers or stickmen when playing certain casino games. When those dealers or stickmen are on duty, and if the user is located in a certain area, or within a certain distance, an alert may be sent inviting the user to participate in the gaming activity at the particular table where the dealer or stickman is on duty.

Thus, when user profile information indicates that a one or more predetermined criteria are met, the system may send an alert to the corresponding user or to another user. For example, the system may "learn" that a player is a fan of certain sports teams. The system monitors information about upcoming events that involve those teams and, at a predetermined time, checks to see if the user has placed a bet on the event(s). If not, the system invites the user to visit a sports book to make a bet. As another example, the system knows a user prefers $10 minimum tables and alerts the user to the opening of a seat at such a table. As another example, the alerts can be triggered by information which is not directly related to or associated with the particular user (e.g., non-user specific information). For instance an alert might be triggered by a certain time or the occurrence of a certain event (e.g., the odds given on a certain sports event changing by a certain predetermined amount).

Service Applications

According to various embodiments, gaming services may be provided as an application add-on to a pre-existing communication or data service. Thus, gaming service applications may be made available to customers of a pre-existing communication or data service. For example, customers of a particular wireless telephone or data service may be offered any one or combination of the various gaming service applications discussed herein as an additional feature that is bundled with the telephone or data service. Although this document may refer to the communication service bundled with offered gaming service applications as including pre-existing communication services, it is recognized that the gaming services applications may be offered and accepted as part of a package with newly-activated communications service plan. In still other embodiments, the gaming service may be established first and the communication service may be added later.

The gaming service applications bundled with, or otherwise offered in conjunction with communication services, may be customized to meet the needs of the customers, service providers, or both. For example, a service provider may elect to make certain gaming service applications available to only a subset of the service providers' customers. Accordingly, not all customers associated with a service provider may be offered gaming services. As an another example of customized gaming service applications, a communication service may offer customers a number of gaming service plans which may provide different levels of service. For example, certain services such as advertisement services and/or promotional services may be free to customers of the communications service. Such levels of service may be customer-selected, service provider-selected, or both.

Customers may be billed separately for add-on gaming services, or in conjunction with the invoice the customer already receives for the pre-existing communications service. For instance, in certain embodiments, gaming services may be billed as an add-on in the same way that Caller ID services, call waiting services, and call messaging services result in fees that are in addition to the basic fees associated with communication services.

Peer-to-Peer Wireless Gaming

According to various embodiments, gaming services enable peer-to-peer wireless gaming. Specifically, the system may enable multiple players to participate in the same gaming activity at the same time from dispersed locations. This may be particularly desirable in the case of certain games such as, but without limitation, horse racing, poker, and blackjack. The system may also enable a single player to participate in multiple positions with respect to a particular game. For example, a user may be permitted to play multiple hands of blackjack. Particular aspects include such features as providing assistance to a user in finding a particular activity. For example, a first player may want to play poker at a six-person table. The gaming system may be used to identify such a poker table that has a position available for the first user's participation. Additionally or alternatively, a first player might want to play poker at the same table as a second player, and the system may be configured to assist the first player in finding a game in which the second player is already participating.

Location determination techniques may be incorporated to enable peer-to-peer gaming or related services. For example, a "buddy network" may be established to track members of a selected group. For example, a group of friends might all be in a gambling jurisdiction but be located at various dispersed places within that jurisdiction. The gaming system allows the establishment of a private buddy network of peers for this group of friends. The system enables one or more members of the group to track one or more other members of the group. In various embodiments, the system may also allow messages from and to one or more group members. For example, the system also allows members to invite other members to participate in certain wireless gaming activities. Additionally or alternatively, the system may allow members of the group to bet on the performance of another member of the group who is participating in a virtual or actual game.

Location determination techniques may also be incorporate to establish an "alert system." The alert system may be used to invite certain types of players to participate in a gaming activity. Criteria may then be used to identify users of gaming devices that meet the criteria. For example, a gaming participant may wish to initiate a gaming activity with other users of gaming devices that qualify as "high rollers" or "high stakes gamers." As other examples, a celebrity user may wish to initiate a gaming activity with other celebrities, or a senior citizen may wish to initiate a gaming activity with other senior citizens. In each instance, the user may identify criteria that may then be used to identify other gaming participants that meet these criteria for the initiation of a peer-to-peer gaming event.

It should be understood that the foregoing descriptions encompass but some of the implementation technologies that may be used, according to various embodiments. Other technologies may be used and are contemplated, according to various embodiments. Various embodiments may be performed using any suitable technology, either a technology currently existing or a technology which has yet to be developed.

Gaming and Wireless System

Various embodiments include a gaming system including hand-held personal gaming devices. The gaming system is adapted to present one or more games to a user of one of the hand-held gaming devices.

In various embodiments, the gaming system includes a portable gaming device or interface. The portable gaming device has a display for displaying game information to a player, at least one input device for receiving input from the player and is capable of receiving and sending information to a remote device/location. The gaming system also includes a game server for generating game data, transmitting game data to the portable gaming device and receiving information, such as player input, from the portable gaming device. The gaming system further includes a payment transaction server for validating payment and establishing entitlement of a player to play a game via the portable gaming device as provided by the game server.

In various embodiments, the gaming system includes one or more stationary gaming machines or other devices capable of printing tickets having a value associated therewith. The portable gaming device includes a ticket reader for reading ticket information for use by the payment transaction server in verifying the associated value for permitting the player to play the game.

In one or more embodiments, the portable gaming devices communicate with other devices (such as the game server) via a wireless communication channel. Appropriate relays and transceivers are provided for permitting the wireless communication.

In one or more embodiments, the portable gaming device includes a plurality of interfaces for changing the configuration of the gaming device or interacting with one or more transaction servers. In some embodiments, a login interface is provided for receiving login information regarding a user of the device. In various embodiments, the number of interfaces or other functions or features displayed or permitted to be accessed are configured depending upon the user of the device. In the event a gaming representative identifies himself, interfaces permitting access to a variety of control functions may be provided. In the event a player identifies themselves, such control functions may not be accessible, but instead only consumer-related functions may be accessible such as game play.

In one or more embodiments the gaming system includes one or more transaction servers, such as a food transaction server. Using an interface of the portable gaming device a player or other user may request services from the food transaction server. For example, a player may request food, drink, a restaurant reservation or other service.

One or more embodiments comprise a method of playing a game via a portable gaming device associated with a gaming network. In some embodiments, a player obtains a portable gaming device, such as by checking out the device from the hostess station of a restaurant or the front desk of a hotel/casino. The player provides value to the gaming operator, such as a credit card or cash deposit. This value is associated with the server and matched with a ticket number, player tracking number or other identifier.

The game device is configured for player play using the login interface. The act of logging in may be performed by the player or the gaming operator. The player next establishes entitlement to obtain services, such as the playing of a game, by showing the existence of value. In some embodiments, the player scans his ticket using the ticket reader of the device. The scanned information is transmitted to the payment transaction server for verifying entitlement of the player to play a game or obtain other services. In the event the entitlement is verified, then the player is permitted to engage in the play of a game or request service.

In the event a player wishes to play a game, the player indicates such by selecting a particular game using a game play interface. Upon receipt of such an instruction, the game server generates game data and transmits it to the personal gaming device. The transmitted data may comprise sound and video data for use by the personal gaming device in presenting the game. The player is allowed to participate in the game by providing input to the game server through the personal gaming device. The game server determines if the outcome of the game is a winning or losing outcome. If the outcome is a winning outcome, an award may be given. This award may be cash value which is associated with the player's account at the payment transaction server. If the outcome is a losing outcome, then a bet or wager placed by the player may be lost, and that amount deducted from the player's account at the transaction server.

FIG. 8 is a block diagram of a gaming system in accordance with various embodiments.

As illustrated, the gaming system B20 includes a plurality of gaming machines B22*a*, B22*b*, B22*c*, B22*d*, B22*e*, B22*f*, B22*g*, B22*h*, B22*i*, B22*j*. In some embodiments, these gaming machines B22*a*, B22*b*, B22*c*, B22*d*, B22*e*, B22*f*, B22*g*, B22*h*, B22*i*, B22*j* are of the stationary type. In general, the gaming machines B22*a*, B22*b*, B22*c*, B22*d*, B22*e*, B22*f*, B22*g*, B22*h*, B22*i*, B22*j* are arranged to present one or more games to a player. In various embodiments, the games are of the type requiring the placement of a wager or bet and are of the type by which a player receiving a winning outcome is provided an award, such as a monetary award. These devices may comprise for example, video poker and slot machines. In addition, the gaming system B20 includes one or more hand-held, portable gaming devices (PGDs) B24. The PGD B24 is also arranged to present one or more games to a player, and as described below, may be used as an access point for a variety of other services. The device referred to herein as a "personal gaming device" may be referred to by other terminology, such as a portable gaming interface, personal game unit or the like, but regardless of the name of the device, such may have one or more of the characteristics herein.

In addition, in various embodiments, the PGD B24 is in communication with at least one gaming server B28. As described below, in various embodiments, the one or more games which are presented via the PGD B24 to the player are provided by the gaming server B28.

The gaming machines B22*a*, B22*b*, B22*c*, B22*d*, B22*e*, B22*f*, B22*g*, B22*h*, B22*i*, B22*j* and each PGD B24 is in communication with a payment system referred to herein as the "EZ-Pay" system. This system includes a server B26 for receiving and transmitting information. In general, the EZ Pay system is utilized to accept payment from a player for the playing of games and obtaining of other goods and services, and for paying a player winnings or awards.

In the embodiments illustrated, the gaming system B20 includes other servers B30, B32 for transmitting and/or receiving other information. In some embodiments, one server B30 comprises a prize transaction server. Another server B32 comprises a food transaction server. In a some embodiments, information may be transmitted between the PGD B24 and these servers B30, B32.

The EZ Pay system, according to various embodiments, will now be described in more detail with reference to FIG. 9. The EZ Pay system may constitute an award ticket system which allows award ticket vouchers to be dispensed in lieu of the traditional coin awards or reimbursements when a player wins a game or wishes to cash out. These tickets may also be used by gaming machines and other devices for providing value, such as for payment of goods or services including as a bet or ante for playing a game.

Figure 9:
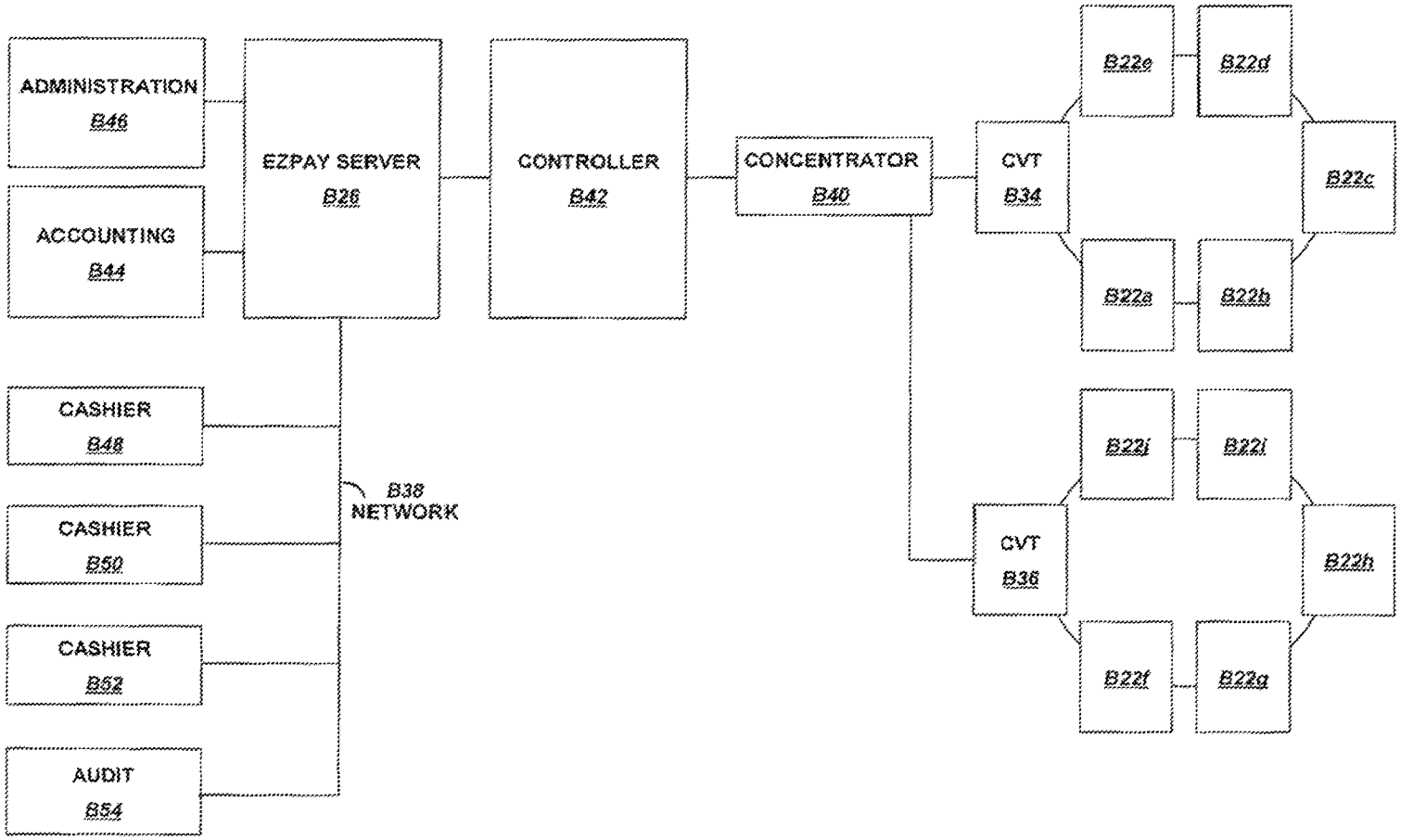
FIG. 9 is a block diagram of a payment system forming a part of the gaming system illustrated in FIG. 8, according to some embodiments.

FIG. 9 illustrates some embodiments of such a system in block diagram form. As illustrated, a first group of gaming machines B22*a*, B22*b*, B22*c*, B22*d*, and B22*e* is shown connected to a first clerk validation terminal (CVT) B34 and a second group of gaming machines B22*f*, B22*g*, B22*h*, B22*i*, and B22*j* is shown connected to a second CVT B36. All of the gaming machines print ticket vouchers which may be exchanged for cash or accepted as credit or indicia in other gaming machines. When the CVTs B34,B36 are not connected to one another, a ticket voucher printed from one gaming machine may only be used as indicia of credit in another gaming machine which is in a group of gaming machines connected to the same CVT. For example an award ticket printed from gaming machine B22*a* might be used as credit of indicia in gaming machines B22*b*, B22*c*, B22*d*, and B22*e*, which are connected to the common CVT B34, but may not be used in gaming machines B22*f*, B22*g*, B22*h*, B22*i*, and B22*j* since they are each connected to the CVT B36.

The CVTs B34,B36 store ticket voucher information corresponding to the outstanding ticket vouchers that are waiting for redemption. This information is used when the tickets are validated and cashed out. The CVTs B34,B36 store the information for the ticket vouchers printed by the gaming machines connected to the CVT. For example, CVT B34 stores ticket voucher information for ticket vouchers printed by gaming machines B22*a*, B22*b*, B22*c*, B22*d*, and B22*e*. When a player wishes to cash out a ticket voucher and the CVTs B34,B36 are not connected to one another, the player may redeem a voucher printed from a particular gaming machine at the CVT associated with the gaming machine. To cash out the ticket voucher, the ticket voucher is validated by comparing information obtained from the ticket with information stored with the CVT. After a ticket voucher has been cashed out, the CVT marks the ticket as paid in a database to prevent a ticket voucher with similar information from being cashed multiple times.

Multiple groups of gaming machines connected to the CVTs B34,B36 may be connected together in a cross validation network B38. The cross validation network typically comprises one or more concentrators B40 which accept input from two or more CVTs and enables communications to and from the two or more CVTs using one communication line. The concentrator B40 is connected to a front end controller B42 which may poll the CVTs B34,B36 for ticket voucher information. The front end controller B42 is connected to an EZ pay server B26 which may provide a variety of information services for the award ticket system including accounting B44 and administration B46.

The cross validation network allows ticket vouchers generated by any gaming machine connected to the cross validation network to be accepted by other gaming machines in the cross validation network B38. Additional, the cross validation network allows a cashier at a cashier station B48, B50, B52 to validate any ticket voucher generated from a gaming machine within the cross validation network B38. To cash out a ticket voucher, a player may present a ticket voucher at one of the cashier stations B48, B50, B52. Information obtained from the ticket voucher is used to validate the ticket by comparing information on the ticket with information stored on one of the CVTs B34,B36 connected to the cross validation network B38. As tickets are validated, this information may be sent to another computer B54 providing audit services.

As described above, the gaming system B20 may also include one or more hand-held PGDs B24. In various embodiments, the PGD B24 is a portable device capable of transmitting and receiving information via a wireless communication link/network.

Referring again to FIG. 8, the gaming system B20 may include a printer B56, wireless communication relays B58 and B60, and wireless transceivers B62, B64, B66 and B68 connected to the remote transaction servers B26, B28, B30 and B32. In various embodiments, a player may obtain the PGD B24, and after being provided with the appropriate authority, may play one or more games and/or obtain other services including food services or accommodation services.

Figure 10:
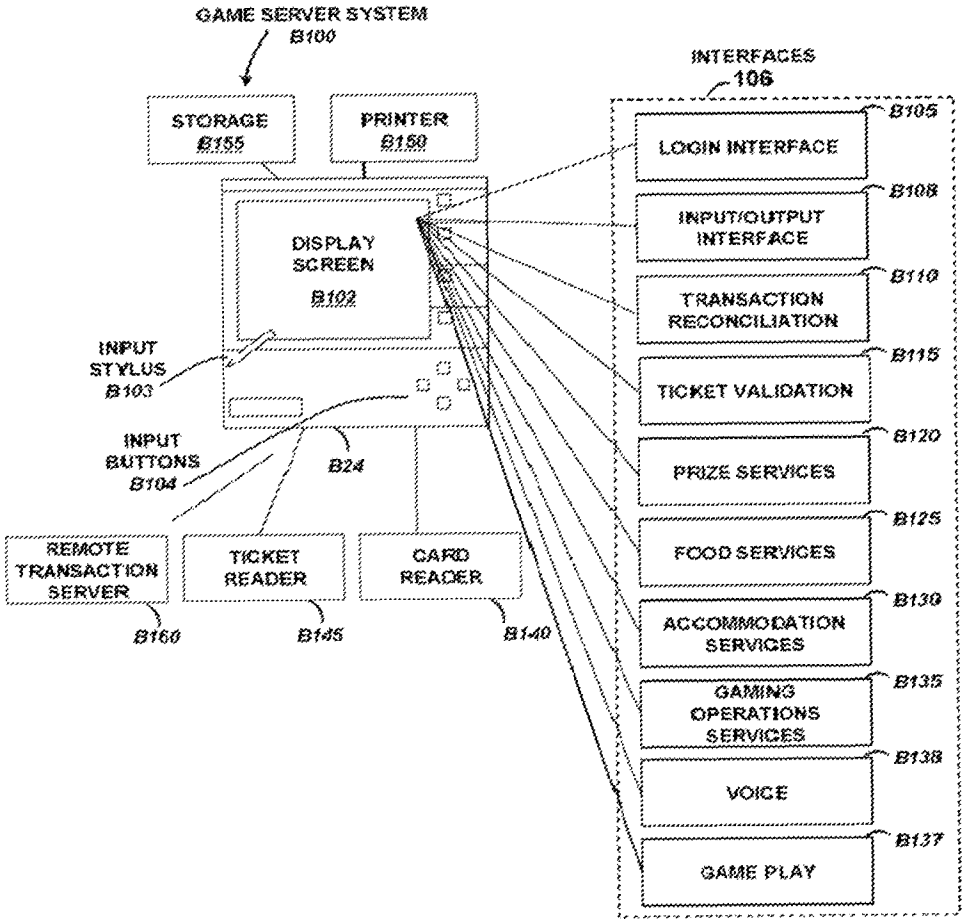
FIG. 10 is a schematic diagram of a portable gaming device of the gaming system illustrated in FIG. 8, according to some embodiments.

FIG. 10 illustrates the PGD B24 and a block diagram of a game and service system which may be implemented by the gaming system B20 illustrated in FIG. 8. In various embodiments, the game and service system B100 is comprised of at least one PGD B24 and a number of input and output devices. The PGD B24 is generally comprised of a display screen B102 which may display a number of game service interfaces B106. These game service interfaces B106 are generated on the display screen B102 by a microprocessor of some type (not shown) within the PGD B24. Examples of a hand-held PGD B24 which may accommodate the game service interfaces B106 shown in FIG. 10 are manufactured by Symbol Technologies, Incorporated of Holtsville, N.Y. The interface or menu data may be stored in a local memory, or the data may be transmitted to the PGD B24 from a remote location (such as a data server). This reduces the memory requirement of the device.

The game service interfaces B106 may be used to provide a variety of game service transactions and gaming operations services, including the presentation for play by a user of one or more games. The game service interfaces B106, including a login interface B105, an input/output interface B108, a transaction reconciliation interface B110, a ticket validation interface B115, a prize services interface B120, a food services interface B125, an accommodation services interface B130, a gaming operations interface B135, and a game play interface B137 may be accessed via a main menu with a number of sub-menus that allow a game service representative or player to access the different display screens relating to the particular interface.

In one or more embodiments, some or all of the interfaces may be available to a user of the PGD B24. For example, in one or more embodiments, the PGD B24 may have a dual purpose of both being usable by a player to play games and engage in other activities, and also be used by gaming operations personnel for use in providing services to players and performing administrative functions. In various embodiments, certain PGDs B24 may be specially configured for use only by players, and other PGDs B24 may be specially configured for use only by gaming or other personnel. In such event, the interfaces B106 may be custom programmed.

In one or more embodiments, only certain interfaces B106 may be displayed, depending on the status of the user of the PGD B24. In some embodiments, the particular interfaces B106 which are displayed and thus accessible for use are determined by the status of the user as indicated through a login function. In various embodiment, when the PGD B24 is operable (such as when a power button is activated) the default status for the PGD B24 is the display of the login interface B105. Once a user of the PGD B24 has logged in, then the status of the PGD display is changed.

In one or more embodiments, the login interface B105 may allow a game service representative to enter a user identification of some type and verify the user identification with a password. When the display screen B102 is a touch screen, the user may enter the user/operator identification information on a display screen comprising the login interface B105 using an input stylus B103 and/or using one or more input buttons B104. Using a menu on the display screen of the login interface, the user may select other display screens relating to the login and registration process. For example, another display screen obtained via a menu on a display screen in the login interface may allow the PGD B24 to scan a finger print of the game service representative for identification purposes or scan the finger print of a game player.

In the event a user identifies themselves as a gaming operator or representative, then the PGD B24 may be arranged to display one or more other interfaces such as those listed above and described in detail below. In one or more embodiments, the default status or login may be a "player" mode login.

In various embodiments, the login interface B105 may allow a player to identify themselves to configure the PGD B24 to permit the player to access a plurality of player services, such as playing games and the like. In various embodiments, the login interface B105 includes a request that the user identify themselves as a "player" or "authorized personnel." In the event "authorized personnel" is selected, then the above-referenced user identification (including password) may be requested. If "player" is selected, then in various embodiments the player is requested to provide an EZ pay ticket. As described in more detail below, in various embodiments, a player who wishes to play one or more games or obtain other goods or services uses an EZ pay ticket to provide the credit or payment therefor. The ticket may be obtained from a cashier or by play of another gaming device (such as devices B22*a*, B22*b*, B22*c*, B22*d*, B22*e*, B22*f*, B22*g*, B22*h*, B22*i*, B22*j* in FIG. 8). The ticket may be verified through the EZ pay system described above.

In various embodiments, the PGD B24 includes a ticket reader B145 and a card reader B140. In some embodiments, the ticket reader B145 may be of a variety of types. In some embodiments, the reader comprises a bar-code reading optical scanner. In this arrangement, a user of the PGD B24 may simply pass the bar-coded ticket in front of the bar-code reader. In some embodiments, the card reader B140 comprises a magnetic-stripe card type reader for reading information associated with a magnetic stripe of a card, such as a player tracking card.

After having provided the appropriate authorization, access may be provided to the user of the PGD B24 of one or more of the following interfaces B106.

In one or more embodiments, an authorized user may be provided with access to the input/output interface B108. In a various embodiments, such access is only provided to a game service operator and not a player. In one or more embodiments, the input/output interface B108 permits a user to select, from a list of devices stored in memory on the PGD B24, a device from which the PGD may input game service transaction information or output game service transaction information. For example, the PGD B24 may communicate with the ticket reader B145. As another example, the PGD B24 may input information from the card reader B140. Such input may be useful, for example, if a game service operator wishes to verify the authenticity of a player tracking card or the like.

The PGD B24 may output game and service transaction information to a number of devices. For example, to print a receipt, the PGD B24 may output information to a printer B150. In this game service transaction, the PGD B24 may send a print request to the printer B150 and receive a print reply from the printer B150. The printer B150 may be a large device at some fixed location or a portable device carried by the game service representative. As another example, the output device may be the card reader B140 that is able to store information on a magnetic card or smart card. Other devices which may accept input or output from the PGD B24 are personal digital assistants, microphones, keyboard, storage devices, gaming machines and remote transaction servers.

The PGD B24 may communicate with the various input mechanisms and output mechanisms using both wire and wire-less communication interfaces. For example, the PGD B24 may be connected to the printer B150 by a wire connection of some type. However, the PGD B24 may communicate with a remote transaction server B160 via a wire-less communication interface including a spread spectrum cellular network communication interface. An example of a spread spectrum cellular network communication interface is Spectrum 24 offered by Symbol Technologies of Holtsville, N.Y., which operates between about 2.4 and 2.5 Gigahertz. The information communicated using the wireless communication interfaces may be encrypted to provide security for certain game service transactions such as validating a ticket for a cash pay out. Some devices may accommodate multiple communication interfaces. Such a spread spectrum network is but one possible communication scheme.

Another type of interface that may be stored on the PGD B24 is the award ticket validation interface B115. In some embodiments, this interface is only available to an authorized game service representative, and not a player. Some embodiments of the award ticket interface B115 may accommodate the EZ pay ticket voucher system and validate EZ pay tickets as previously described. However, when other ticket voucher systems are utilized, the award ticket validation interface B115 may be designed to interface with the other ticket voucher systems. Using the award ticket validation interface B115, a game service representative may read information from a ticket presented to the game service representative by a game player using the ticket reader and then validate and pay out an award indicated on the ticket.

In various embodiments, the award ticket contains game service transaction information which may be verified against information stored on a remote transaction server B160. To validate the ticket may require a number of game service transactions. For example, after obtaining game service transaction information from the award ticket, the PGD B24 may send a ticket validation request to the remote transaction server B160 using the spread spectrum communication interface and receive a ticket validation reply from the remote server B160. In particular, the validation reply and the validation request may be for an EZ pay ticket. After the award ticket has been validated, the PGD B24 may send a confirmation of the transaction to the remote server B160. Details of the game service transaction information validation process are described with the reference to FIG. 12. In various embodiments, the award ticket interface may be configured to validate award information from a smart card or some other portable information device or validate award information directly from a gaming machine.

As game and service transactions are completed, game and service transaction information may be stored on a storage device B155. The storage device B155 may be a remote storage device or a portable storage device. The storage device B155 may be used as a back-up for auditing purposes when the memory on the PGD B24 fails and may be removable from the PGD B24.

A type of game service interface that may be stored on the PGD B24 is the prize service interface B120. As an award on a gaming machine (i.e., machines B22*a*, B22*b*, B22*c*, B22*d*, B22*e*, B22*f*, B22*g*, B22*h*, B22*i*, B22*j* in FIG. 8) or while playing a game via the PGD B24, a game player may receive a ticket (such as issued by other machine) that is redeemable for merchandise including a bicycle, a computer or luggage or receive such an award directly (such as while playing the PGD B24 itself). Using the prize service interface B120, a game service representative or player may validate the prize service ticket and then check on the availability of certain prizes. For example, when the prize service ticket indicates the game player has won a bicycle, the game service representative may check whether the prize is available in a nearby prize distribution center. Alternatively, a player may be permitted to do the same thing. In some embodiments, a player may be awarded a prize of a particular level, there being one or more particular prizes on that level. In such events, the player may use the interface B120 to determine what prizes are currently available in the prize level just awarded. The PGD B24 may validate a prize ticket and check on the availability of certain prizes by communicating with a remote prize server. Further, the game service representative may have the prize shipped to a game player's home or send a request to have the prize sent to a prize distribution location. The game service transactions needed to validate the prize ticket including a prize validation request and a prize validation reply, to check on the availability of prizes and to order or ship a prize may be implemented using various display screens located within the prize interface. The different prize screens in the prize service interface B120 may be accessed using a menu located on each screen of the prize service interface. In some embodiments, the prize service interface B120 may be configured to validate prize information from a smart card or some other portable information device or validate award information directly from a gaming machine.

A type of game service interface that may be stored on the PGD B24 is the food service interface B125. As an award on a gaming machine or as compensation for a particular amount of game play, a game player may receive a free food or drink. Using the food service interface B125, the player may redeem the food or drink award, or a game service representative may validate such an award (for example, the award may be provided to a player of a gaming device B22*a* in the form of a ticket) and check on the availability of the award. For example, when the game player has received an award ticket valid for a free meal, the food service interface may be used to check on the availability of a dinner reservation and make a dinner reservation. As another example, the PGD B24 may be used to take a drink or food order by the player thereof. Such an order may be processed via the remote food server B32 (see also FIG. 8). The transactions needed to validate a food ticket or award, to check on the availability of food services, request a food service and receive a reply to the food service request may be implemented using various display screens located within the food service interface B125. These display screens may be accessed using a menu located on each screen of the food service interface. In some embodiments, the food service interface may be configured to validate food service information from a smart card or some other portable information device.

Another type of game service interface that may be stored on the PGD B24 is an accommodation service interface B130. As an award for game play or as compensation for a particular amount of game play, a game player may receive an award in the form of an accommodation service such as a room upgrade, a free night's stay or other accommodation prize. using the accommodation service interface B130, the player may check on the availability of certain accommodation prizes. For example, when the game player has received an award for a room upgrade, the accommodation service interface may be used to check on the availability of a room and to make a room reservation. Regardless of whether the player has won an accommodation award, the player may utilize the accommodation service interface B130 to reserve a room (such as an additional night's stay) or an upgrade to a room. In some embodiments, a player of a game may be issued a ticket (such as from a free-standing game device B22*a*, B22*b*, B22*c*, B22*d*, B22*e*, B22*f*, B22*g*, B22*h*, B22*i*, B22*j* in FIG. 8), and a gaming representative may use the accommodation service interface B130 in order to validate the player's award ticket and check on the availability of the award and institute the award. As another example, the PGD B24 may be used to order a taxi or some other form of transportation for a player at a gaming machine preparing to leave the game playing area. The game playing area may be a casino, a hotel, a restaurant, a bar or a store.

The PGD B24 may validate the accommodation service award and check on the availability of certain accommodation awards by communicating with a remote accommodation server. The transactions needed to validate the accommodation ticket, check on the availability of accommodation services, request an accommodation service and receive a reply to the accommodation service request may be implemented using various display screens located within the accommodation service interface. These display screens may be accessed using a menu located on each screen of the accommodation service interface. In some embodiments, the accommodation service interface may be configured to validate accommodation service information from a smart card or some other portable information device.

A type of game service interface that may be stored on the PGD B24 is a gaming operations service interface B135. Using the gaming service interface B135 on the PGD B24, a game service representative may perform a number of game service transactions relating to gaming operations. For example, when a game player has spilled a drink in the game playing area, a game service representative may send a request to maintenance to have someone clean up the accident and receive a reply from maintenance regarding their request. The maintenance request and maintenance reply may be sent and received via display screens selected via a menu on the screens of the gaming operations service interface. As another example, when a game service representative observes a damaged gaming machine such as a broken light, the game service representative may send a maintenance request for the gaming machine using the PGD B24. In one or more embodiments, a player may be permitted various options through the gaming service interface B135. For example, a player may be permitted to request a gaming service representative or attendant using the interface B135.

A type of game service interface that may be stored on the PGD B24 is a transaction reconciliation interface B110. In various embodiments, the PGD B24 contains a memory storing game service transaction information. The memory may record the type and time when a particular game service transaction is performed. At certain times, the records of the game service transactions stored within the PGD B24 may be compared with records stored at an alternate location. For example, for an award ticket validation, each time an award ticket is validated and paid out, a confirmation is sent to a remote server B160. Thus, information regarding the award tickets, which were validated and paid out using the PGD B24, should agree with the information regarding transactions by the PGD stored in the remote server B160. The transaction reconciliation process involves using the transaction reconciliation interface B110 to compare this information. In various embodiments, only a gaming service representative (and not a player) is permitted access to the transaction reconciliation interface B110.

A type of game service interface that may be stored on the PGD B24 is a voice interface B138. Using the spread spectrum cellular or other communication network incorporated into the PGD, a player and/or game service representative may use the PGD B24 as a voice communication device. This voice interface B138 may be used to supplement some of the interfaces previously described. For example, when a game player spills a drink the game service representative may send maintenance request and receive a maintenance reply using the voice interface B138 on the PGD B24. As another example, when a game player requests to validate a food service such as free meal, such a request may be made by the player or a game service representative at a restaurant or other location using the voice interface B138 on the PGD B24. In some embodiments, a player may be permitted to contact a player of another PGD B24, such as by inputting a code number assigned to the PGD B24 through which communication is desired. Such would permit, for example, a husband and wife using two different PGDs B24 to communicate with one another. The voice interface B138 may also permit a player to contact the front desk of a hotel/casino, an operator of a switchboard at the gaming location or the like.

A type of game service interface that may be stored on the PGD B24 is a game play interface B137. In various embodiments, a player is permitted to access the game play interface B137 in order to select from one or more games for play. The game play interface B137 may include a menu listing one or more games which the player may play via the PGD B24. In various embodiments, game play is facilitated with the game server B28 (see FIG. 8).

In one or more embodiments, the gaming control code is not resident at the PGD B24, but instead at a secure, remote server. Referring to FIG. 8, game play data is transmitted from the game server B28 to the PGD B24, and from the PGD B24 to the game server B28. Preferably, the PGD B24 is adapted to receive and process data, such as by receiving video data and processing the data to present the information on the display B102. Likewise, the PGD B24 is arranged to accept input and transmit that input or instruction to the game server B28. This arrangement has the benefit that nearly all aspects of the play of a game can be monitored, as it requires the game play data to pass to or from a remote location. This avoids, for example, storage of the gaming software at the PGD B24 where it might be tampered with, copied or the like.

In one or more embodiments, each PGD B24 has a unique identifier which is utilized to identify which PGD B24 data is transmitted from and to which data is to be transmitted to. In some embodiments, the game server B28 may thus be used to present the same or different games to a plurality of players using different PGDs B24, with the game data regarding a particular game being played at a particular PGD B24 being directed to that PGD B24 using its particular identifier.

As will be appreciated by those of skill in the art, the PGD B24 may have a variety of configurations. As stated above, the PGD B24 may be used in the gaming system B20 in which gaming code is not stored directly at the PGD. In such an embodiment, the PGD B24 may have a much more limited amount of data memory. In some embodiments, the PGD B24 includes a processor for executing control code, such as that necessary to operate the display B102, accept input from the stylus B103 or input buttons B104 or the like. In addition, the PGD B24 preferably includes a buffer memory for accepting data transmitted from the game server B28. This data may comprise data for displaying game information, such as video and sound content.

Various aspects of the use of the PGD B24 described above will now be described. In one or more embodiments, the PGD B24 may be used directly by a player. In various embodiments, a player may use the PGD B24 to play one or more games, and obtain products and services, such as food.

Figure 11:
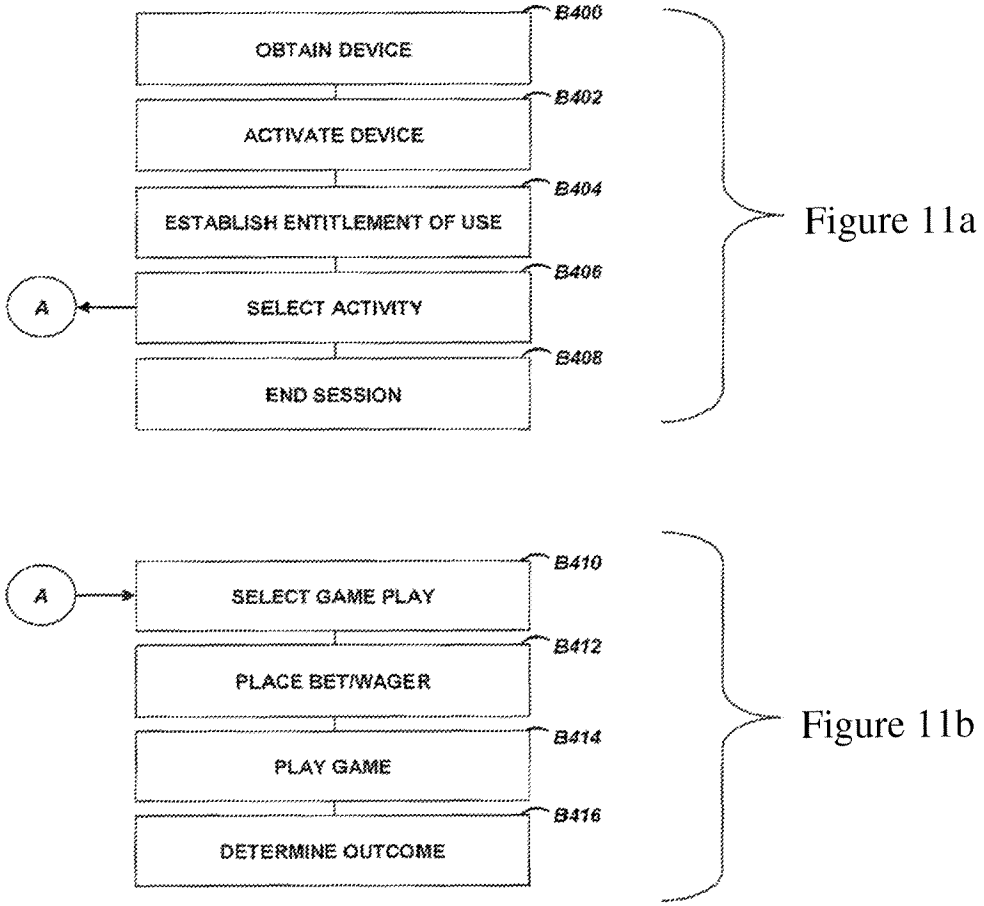
FIG. 11(*a*) is a flow diagram of a method of use of a portable gaming device by a player, according to some embodiments.

A method of use of the PGD B24, according to some embodiments, is illustrated in FIGS. 11(*a*) and 11(*b*). In general, a player must first obtain a PGD B24. For example, a player may check out a PGD B24 from a gaming operator. The player then establishes entitlement to use the PGD B24. In some embodiments, the player must indicate player status at the login interface, and obtain a valid ticket in order to activate the PGD B24. Once activated, the player is permitted to engage in a variety of transactions using the interfaces B106, such as playing a game, redeeming prizes and awards, placing food and drink orders, placing reservations, seeking gaming operator support and seeking a variety of other goods and services as described in more detail below.

One example of a method of use of the PGD B24 by a player will be described with reference to FIG. 11(*a*). In a first step B400, the player first obtains the PGD B24. In some embodiments, a gaming operator may have certain locations at which a player may obtain the PGD B24, such as the front desk of a hotel/casino, the hostess stand at a restaurant, from a gaming attendant or other location as desired. In some embodiments, a gaming operator may actually permit a player to retain the PGD B24, such as by renting, selling or giving the PGD B24 away to a player.

In a step B402, the PGD B24 is activated. In some embodiments, this step includes turning on the PGD B24 (such as with a power switch) and logging in. In some embodiments, when the PGD B24 is turned on, the login interface B105 is automatically displayed. The login interface B105 may include "player" and "authorized personnel" buttons which may be activated using the stylus B103. The player may indicate "player" status by selecting the player button with the stylus B103.

In some embodiments, the gaming operator may log the player in. For example, when a player obtains the PGD B24 from a hostess at a restaurant, the hostess may log in the player in player mode. In some embodiments, the gaming operator may have certain PGDs B24 which are for use by players and certain others which are for use by gaming personnel. In such event, the PGDs B24 which are configured for player status may automatically be configured for player mode after being turned on.

In a step B404, a player establishes entitlement to use the PGD B24. In some embodiments, this step comprises the player providing a valid ticket which is verifiable using the EZ pay portion of the gaming system B20. In some embodiments, a player may have obtained a ticket through play of a gaming machine, such as gaming machines B22*a*, B22*b*, B22*c*, B22*d*, B22*e*, B22*f*, B22*g*, B22*h*, B22*i*, B22*j* of the gaming system B20. In some embodiments, a player may be issued a ticket by a game service representative. For example, a player may provide credit at a cashier cage (such as with a credit card or cash) and be issued a ticket. A player may also pay cash or the like to a restaurant hostess and be issued a ticket.

Once the player has a ticket, the ticket may be scanned using the ticket reader B145 of the PGD B24. For example, the player may pass the ticket in front of the ticket reader B145. Once the information is read by the PGD B24, the data may be transmitted to the EZ pay server B26 for validation. Preferably, this validation confirms that the particular ticket is authorized, including the fact that it is outstanding and has value associated therewith.

In one or more embodiments, entitlement may be established in other manners. For example, in some embodiments, entitlement may be established with a player tracking or identification card which may be read using the card reader B140 of the PGD B24.

Establishing entitlement to use the PGD B24 may ensure that the player has funds for paying to obtain services and products available by use of the PGD B24. In one or more embodiments, however, this step may be eliminated. For example, in some embodiments, a player may be permitted to use the PGD B24 and then pay for goods or services in other manners. In some embodiments, a player may, for example, order food and then pay the server for the food using a room charge or cash at the time the food is delivered. In some embodiments, a player may use a credit card to pay to play games or to pay for food or the like. In such event, a credit card may be read by the card reader B140 at the time the services or products are to be provided or are ordered by the player.

In a step B406, the player is then permitted to select one or more selections from the interfaces B106. As stated above, a player may not be permitted access to all of the interfaces B106. In any event, a player may select, such as with the stylus B103, a service from the group of interfaces B106. An example of the engagement of a particular activity using the PGD B24 will be described below with reference to FIG. 11(*b*).

Once a player no longer desires to engage in any more activities using the PGD B24, the use session of the PGD B24 is ended in a step B408, and in one or more embodiments, the PGD B24 is returned to the gaming operator. In various embodiments, once a player no longer wishes to use the PGD B24, the player returns the PGD B24 to the gaming operator. At that time, the gaming operator may confirm that all transactions using the PGD B24 are closed or complete, and pay the player any winnings. In some embodiments, a player B24 is issued a new ticket representing the player's credit (including any payments made in order to first use the PGD B24, plus any winnings, less any expenditures).

An example of a method of using the PGD B24 wherein the player has selected the option of game play using the game play interface B137 will be described in detail with reference to FIG. 11(*b*). In a step B410 (which step comprises a particular embodiment of step B406 of FIG. 11(*a*)), a player has selected the event or service of "game play" using the game play interface B137.

In some embodiments, when a player has selected the game play interface B137, a menu may be displayed to the player of the one or more games which the player may be permitted to play. In some embodiments, when the player selects the game play interface B137, a signal is transmitted from the PGD B24 to the remote game server B28 instructing the game server B28 that the player wishes to play a game. In response, the game server B28 may send the latest game menu to the PGD B24 for display. In this arrangement, the menu of games which is available may be continuously updated at one or more central locations (such as the server B28) instead of at each PGD B24.

If the system B20 permits the player to select a game from a menu of games, then the method includes the step of the player selecting a particular game to be played. Once a game is selected, or if only a single game option is provided, then game play begins. In some embodiments, the game server B28 transmits data to the PGD B24 for use by the PGD B24 in presenting the game, such as video and audio content.

In some embodiments, in a step B412 a player is required to place a bet or ante to participate in a game. In some embodiments, the player may place the bet or ante using the EZ pay system. As stated above, the player preferably establishes entitlement to use the PGD B24 with an EZ pay ticket or other entitlement, which ticket demonstrates that the player has monies or credits on account which may be used to pay for goods and services. These services include game play services.

In some embodiments, when the player establishes entitlement to use the PGD B24, the value of the player's credits or monies are displayed to the player so that the player is visually reminded of these amounts. When a player begins play of a game, the player may input a bet and ante which is no more than the value of the credits or monies which the player has on account. Once a player has placed a bet or ante, that information is transmitted to the EZ pay server B26 and is deducted from the player's account. A new credit value is then displayed at the PGD B24 to the player.

In various embodiments, a player may provide credit for a bet or ante in other manners. For example, a player may swipe a credit card through the card reader B140 in order to provide the necessary credit for the bet or ante.

In a step B414, the player is then permitted to engage in the game. In some embodiments, game play comprises the game server B28 executing game code and transmitting information to the PGD B24 for presenting certain aspects of the game to the player. When necessary, the player is permitted to provide input, and the input data is transmitted from the PGD B24 to the game server B28.

As one example of a game, the game may comprise video poker. In this embodiment, the game server B28 executes code for randomly generating or selecting five cards. Data representing video images of the cards is transmitted to the PGD B24, where the images of the five dealt cards are displayed on the display screen B102.

The instruction "draw" or "stay" may be displayed to the player. At that time, the player may select one or more of the cards to hold or replace. In the event the player elects to replace any card, that instruction is transmitted to the game server B28 which then randomly generates or selects replacement cards. The replacement card data is transmitted to the PGD B24 and images of the replacement cards are displayed.

In the event the hand of five cards (including any replacement cards) is determined by the game server B28 to comprise a predetermined winning hand, then the player may be paid a winning amount. If not, then the player loses his bet or ante. This step comprises step B416 of the method, that of determining the outcome of the game.

If the outcome is a winning outcome, then the player may be paid a winning by crediting the player's account through the EZ pay server B26. In that event, the player's credits value as displayed is updated to reflect the player's winnings.

A player may then elect to play the game again, play a different game, or select one or more other services offered. In some embodiments, a "return to main menu" button or the like may be displayed to the player at all times, permitting the player to return to a display including the various interfaces B106.

In some embodiments, when the player has completed use of the PGD B24, the player returns the PGD B24 to the gaming operator. For example, the player may return the PGD B24 to a cashier cage or a game service operator. In various embodiments, the game service operator or other party then issues the player a ticket for any credit or value which remains in the player's account. The PGD B24 may then be deactivated so that it readied for use by another player. In some embodiments, the PGD B24 may be deactivated by turning its power off. In some embodiments, a "logout" interface or option may be provided which causes the PGD B24 to return to a default state seeking the login of a player or user.

The PGD B24 may be used by a game service operator. Several examples of a method of such use are detailed below in conjunction with FIGS. 8 and 9.

When a game service representative contacts a game player seeking a game service in the game playing area B70 (see FIG. 8), the game service representative uses an appropriate game service interface on the display screen of the PGD B24, as described with reference to FIG. 10, to provide the game service requested by the game player. For example, when a game player requests an EZ pay ticket validation, the game service representative brings the EZ pay ticket validation interface onto the display screen of the PGD B24 using menus available on the display screen B102. Then, the game service representative scans the EZ pay ticket using a ticket reader connected to the PGD B24 to obtain unique ticket information. Next, the PGD B24 sends an EZ pay ticket validation request using the wire-less communication interface to the EZ pay server B26.

In various embodiments, the ticket validation request is composed of one or more information packets compatible with the wire-less communication standard being employed. Using a wireless link B72, the one or more information packets containing the ticket validation request are sent to the transceiver B62 connected to the EZ pay server. The transceiver B62 is designed to receive and send messages from the one or more PGDs B24 in the game playing area B70 in a communication format used by the PGDs. Depending on the location of the PGD B24 in the game playing area B70, the communication path for the information packets to and from the PGD B24 may be through one or more wire-less communication relays including B58 and B60. For example, when the PGD B24 is located near gaming machine B22*a*, the communication path for a message from the PGD B24 to the EZ pay server B26 may be from the PGD B24 to the relay B60, from the relay B60 to the relay B58, from the relay B58 to the transceiver B62 and from the transceiver B62 to the EZ pay server B26. As the location of the PGD B24 changes in the game playing area B70, the communication path between the PGD B24 and the EZ pay server B26 may change.

After receiving an EZ pay ticket validation reply from the EZ pay server B26, the EZ pay ticket may be validated using an appropriate display screen on the PGD B24. After cashing out the ticket, the game service representative may send a confirmation of the transaction to the EZ pay server B26 using the PGD B24. The transaction history for the PGD B24 may be stored on the PGD B24 as well as the EZ pay server B26. Next, a receipt for the transaction may be printed out. The receipt may be generated from a portable printer carried by the game server representative ad connected to the PGD B24 in some manner or the receipt may be generated from a printer B56 at a fixed location.

After providing a number of game services comprising a number of game service transactions to different game players in the game playing area B70 using the PGD B24, a game service representative may log-off of the PGD B24 and return it to location for secure storage. For example, at the end of a shift, the game service representative may check the PGD B24 at some of the locations, the device is unassigned to the particular game service representative and then may be assigned to another game service representative. However, before the PGD B24 is assigned to another game service representative, the transaction history stored on the PGD B24 may be reconciled with a separate transaction history stored on a transaction server such as the EZ pay server B26.

The assigning and unassigning of the PGD B24 to a game service representative and the transaction reconciliation are performed for security and auditing purposes. Another security measure which may be used on the PGD B24 is a fixed connection time between the PGD B24 and a transaction server. For example, after the PGD B24 has been assigned to a game service representative and the game service representative has logged on the PGD B24, the PGD B24 may establish a connection with one or more transaction servers including the EZ pay server B26, a server B28, a server B30, or a server B32. The connection between a transaction server and the PGD B24 allows the PGD B24 to send information to the transaction server and receive information from the transaction server. The length of this connection may be fixed such that after a certain amount of time the connection between the PGD B24 and the transaction server is automatically terminated. To reconnect to the transaction server, the login and registration process must be repeated on the PGD B24.

A transaction server may provide one or more game service transactions. However, the PGD B24 may connect with multiple transaction servers to obtain different game service transactions. For example, server B30 may be a prize transaction server allowing prize service transactions and server B415 may be a food transaction server allowing food service transactions. When a game service representative receives a prize service request from a game player, the PGD B24 may be used to contact the prize transaction server B30 using a wire-less communication link between the PGD B24 and a transceiver B64 connected to the prize transaction server B30. Similarly, when a game service representative receives a food service request from a game player, the PGD B24 may be used to contact the food transaction server B32 using a wire-less communication link between the PGD B24 and a transceiver B66 connected to the food transaction server B32.

The different transaction servers including the servers B26, B28, B30, B32 may be on separate networks or linked in some manner. For example, server B32 is connected to network B74, server B26 is connected to network B38, server B30 is connected to network B76, and server B28 is connected to network B78. In this embodiment, a network link B80 exists between network B76 and network B38. Thus, server B26 may communicate with server B30 via the network link B80. A communication link between different servers may allow the servers to share game service transaction information and allow different communication paths between the PGDs and the transaction servers. Likewise, a network link B82 exists between network B78 and network B38, permitting the game server to communicate with the EZ pay server B26.

Figure 12:
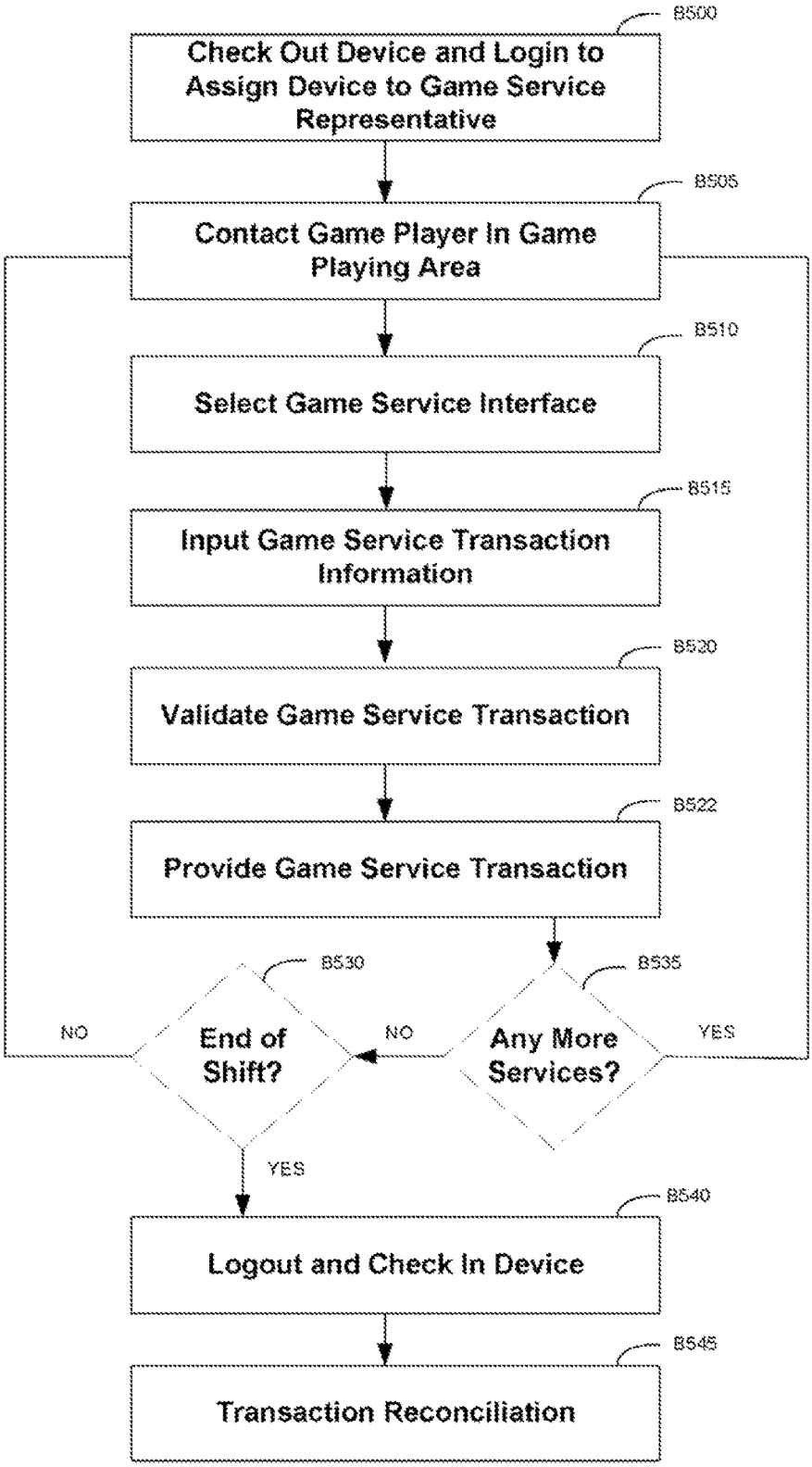
FIG. 12 is a flow diagram of a method of use of the portable gaming device by a gaming service operator, according to some embodiments.

FIG. 12 is a flow chart depicting a method for providing a game service using a hand-held device. In step B500, a game service representative receives the PGD B24 and logs in to the device to assign the device. The check out process and assign process are for security and auditing purposes. In a step B505, the game service representative contacts a game player in the game playing area requesting a game service of some type. In a step B510, the game service representative selects an appropriate interface on the PGD B24 using menus on the display screen B102 of the PGD that allow the game service representative to provide a requested game service. In a step B515, the game service representative inputs game service transaction information required to perform a game service transaction. For example, to validate an award ticket, the game service representative may read information from the ticket using a ticket reader. As another example, to provide a food service including dinner reservation, the game service representative may enter a game player's name to make the reservation.

In a step B520, the transaction information obtained in step B515 is validated as required. For example, when a player attempts to cash out an award ticket, the information from the award is validated to ensure the ticket is both genuine (e.g. the ticket may be counterfeit) and has not already been validated. The validation process requires a number of transfers of information packets between the PGD B24 and the transaction server. The details of the validation process for an award ticket validation are described with reference to FIG. 13. When the transaction information is valid, in a step B522, a game service transaction is provided. For example, a room reservation may be made for a player requesting an accommodation service. A confirmation of the game service transaction may be sent to the transaction server for transaction reconciliation in a step B545. In one or more embodiments, the method may include the step of generating a receipt regarding the game service transaction.

In a step B535, after providing the service, a game player may request another game service. When a game player requests an additional game service, the game service representative returns to step B510 and selects an appropriate interface for the game service. When a game player does not request an additional service and it is not the end of a shift, in a step B530, the game service representative returns to step B505 and contacts a new game player. In a step B540, when a shift has ended, the game service representative logs out of the PGD B24 and checks the device at a secure location so that the PGD may be assigned to a different game service representative. In step B545, before the PGD B24 is assigned to a different game service representative, a transaction history reconciliation is performed to ensure that the transaction history stored on the PGD is consistent with the transactions previously confirmed with a transaction server during the game service representatives shift. The transaction history on the PGD B24 may be stored on a removable memory storage device on the PGD. Thus, the memory may be removed from the device for transaction reconciliation and replaced with a new memory. Thus, the device with the new memory may be assigned to a new game service representative while the transaction history from the previous game service representative assigned to the device is reconciled.

Figure 13:
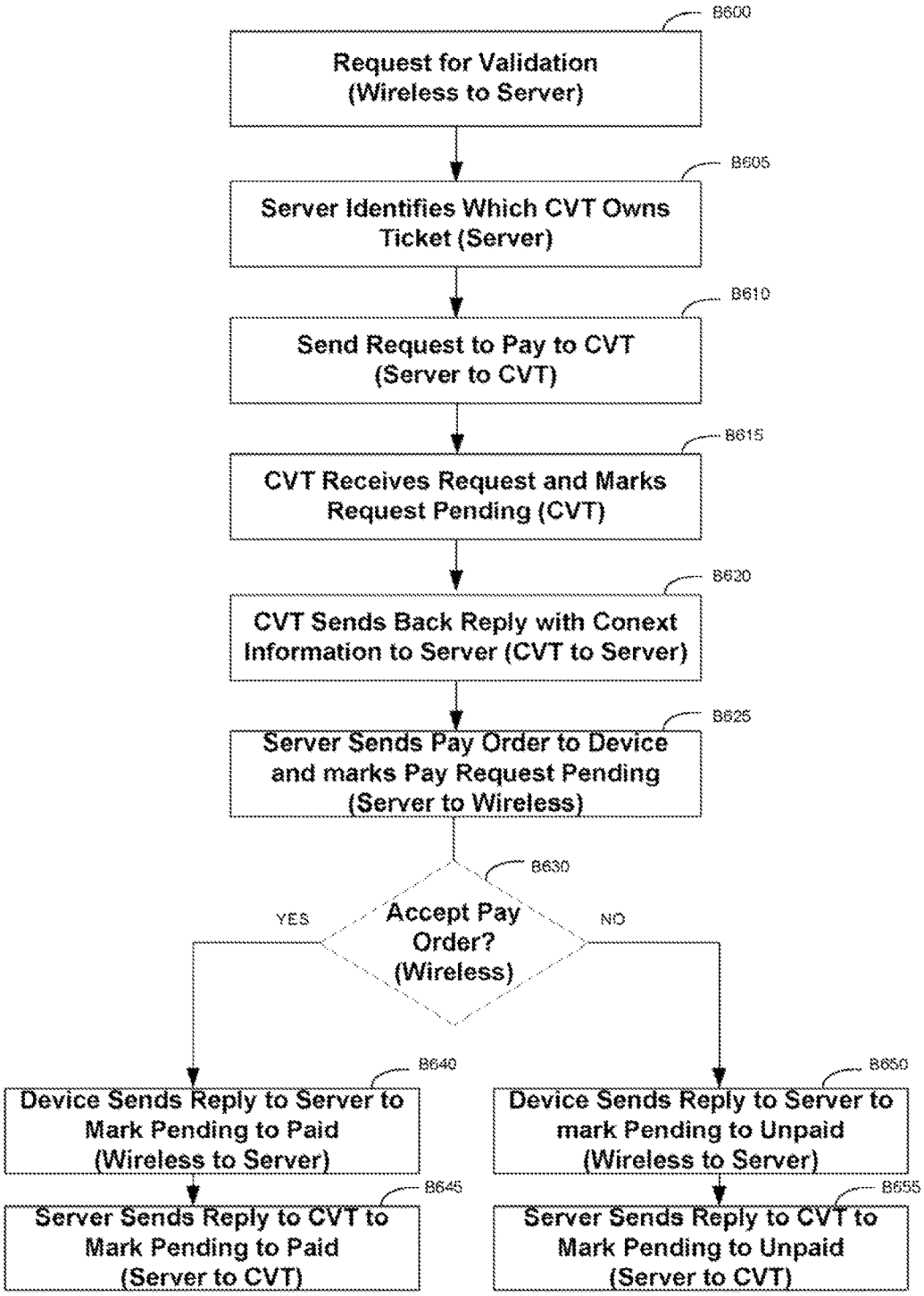
FIG. 13 is a flow diagram of a method of use of the portable gaming device according to some embodiments.

FIG. 13 is a flow chart depicting a method for validating information for providing a personal game service. In the embodiment shown in the figure, a ticket is validated in a manner consistent with an EZ pay ticket system. The EZ pay ticket is usually used for award tickets. However, the system may be adapted to provide tickets for other services include food services, prize services or accommodation services. In a step B600, a request for game service transaction information read from a ticket is sent via a wire-less communication interface on the PGD B24 to the appropriate transaction server as described with reference to FIG. 8. In a step B605, the server identifies which clerk validation ticket (CVT) B34,B36 owns the ticket. When a CVT owns a ticket, the CVT has stored information regarding the status of a particular ticket issued from a gaming machine connected to the CVT B34,B36. In a step B610, the server sends a request to pay the ticket to the CVT identified as the owner of the ticket. Typically, the pay request indicated a service on the ticket has been requested. For a cash ticket, a pay request means a request to cash out the ticket has been made. For a free meal, a pay request means a request to obtain the meal has been made. In a step B615, the CVT receives the pay request for the ticket and marks the ticket pending. While the ticket is pending, any attempts to validate a ticket with similar information is blocked by the CVT.

In a step B620, the CVT B34,B36 sends back a reply with context information to the server. As an example, the context information may be the time and place when the ticket was issued. The information from the CVT to the server may be sent as one or more data packets according to a communication standard shared by the CVT and server. In a step B625, after receiving the validation reply from the CVT, the server marks the pay request pending and sends a pay order to the PGD B24. While the pay request is pending, the server will not allow another ticket with the same information as the ticket with the pay request pending to be validated.

In a step B630, the game service representative may choose to accept or reject the pay order form the server. When the game service representative accepts the pay order from the server, in a step B640, the PGD B24 sends a reply to the transaction server confirming that the transaction has been performed. The transaction server marks the request paid which prevents another ticket with identical information from being validated. In a step B645, the server sends a confirmation to the CVT which allows the CVT to mark the request from pending to paid. When the game service representative rejects the pay order from the server, in a step B650, the PGD B24 sends a reply to the server to mark the pay request from pending to unpaid. When the ticket is marked unpaid, it may be validated by another PGD B24 or other validation device. In a step B655, the server sends the reply to the CVT to mark the pay request from pending to unpaid which allows the ticket to be validated.

In one or more embodiments of the invention, a ticket may be used to provide credit/value for establishing entitlement to a service or a good, such as the right to play a game or obtain food. The PGD B24 may include a card reader B140. In such an arrangement, a user of the PGD B24 may use a credit card or other magnetic stripe type card for providing credit/value. In various embodiments, the PGD B24 may include one or more other types of devices for obtaining/receiving information, such as a smart card reader.

In such arrangements, the PGD B24 device may read information from the credit card, smart card or other device. These cards may comprise the well known credit or debit cards. This information may be used to provide the credit/value. In the example of a credit card, the user's account information may be read from the card and transmitted from the PGD B24 to the controller B42. Credit card/credit validation information may be associated with a credit card server (not shown). This credit card server may be associated with a bank or other entity remote from the casino or place of use of the PGD B24 and the controller B42. A communication link may be provided between the controller B42 and remote server for sending credit card information there over.

In some embodiments, when a player utilizes a smart card or credit card the amount of associated credit or value may be transmitted to the EZ Pay server B26, and then the credited amount may be treated in exactly the same manner as if the credit/value had been provided by a ticket. When a player wishes to cash out, the EZ Pay server B26 has a record of the original amount credited and the amounts of any awards, losses or payments, and may then issue the player a ticket representing the users total credit.

In accordance with the invention, a gaming system is provided which includes one or more portable gaming devices. The portable gaming devices permit a player to play one or more games at a variety of locations, such as a hotel room, restaurant or other location. These locations may be remote from traditional gaming areas where free-standing, generally stationary gaming machines are located.

In one or more embodiments, a player may use the portable gaming device to not only play games, but obtain other products and services. In addition, in one or more embodiments, the portable gaming device may be used by game service representatives to perform a variety of functions and provide a variety of services to a player.

It should be understood that the foregoing descriptions encompass but some of the implementation technologies that may be used, according to various embodiments. Other technologies may be used and are contemplated, according to various embodiments. Various embodiments may be performed using any suitable technology, either a technology currently existing or a technology which has yet to be developed.

Wireless Interactive System

According to various embodiments, a wireless interactive gaming system includes one or more wireless gaming devices, a receiver, and a central processor. The wireless interactive gaming system may also include a terminal which is in communication with the central processor.

In a gaming environment that employs a wireless interactive gaming system, a player receives a wireless gaming device from a game official who represents a gaming establishment or the "house". The wireless gaming device is capable of receiving wager information as commands entered by the player and transmitting the received wager information along with identification information to the receiver by wireless transmission.

The wireless interactive gaming system may support a number of wireless gaming devices within one gaming establishment. The range for the wireless transmission from a wireless gaming device may be up to 100 feet.

According to various embodiments, a player inputs information into a wireless gaming device, e.g., by pressing push buttons or keys on the device. The wireless gaming device may include any number, e.g. from 5 to 20, of buttons in a keypad-type arrangement. Buttons may be marked with the digits 0 through 9 and may also include a "$" (dollar sign) key and an "enter" key, so that the player may easily input wager information. In various embodiments, the wireless gaming device includes at least eight player selection buttons (e.g., digits) and at least five special function buttons, (e.g., to request the player's balance). In various embodiments, the player can input some or all of the wager information into the wireless gaming device by swiping a smart card, which contains a microprocessor chip or a magnetic stripe with encoded information, through a smart card reader on the wireless gaming device.

In various embodiments, the wireless gaming device may include an identifier. The identifier may be, e.g., a series of alphanumeric characters, a bar code, or a magnetic stripe affixed to the device. In various embodiments, the identifier may be a digital code stored in a secure memory, e.g., an electronically erasable programmable read only memory (EEPROM). The identifier may thus be readable directly by the game official if it is a series of alphanumeric characters, or it may be read automatically by a bar code reader or a magnetic stripe reader. In various embodiments, the identifier may be programmed in EEPROM or read from EEPROM through an RS-232 port, which may be directly connected to encoder and decoder circuitry in a terminal.

A wireless gaming device may store an encryption key. The encryption key may be used to encrypt information that is transmitted to the receiver from the device. Encryption of the information transmitted to the receiver may limits tampering with the wireless gaming device and may prevent unauthorized or counterfeit devices from being used with the system.

In various embodiments, the encryption key may be stored in the EEPROM. The EEPROM may have the advantage of being a memory device which is difficult to access if the appropriate encoding circuitry is not available. Thus, it is contemplated that the encoding circuitry that downloads the encryption key into the device may be securely held by the game official.

Alternately, the encryption key stored in the EEPROM may be updated and changed for each player who receives a wireless gaming device by directly connecting the device to encoding and decoding circuitry in the terminal through a port at the time the wireless gaming device is delivered to the player. Moreover, other digital information related to the game being played may be downloaded from the terminal to the EEPROM through a direct connection with the wireless gaming device.

In various embodiments, a microprocessor controls the operation of a wireless gaming device. The microprocessor receives digital wager information entered by the player using buttons or keys of the wireless gaming device. The microprocessor stores an identification code associated with the wireless gaming device that is a digital equivalent of the identifier of the wireless gaming device. The microprocessor also executes software applications for encrypting the identification code and the player's wager information for transmission to the receiver. The software contains an algorithm that encrypts a data packet including the identification code and wager information using the encryption key.

In various embodiments, a wireless gaming device has a unique address, i.e. identification code, for communications with the receiver and stores a player identification that is programmed into the device by the central processor. The wireless gaming device may include a wager amount register, which is maintained and updated using the keys on the device. The value stored in the wager amount register may be included in transmissions from the device to the central processor. The value of the wager amount register may default to a predetermined value, e.g. $1, when the device is initialized, and can be further adjusted by the player. The wireless gaming device may also include an account balance register, which is maintained in the device and is updated by the central processor periodically. The value of the account balance register should default to $0 when the device is initialized.

The wireless gaming device may include player function keys. The player function keys may be used to accomplish the following functions:

1. Transmit a message to the receiver;
2. Request account balance information;
3. Adjust the state of the device;
4. Affect the data to be sent in the next transmitted message;
5. Increment the wager amount register by a predetermined amount, e.g., $10, $5 or $1;
6. Reset the wager amount register to the default value, e.g., $1.

The firmware of the wireless gaming device may only allow for one press of buttons or keys every 100 ms. In various embodiments, key presses are not queued; thus, when a key press message is queued to be sent, no other player input is accepted until the queued message has been sent.

The wireless gaming device may include a transmitter. The transmitter may receive encrypted digital information from the microprocessor and convert it to a signal for wireless transmission to the receiver. The transmitter transmits signals wirelessly, e.g., using radio frequency signals or infrared signals. Communications between the receiver and the wireless gaming device may be asynchronous at 2400 bits per second.

The wireless gaming device may include an identifying circuit that drives the transmitter to periodically send an identification signal to the receiver. The use of the identifying circuit permits the receiver and the central processor to be assured that the wireless gaming device is still active, functioning and present in the gaming establishment. Thus, if the wireless gaming device were removed from the gaming establishment, the receiver and central processor would no longer receive and detect the periodic identification signal sent by the identifying circuit and the transmitter, and the game official may be alerted that the wireless gaming device has been removed from the gaming establishment.

The wireless gaming device may contain a real-time clock that permits the microprocessor to monitor the current time and date. The clock may consist of a timing circuit. The microprocessor can use the time and date information obtained from clock to perform calculations and other functions based on the current time and date.

The wireless gaming device may also include a tag, such as an electronic or magnetic component, which activates an alarm when passed through a sensing apparatus located at the entrance and/or exit of the gaming establishment. Activation of the alarm by passing the wireless gaming device with the tag through the sensing apparatus notifies the game official of an attempted removal of the wireless gaming device from the gaming establishment.

The wireless gaming device may be powered by a battery source contained within the device. A portable power source such as battery source permits extended cordless operation of the wireless gaming device throughout a gaming environment. The battery source may be part of a removable, rechargeable battery pack that allows the device to be recharged when it is not in use.

In some embodiments, the wireless gaming device displays information such as game information on a device display, such as a liquid crystal display (LCD) with a back-light. The LCD can be used to display the values stored in the wager amount register and in the account balance register. The wireless gaming device may include a display receiver which receives digital information transmitted from the receiver or from the central processor.

The device may also include a bicolor light emitting diode (LED). The bicolor LED is capable of displaying at least two colors, e.g., red and green. The green light may flash each time the wireless gaming device sends a transmission to the receiver, for a period of time to ensure that it is visible to the player. The red light may illuminate when a key is pressed on the wireless gaming device, and remain lit until the transmission is received by the receiver; no additional key entry will be enabled when the red light is lit. The wireless gaming device may also include additional light emitting diodes, for example to indicate when the account balance register is being updated and the balance information is being displayed on the LCD.

The receiver is capable of receiving signals transmitted from the transmitter in the wireless gaming device. The receiver contains a decoder, which converts the received signals, e.g., into digital information. This digital information contains at least the identification code of the wireless gaming device and the player's wager information. The receiver sends the digital information obtained by the decoder to the central processor. Communications between the central processor and the receiver may be by an RS-232 electrical interface data serial communications link, with communications being asynchronous at either 9600 or 19,200 bytes per second, in various embodiments.

The receiver may receive signals from many wireless devices either simultaneously or in rapid succession, e.g., using multiplexing techniques, so that many players can place wagers using their wireless gaming devices during a short time interval. The receiver differentiates signals received from the various devices by the identification codes which are present in the signals received by the receiver.

The central processor receives the identification code of a wireless gaming device and the players wager information from the receiver. The central processor also decrypts this information using the encryption key. The central processor is capable of receiving data from multiple wireless gaming devices in an apparently simultaneous manner.

In various embodiments, an account for the player is stored in a database of the central processor. The database stores the monetary value of the balance of the account associated with the identifier of the wireless gaming device.

The central processor manages the players account in the database based on signals received from the players wireless gaming device as the player places wagers and when prizes are awarded during play of the game. The central processor subtracts money from the players account balance when the player places a wager. The players account balance may be automatically increased by the central processor when the player wins a game on which he has placed a wager.

The central processor also stores and is capable of executing software applications containing algorithms to calculate players' account balances, wagers, and winnings. The central processor should be able to execute all of the algorithms which define the actions performed on the players' accounts during the progress of the game, as wagers are entered, as winnings paid out, and when funds are added to the players' accounts.

Algorithms in the software in the central processor may also calculate odds and payouts for certain games, such as lottery-type games, during play of the game. The odds and payouts at a particular point in time may depend on the characteristics of the game being conducted by the central processor, and may change as the game progresses. These algorithms may be executed by the central processor to provide exact calculations of the odds of specific game events occurring and the associated prizes for a players correctly predicting the occurrence of one of those events. The algorithms may be executed continuously, so that real-time odds and payout can be calculated as the game progresses.

The central processor may perform various actions on players' accounts, resulting in various impacts on the accounts. For example, if the player wins a game, his account is credited for the payout based on his wager. If the player places a wager using the wireless gaming device, his account is debited by the amount of the wager. If the game official receives additional funds from the player, the balance of the players account is credited by the amount of the funds. If the game official closes the players account and disburses funds to him, the balance of the players account is debited by the amount disbursed.

The central processor may be located in the gaming establishment that houses the receiver. In various embodiments, the central processor may be located remotely from the receiver, communicating with the receiver via electronic digital telephone communication or wireless transmission, such as a serial communication link. Additionally, the central processor may perform a multitude of functions for various receivers in a variety of gaming environments.

In some embodiments, communication among the central processor, the receiver, and the wireless gaming device involves a polling scheme. Polling enables many wireless gaming devices to communicate with a receiver without interference between them. Such a polling scheme may include the transmission of digital signals in the form of strings of hexadecimal characters. Preferably, all communications between the central processor, the receiver and the wireless gaming device are encrypted.

In such a polling scheme, hexadecimal characters may be reserved for specific control protocols. For example, an attention character is a header character used to begin all transmissions from the central processor to the receiver, and serves to delineate messages and synchronize the receipt of messages in the receiver. The same function is implied when the attention character follows in response to a message transmission. An acknowledgement character is another header character which provides acknowledgement to the transmitting device that the previous message's data has been received and verified. The acknowledgement character can also function as an attention character to begin a subsequent message. An end of message character is used to indicate the end of a transmission. Also, a complement next byte character allows for use of reserved protocol characters within a normal transmission message by avoiding a false control signal when a message data byte matches one of the control characters. When a message byte that needs to be sent matches one of the protocol control characters, the complement next byte character is sent, followed by the one's complement of the matching message byte.

Verification of received data may be accomplished using a single byte checksum of the message information. This checksum may be the ones complement of the sum of the original message data, not including the header character. If the checksum results in a value equal to one of the protocol control characters, it will be treated in accordance with the function of the complement next byte character.

In the polling scheme described above, there are three different modes of communication over the link between the central processor and the receiver. First, the central processor may send messages intended for the receiver. Second, the central processor may send messages intended for the wireless gaming device. Third, the wireless gaming device may send messages intended for the central processor. In various embodiments, messages sent by the central processor may be in the form of a character string formatted with a header character, followed by the identification code of the intended device, the command or message, an end of message character, and a checksum character. Messages received by the receiver or the wireless gaming device may be acknowledged by transmission of an acknowledgement character, but the central processor need not acknowledge messages sent from the wireless gaming devices. Messages sent by the central processor to be received by the wireless gaming device may be broadcast to all of the wireless gaming devices. A device address may be reserved as a broadcast address for all of the wireless gaming devices, and all devices will receive messages sent to this address; in this case, no acknowledgement need be returned from any of the wireless gaming devices.

Each command or message may begin with a command code to signal how the information contained in the message is to be used. Command codes for messages sent by the central processor to the receiver and the wireless gaming device include the following:

1. Send a device address list to the receiver;
2. Send account balance information to the addressed device;
3. Send command to disable the addressed device;
4. Send command to enable the addressed device.

In various embodiments, messages sent between the receiver and the wireless gaming device may be in the form of a character string formatted with a header character, followed by the identification code of the intended device, the current wager amount, the request, command or data, an end of message character, and a checksum character. Command codes for requests, commands and data sent between the receiver and the wireless gaming device include the following:

1. Read user identification;
2. Read device address;
3. Read balance register;
4. Read wager amount register;
5. Provide device status;
6. Write user identification;
7. Write device address;
8. Write balance register;
9. Write wager amount;
10. Perform self test.

These command codes may be used to program the device addresses and user identification information into the wireless gaming devices, as well as to initialize the device to the default state, i.e., the players account balance of $0. The account balance register and the user identification may each comprise two characters, the least significant byte and the most significant byte, allowing for the use a greater range of numbers for these values.

Various embodiments include methods by which the central processor communicates with a wireless gaming device. The central processor transmits a string of hexadecimal characters, including, e.g., a header character, followed by the device's identification code, followed by a request, command or data, followed by an end of message character, followed by a checksum character. After the central processor transmits the character string, the wireless gaming device receives the string, recognizes its identification code, and executes any instructions in the string. When the central processor sends an instruction to all wireless gaming devices simultaneously, all currently active devices receive and execute the instruction. The wireless gaming device does not send an acknowledgement message to the central processor, although the receiver may receive a transmission from the wireless gaming device that the instruction was received properly. The central processor also communicates with the receiver in a similar manner, except that the receiver may send an acknowledgement message to the central processor which includes the acknowledgement control protocol character.

Similarly, the wireless gaming device communicates with the receiver and the central processor using, e.g., hexadecimal character strings. The receiver regularly and periodically polls the active wireless gaming device for information requests or wagering requests. If the player has entered a request into the wireless gaming device since the last time the wireless gaming device was polled, then the players request will be transmitted to the receiver.

Various embodiments include methods by which the wireless gaming device receives and relays player requests to the central processor. First, the player enters a request into the wireless gaming device using buttons or keys. The player then presses a button labeled, e.g., "enter" or "send," instructing the wireless gaming device to send the request the next time the receiver polls the wireless gaming device. When this button has been pressed, the red light of the bicolor LED is illuminated, thereby informing the player that the request is waiting to be sent. The request is converted into a hexadecimal character string, including, e.g., a header character, an identification code (or, alternatively, a separate identification string reserved for a specific player), the current wager amount, the players request (e.g., to change the wager amount or to send a balance update), an end of message character, and a checksum character. The next time the receiver polls the device, the transmitter of the device transmits the character string to the receiver. When the wireless gaming device is polled by the receiver, the green light of bicolor LED flashes, informing the player that the request has been transmitted. The receiver receives the request string, and transmits the string to the central processor. The central processor then acts on the player's request.

Using the terminal, the game official may process wagering transactions and distribute wireless gaming devices. In various embodiments, the terminal may include a bar code reader and/or a magnetic stripe reader for rapid entry of the identifier of a wireless gaming device prior to delivering the wireless gaming device to the player. Reading devices provide information in the form of digital data to the terminal. The terminal includes a keyboard by which the game official can manually enter data to be sent to the central processor. Using either reading device, the keyboard, or a combination of these, the game official communicates with the central processor to establish a player's account, increase the balance of the account when the player tenders funds to the game official, and decrease the balance of the account when the player seeks to collect the cash value of his account balance.

The player establishes a balance of the account associated with his wireless gaming device, identified by an identifier, when he receives the wireless gaming device from the game official. The player may increase the monetary value of the balance of the account by paying additional funds, in the form of cash or credit, to the game official, who accesses the account stored in the central processor through the terminal to increase the balance of the account.

The wireless gaming device is returned to the game official after the player has played one or more games. The readers may be used to read the identifier for closing out the player's account stored in the database of the central processor. The terminal includes a terminal display which notifies the game official of the balance of the player's account, so that the player may be paid the cash value of the remaining balance of his account.

In some embodiments, an account status display device is located in the gaming establishment to display players' account information. In various embodiments, the display device may be, e.g., a liquid crystal display or a cathode ray tube display. The display device is controlled by the central processor, which sends information to the display device for display to the players.

A player may look at the display device to confirm that wagers transmitted from the wireless gaming device were received by the receiver and sent to the central processor, to determine the monetary balance of the player's account, and to verify that the player's winnings have been credited to his account. The display device displays key information necessary for a player to participate in a game. The information displayed for each player may include the account number, the player's account balance, the player's last wager, and the player's last prize award or win.

The display device is divided into specific areas, e.g., a display area, each area showing the account information for one player. The size of the display area may be determined by the size of the display device and the number of players who possess wireless display devices. It is contemplated that only active accounts will be displayed on the display device. If additional display devices are required to display the information concerning a large number of accounts, the central processor may be configured to drive multiple similar display devices.

The display device may also be used to display the odds and payouts for game wagers. Alternately, a separate display device driven by the central processor may be used to display the odds and payout information. Further, the odds and payouts may be displayed on the device display 21.

Procedures for using the wireless interactive gaming system, according to some embodiments, are now described. In some embodiments, a player tenders money in the form of cash or credit, e.g., $100, to a game official in the gaming establishment to establish an account. The game official chooses a wireless gaming device and uses, e.g., the bar code reader on the terminal to enter the identifier of the wireless gaming device into the terminal. The game official also inputs the amount of money tendered, i.e. $100, into the terminal via keyboard. The game official hands the wireless gaming device to the player and tells the player that his account is, e.g., Account No. 12. Alternately, the player may identify his account number directly from the identifier on the wireless gaming device. The information entered by the game official into the terminal is sent to the central processor, which establishes an account record for the player in the database.

For this example, the central processor may be conducting a racing game in which players choose a winning racing element on which to place a wager for the next racing game to be displayed in the gaming establishment. To place a wager, the player presses buttons on the wireless gaming device.

In some embodiments, the player first presses the button that corresponds to the number assigned to the racing element that he chooses, e.g., "3", and then the wager amount, e.g., "$" and "5", for a $5 wager. The player then presses the "enter" key to transmit his wager to the central processor.

In an alternate embodiment, the game may be simplified so that all wagers are placed for a fixed amount, e.g., $1, by pressing a single button on the wireless gaming device. By pressing the button that corresponds to the number assigned to the chosen racing element, e.g., "3", the player places a $1 bet on racing element number 3. The player can then place a larger wager on racing element number 3, by pressing the "3" button the number of times corresponding to the number of $1 bets he desires to make, e.g., by pressing "3" five times to wager $5 on racing element number 3.

Each time the player enters a wager, the wireless gaming device forms a data packet containing the player's wager information and the identification code of the wireless gaming device. The data packet is encrypted and transmitted by the transmitter via wireless communication.

The decoder in the receiver receives the encrypted data packet transmitted by the transmitter. The encrypted data packet is sent to the central processor, where it is decrypted. The central processor uses the information it has obtained to update the player's account in the database by subtracting the wagered amount from the player's account balance and registers the player's wager on the game.

After the game has been played, the central processor awards prizes to winning players based on the wagers they have made and the odds associated with the winning outcome of the game. If the player in possession of the wireless gaming device is a winner, the central computer updates the player's account in the database by adding the monetary amount of the prize to the player's account balance. Otherwise, the player's account remains unchanged.

When the player has finished playing games in the gaming establishment, he returns the wireless gaming device to the game official. The game official again inputs the identifier of the wireless gaming device into the terminal, e.g., by using the bar code reader of the terminal. The terminal accesses the player's account information stored in the database of the central processor to obtain the player's remaining account balance. The terminal display displays the player's remaining account balance to the game official, who then tenders the monetary value of that amount to the player. The account is closed, and the transaction is recorded in the central processor.

It should be understood that the foregoing descriptions encompass but some of the implementation technologies that may be used, according to various embodiments. Other technologies may be used and are contemplated, according to various embodiments. Various embodiments may be performed using any suitable technology, either a technology currently existing or a technology which has yet to be developed.

Hand-Held Wireless Game Player

Various embodiments include a hand-held wireless game player for playing a game of chance. The hand-held wireless game player may be generally characterized as including: 1) a wire-less communication interface; 2) a display screen; 3) one or more input mechanisms; and 4) a microprocessor configured i) to present the game of chance on the display screen using operating instructions received via the wireless communication interface from a master gaming controller located on a gaming machine and ii) to send information from input signals generated from the one or more input mechanisms to the master gaming controller via the wireless communication interface. The wireless game player may be played in a plurality of venue locations physically separate from the location of the gaming machine where the plurality of venue locations are selected from the group consisting of a keno parlor, a bingo parlor, a restaurant, a sports book, a bar, a hotel, a pool area and a casino floor area. The game of chance played on the wireless game player may be selected from the group consisting of slot games, poker, pachinko, multiple hand poker games, pai-gow poker, black jack, keno, bingo, roulette, craps and a card game. Other games are also contemplated, in various embodiments.

In various embodiments, the wireless communication interface may use a wireless communication protocol selected from the group consisting of IEEE 802.11a, IEEE 802.11b, IEEE 802.11x, hyperlan/2, Bluetooth, and HomeRF. The wireless game player may also comprise a wire network interface for connecting the wireless game player to a wire network access point. In addition, the wireless game player may also comprise a peripheral interface for connecting to a peripheral gaming device where the peripheral interface is a serial interface, a parallel interface, a USB interface, a FireWire interface, an IEEE 1394 interface. The peripheral gaming device may be a printer, a card reader, a hard drive and a CD-DVD drive.

In various embodiments, the one or more inputs mechanisms on the wireless game player may be selected from the group consisting of a touch screen, an input switch, an input button and biometric input device where the biometric input device may be a finger print reader. The wireless game player may also include a detachable memory interface designed to receive a detachable memory where the detachable memory unit stores graphical programs for one or more games of chance played on the wireless game player. The wireless game player may also comprise one or more of the following: 1) an audio output interface for receiving a head phone jack, 2) an antenna, 3) a sound projection device, 4) a battery, 5) a power interface for supplying power to the wireless game player from an external power source and for charging the battery from the external power source, 6) a memory unit where the memory unit may store graphical programs for one or more games of chance played on the wireless game player, 7) an electronic key interface designed to receive an electronic key, and 8) a video graphics card for rendering images on the display screen where the video graphics card may be used to render 2-D graphics and 3-D graphics.

It should be understood that the foregoing descriptions encompass but some of the implementation technologies that may be used, according to various embodiments. Other technologies may be used and are contemplated, according to various embodiments. Various embodiments may be performed using any suitable technology, either a technology currently existing or a technology which has yet to be developed.

The following sections I-X provide a guide to interpreting the present application.

I. DETERMINING

The term "determining" and grammatical variants thereof (e.g., to determine a price, determining a value, determine an object which meets a certain criterion) is used in an extremely broad sense. The term "determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing, and the like.

The term "determining" does not imply certainty or absolute precision, and therefore "determining" can include estimating, extrapolating, predicting, guessing and the like.

The term "determining" does not imply that mathematical processing must be performed, and does not imply that numerical methods must be used, and does not imply that an algorithm or process is used.

The term "determining" does not imply that any particular device must be used. For example, a computer need not necessarily perform the determining.

II. FORMS OF SENTENCES

Where a limitation of a first claim would cover one of a feature as well as more than one of a feature (e.g., a limitation such as "at least one widget" covers one widget as well as more than one widget), and where in a second claim that depends on the first claim, the second claim uses a definite article the to refer to the limitation (e.g., "the widget"), this does not imply that the first claim covers only one of the feature, and this does not imply that the second claim covers only one of the feature (e.g., "the widget" can cover both one widget and more than one widget).

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device, article or other product is described herein, more than one device/article (whether or not they cooperate) may alternatively be used in place of the single device/article that is described. Accordingly, the functionality that is described as being possessed by a device may alternatively be possessed by more than one device/article (whether or not they cooperate).

Similarly, where more than one device, article or other product is described herein (whether or not they cooperate), a single device/article may alternatively be used in place of the more than one device or article that is described. For example, a plurality of computer-based devices may be substituted with a single computer-based device. Accordingly, the various functionality that is described as being possessed by more than one device or article may alternatively be possessed by a single device/article.

The functionality and/or the features of a single device that is described may be alternatively embodied by one or more other devices which are described but are not explicitly described as having such functionality/features. Thus, other embodiments need not include the described device itself, but rather can include the one or more other devices which would, in those other embodiments, have such functionality/features.

III. TERMS

The term "product" means any machine, manufacture and/or composition of matter, unless expressly specified otherwise.

The term "process" means any process, algorithm, method or the like, unless expressly specified otherwise.

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

The term "invention" and the like mean "the one or more inventions disclosed in this application", unless expressly specified otherwise.

The terms "an embodiment", "embodiment", "embodiments", "the embodiment", "the embodiments", "one or more embodiments", "some embodiments", "certain embodiments", "one embodiment", "another embodiment" and the like mean "one or more (but not all) embodiments of the disclosed invention(s)", unless expressly specified otherwise.

The term "variation" of an invention means an embodiment of the invention, unless expressly specified otherwise.

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and the mean "one or more", unless expressly specified otherwise.

The term "plurality" means two or more, unless expressly specified otherwise.

The term "herein" means "in the present application, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase "at least one of a widget, a car and a wheel" means either (i) a widget, (ii) a car, (iii) a wheel, (iv) a widget and a car, (v) a widget and a wheel, (vi) a car and a wheel, or (vii) a widget, a car and a wheel. The phrase "at least one of", when such phrase modifies a plurality of things does not mean "one of each of" the plurality of things.

Numerical terms such as "one", "two", etc. when used as cardinal numbers to indicate quantity of something (e.g., one widget, two widgets), mean the quantity indicated by that numerical term, but do not mean at least the quantity indicated by that numerical term. For example, the phrase "one widget" does not mean "at least one widget", and therefore the phrase "one widget" does not cover, e.g., two widgets.

The phrase "based on" does not mean "based only on", unless expressly specified otherwise. In other words, the phrase "based on" describes both "based only on" and "based at least on". The phrase "based at least on" is equivalent to the phrase "based at least in part on".

The term "represent" and like terms are not exclusive, unless expressly specified otherwise. For example, the term "represents" do not mean "represents only", unless expressly specified otherwise. In other words, the phrase "the data represents a credit card number" describes both "the data represents only a credit card number" and "the data represents a credit card number and the data also represents something else".

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

The term "e.g." and like terms mean "for example", and thus does not limit the term or phrase it explains. For example, in the sentence "the computer sends data (e.g., instructions, a data structure) over the Internet", the term "e.g." explains that "instructions" are an example of "data" that the computer may send over the Internet, and also explains that "a data structure" is an example of "data" that the computer may send over the Internet. However, both "instructions" and "a data structure" are merely examples of "data", and other things besides "instructions" and "a data structure" can be "data".

The term "respective" and like terms mean "taken individually". Thus if two or more things have "respective" characteristics, then each such thing has its own characteristic, and these characteristics can be different from each other but need not be. For example, the phrase "each of two machines has a respective function" means that the first such machine has a function and the second such machine has a function as well. The function of the first machine may or may not be the same as the function of the second machine.

The term "i.e." and like terms mean "that is", and thus limits the term or phrase it explains. For example, in the sentence "the computer sends data (i.e., instructions) over the Internet", the term "i.e." explains that "instructions" are the "data" that the computer sends over the Internet.

Any given numerical range shall include whole and fractions of numbers within the range. For example, the range "1 to 10" shall be interpreted to specifically include whole numbers between 1 and 10 (e.g., 1, 2, 3, 4, . . . 9) and non-whole numbers (e.g., 1.1, 1.2, . . . 1.9).

Where two or more terms or phrases are synonymous (e.g., because of an explicit statement that the terms or phrases are synonymous), instances of one such term/phrase does not mean instances of another such term/phrase must have a different meaning. For example, where a statement renders the meaning of "including" to be synonymous with "including but not limited to", the mere usage of the phrase "including but not limited to" does not mean that the term "including" means something other than "including but not limited to".

IV. DISCLOSED EXAMPLES AND TERMINOLOGY ARE NOT LIMITING

Neither the Title (set forth at the beginning of the first page of the present application) nor the Abstract (set forth at the end of the present application) is to be taken as limiting in any way as the scope of the disclosed invention(s). An Abstract has been included in this application merely because an Abstract of not more than 150 words is required under 37 C.F.R. § 1.72(b).

The title of the present application and headings of sections provided in the present application are for convenience only, and are not to be taken as limiting the disclosure in any way.

Numerous embodiments are described in the present application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

No embodiment of method steps or product elements described in the present application constitutes the invention claimed herein, or is essential to the invention claimed herein, or is coextensive with the invention claimed herein, except where it is either expressly stated to be so in this specification or expressly recited in a claim.

The preambles of the claims that follow recite purposes, benefits and possible uses of the claimed invention only and do not limit the claimed invention.

The present disclosure is not a literal description of all embodiments of the invention(s). Also, the present disclosure is not a listing of features of the invention(s) which must be present in all embodiments.

Devices that are described as in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for long period of time (e.g. weeks at a time). In addition, devices that are in communication with each other may communicate directly or indirectly through one or more intermediaries.

A description of an embodiment with several components or features does not imply that all or even any of such components/features are required. On the contrary, a variety of optional components are described to illustrate the wide variety of possible embodiments of the present invention(s). Unless otherwise specified explicitly, no component/feature is essential or required.

Although process steps, algorithms or the like may be described or claimed in a particular sequential order, such processes may be configured to work in different orders. In other words, any sequence or order of steps that may be explicitly described or claimed does not necessarily indicate a requirement that the steps be performed in that order. The steps of processes described herein may be performed in any order possible. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention(s), and does not imply that the illustrated process is preferred.

Although a process may be described as including a plurality of steps, that does not imply that all or any of the steps are preferred, essential or required. Various other embodiments within the scope of the described invention(s) include other processes that omit some or all of the described steps. Unless otherwise specified explicitly, no step is essential or required.

Although a process may be described singly or without reference to other products or methods, in an embodiment the process may interact with other products or methods. For example, such interaction may include linking one business model to another business model. Such interaction may be provided to enhance the flexibility or desirability of the process.

Although a product may be described as including a plurality of components, aspects, qualities, characteristics and/or features, that does not indicate that any or all of the plurality are preferred, essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

An enumerated list of items (which may or may not be numbered) does not imply that any or all of the items are equivalent to each other or readily substituted for each other.

All embodiments are illustrative, and do not imply that the invention or any embodiments were made or performed, as the case may be.

V. COMPUTING

It will be readily apparent to one of ordinary skill in the art that the various processes described herein may be implemented by, e.g., appropriately programmed general purpose computers, special purpose computers and computing devices. Typically a processor (e.g., one or more microprocessors, one or more microcontrollers, one or more digital signal processors) will receive instructions (e.g., from a memory or like device), and execute those instructions, thereby performing one or more processes defined by those instructions. Instructions may be embodied in, e.g., one or more computer programs, one or more scripts.

A "processor" means one or more microprocessors, central processing units (CPUs), computing devices, microcontrollers, digital signal processors, or like devices or any combination thereof, regardless of the architecture (e.g., chip-level multiprocessing/multi-core, RISC, CISC, Microprocessor without Interlocked Pipeline Stages, pipelining configuration, simultaneous multithreading).

Thus a description of a process is likewise a description of an apparatus for performing the process. The apparatus that performs the process can include, e.g., a processor and those input devices and output devices that are appropriate to perform the process.

Further, programs that implement such methods (as well as other types of data) may be stored and transmitted using a variety of media (e.g., computer readable media) in a number of manners. In some embodiments, hard-wired circuitry or custom hardware may be used in place of, or in combination with, some or all of the software instructions that can implement the processes of various embodiments. Thus, various combinations of hardware and software may be used instead of software only.

The term "computer-readable medium" refers to any medium, a plurality of the same, or a combination of different media, that participate in providing data (e.g., instructions, data structures) which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying data (e.g. sequences of instructions) to a processor. For example, data may be (i) delivered from RAM to a processor; (ii) carried over a wireless transmission medium; (iii) formatted and/or transmitted according to numerous formats, standards or protocols, such as Ethernet (or IEEE 802.3), SAP, ATP, Bluetooth, and TCP/IP, TDMA, CDMA, and 3G; and/or (iv) encrypted to ensure privacy or prevent fraud in any of a variety of ways well known in the art.

Thus a description of a process is likewise a description of a computer-readable medium storing a program for performing the process. The computer-readable medium can store (in any appropriate format) those program elements which are appropriate to perform the method.

Just as the description of various steps in a process does not indicate that all the described steps are required, embodiments of an apparatus include a computer/computing device operable to perform some (but not necessarily all) of the described process.

Likewise, just as the description of various steps in a process does not indicate that all the described steps are required, embodiments of a computer-readable medium storing a program or data structure include a computer-readable medium storing a program that, when executed, can cause a processor to perform some (but not necessarily all) of the described process.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models and/or distributed databases) could be used to store and manipulate the data types described herein. Likewise, object methods or behaviors of a database can be used to implement various processes, such as the described herein. In addition, the databases may, in a known manner, be stored locally or remotely from a device which accesses data in such a database.

Various embodiments can be configured to work in a network environment including a computer that is in communication (e.g., via a communications network) with one or more devices. The computer may communicate with the devices directly or indirectly, via any wired or wireless medium (e.g. the Internet, LAN, WAN or Ethernet, Token Ring, a telephone line, a cable line, a radio channel, an optical communications line, commercial on-line service providers, bulletin board systems, a satellite communications link, a combination of any of the above). Each of the devices may themselves comprise computers or other computing devices, such as those based on the Intel® Pentium® or Centrino™ processor, that are adapted to communicate with the computer. Any number and type of devices may be in communication with the computer.

In an embodiment, a server computer or centralized authority may not be necessary or desirable. For example, the present invention may, in an embodiment, be practiced on one or more devices without a central authority. In such an embodiment, any functions described herein as performed by the server computer or data described as stored on the server computer may instead be performed by or stored on one or more such devices.

Where a process is described, in an embodiment the process may operate without any user intervention. In another embodiment, the process includes some human intervention (e.g., a step is performed by or with the assistance of a human).

VI. CONTINUING APPLICATIONS

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application.

Applicants intend to file additional applications to pursue patents for subject matter that has been disclosed and enabled but not claimed in the present application.

VII. 35 U.S.C. § 112, PARAGRAPH 6

In a claim, a limitation of the claim which includes the phrase "means for" or the phrase "step for" means that 35 U.S.C. § 112, paragraph 6, applies to that limitation.

In a claim, a limitation of the claim which does not include the phrase "means for" or the phrase "step for" means that 35 U.S.C. § 112, paragraph 6 does not apply to that limitation, regardless of whether that limitation recites a function without recitation of structure, material or acts for performing that function. For example, in a claim, the mere use of the phrase "step of" or the phrase "steps of" in referring to one or more steps of the claim or of another claim does not mean that 35 U.S.C. § 112, paragraph 6, applies to that step(s).

With respect to a means or a step for performing a specified function in accordance with 35 U.S.C. § 112, paragraph 6, the corresponding structure, material or acts described in the specification, and equivalents thereof, may perform additional functions as well as the specified function.

Computers, processors, computing devices and like products are structures that can perform a wide variety of functions. Such products can be operable to perform a specified function by executing one or more programs, such as a program stored in a memory device of that product or in a memory device which that product accesses. Unless expressly specified otherwise, such a program need not be based on any particular algorithm, such as any particular algorithm that might be disclosed in the present application. It is well known to one of ordinary skill in the art that a specified function may be implemented via different algorithms, and any of a number of different algorithms would be a mere design choice for carrying out the specified function.

Therefore, with respect to a means or a step for performing a specified function in accordance with 35 U.S.C. § 112, paragraph 6, structure corresponding to a specified function includes any product programmed to perform the specified function. Such structure includes programmed products which perform the function, regardless of whether such product is programmed with (i) a disclosed algorithm for performing the function, (ii) an algorithm that is similar to a disclosed algorithm, or (iii) a different algorithm for performing the function.

Where there is recited a means for performing a function that is a method, one structure for performing this method includes a computing device (e.g., a general purpose computer) that is programmed and/or configured with appropriate hardware to perform that function.

Also includes a computing device (e.g., a general purpose computer) that is programmed and/or configured with appropriate hardware to perform that function via other algorithms as would be understood by one of ordinary skill in the art.

VIII. DISCLAIMER

Numerous references to a particular embodiment does not indicate a disclaimer or disavowal of additional, different embodiments, and similarly references to the description of embodiments which all include a particular feature does not indicate a disclaimer or disavowal of embodiments which do not include that particular feature. A clear disclaimer or disavowal in the present application shall be prefaced by the phrase "does not include" or by the phrase "cannot perform".

IX. INCORPORATION BY REFERENCE

Any patent, patent application or other document referred to herein is incorporated by reference into this patent application as part of the present disclosure, but only for purposes of written description in accordance with 35 U.S.C. § 112, paragraph 1 and enablement in accordance with 35 U.S.C. § 112, paragraph 1, and should in no way be used to limit, define, or otherwise construe any term of the present application where the present application, without such incorporation by reference, would not have failed to provide an ascertainable meaning, but rather would have allowed an ascertainable meaning for such term to be provided. Thus, the person of ordinary skill in the art need not have been in any way limited by any embodiments provided in the reference Any incorporation by reference does not, in and of itself, imply any endorsement of, ratification of or acquiescence in any statements, opinions, arguments or characterizations contained in any incorporated patent, patent application or other document, unless explicitly specified otherwise in this patent application.

X. PROSECUTION HISTORY

In interpreting the present application (which includes the claims), one of ordinary skill in the art shall refer to the prosecution history of the present application, but not to the prosecution history of any other patent or patent application, regardless of whether there are other patent applications that are considered related to the present application, and regardless of whether there are other patent applications that share a claim of priority with the present application.

INCORPORATION BY REFERENCE

The following are incorporated by reference herein:
U.S. Pat. No. 6,676,522;
U.S. Pat. No. 6,846,238;
U.S. Pat. No. 6,702,672.

What is claimed is:

1. A method comprising:

storing in memory of a computing device data describing play of a first game by a first game by a player, the data indicating at least one of an amount of time that the first game was played by the player and a number of times that the first game was played by the player;

determining, by a computer processor, whether the player played the first game for longer than a pre-determined period of time or played the first game more than a pre-determined number of times based at least in part on the stored data;

based at least in part on determining that the player played the first game for longer than the pre-determined period of time or played the first game more than the pre-determined number of times, providing on an electronic display at least one recommendation to play a second game based at least in part on a determination that the second game has a characteristic in common with a characteristic of the first game;

ordering the at least one recommendation based at least in part on a number of times that an outcome occurs which returns more than a predetermined multiple of an amount bet; and based on receipt of location information of a mobile device of a player, causing enabling or disabling of play of the second game on the mobile device of the player based on the location of the mobile device of the player.

2. The method of claim 1, further comprising:

storing in the memory of the computing device data describing the play of a third game by the player, the data indicating at least one of an amount of time that the third game was played by the player and a number of times that the third game was played by the player; and based at least in part on determining that the player has played the first game for longer than the pre-determined period of time or more than the pre-determined number of times and that the player has played the third game for longer than the second pre-determined period of time or more than the second pre-determined number of times, providing on the electronic display a recommendation to play the third game.

3. The method of claim 2, wherein the pre-determined period of time and the second predetermined period of time are the same and wherein the pre-determined number of times and the second predetermined number of times are the same.

4. The method of claim 1, wherein a list of recommendations including the second game and at least one other game having a characteristic in common with the characteristic of the first game is provided on the electronic display.

5. The method of claim 4, further comprising the step of:

rank ordering the list of recommendations based at least in part on play of the games in the list during a most recent 24-hour period.

6. The method of claim 4, further comprising the step of:

rank ordering the list of recommendations based at least in part on a number of times the games in the list are currently in play.

7. The method of claim 4, further comprising the step of:

rank ordering of the list of recommendations based at least in part on a number of players who are currently playing the games in the list.

8. The method of claim 4, further comprising the step of:

receiving from the player search criteria for games, and limiting the list of recommendations to games that match the search criteria.

9. The method of claim 4, further comprising:

receiving from the player registration data identifying at least one characteristic of the player and ordering the list of recommendations based at least in part on the at least one characteristic of the player.

10. The method of claim 9, wherein the at least one characteristic of the player is selected from the group consisting of a demographic attribute, a gender, an occupation, an income level, an age, a hobby, and a language of the player.

11. One or more non-transitory computer-readable media, having stored thereon instructions that, when executed by one or more computer processors, cause the one or more computer processors to:

store in memory of a computing device data describing play of the first game by a player, the data indicating at least one of an amount of time that the first game was played by the player and a number of times that the first game was played by the player;

determine, by a computer processor, whether the player played the first game for longer than a pre-determined period of time or played the first game more than a pre-determined number of times based at least in part on the stored data;

based at least in part on determining that the player has played the first game for longer than the pre-determined period of time or played the first game more than the pre-determined number of times, provide on an electronic display at least one recommendation to play a second game based at least in part on a determination that the second game has a characteristic in common with a characteristic of the first game;

order the at least one recommendation based at least in part on a number of times that an outcome occurs which returns more than a predetermined multiple of an amount bet; and based on receipt of location information of a mobile device of a player, causing enabling or disabling of play of the second game on the mobile device of the player based on the location of the mobile device of the player.

12. The non-transitory computer-readable media of claim 11, wherein the instructions further cause the one or more computer processors to:

store in the memory of the computing device data describing play of a third game by the player, the data indicating at least one of an amount of time that the third game was played by the player and a number of times that the third game was played the player;

and based at least in part on determining that the player has played the first game for longer than the pre-determined period of time or more than the pre-determined number of times and that the player has played the third game for longer than the second pre-determined period of time or more than the second pre-determined number of times, provide on an electronic display a recommendation to play the third game.

13. The non-transitory computer-readable media of claim 11, wherein the instructions further cause the one or more computer processors to:

provide on an electronic display a list of recommendations including the second game and at least one other game having a characteristic in common with the characteristic of the first game.

14. The non-transitory computer-readable media of claim 13, wherein the instructions further cause the one or more computer processors to:

rank order the list of recommendations based at least in part on play of the games in the list during a most recent 24-hour period.

15. The non-transitory computer-readable media of claim 13, wherein the instructions further cause the one or more computer processors to:

rank order the list of recommendations based at least in part on a number of times the games in the list are currently in play.

16. The non-transitory computer-readable media of claim 13, wherein the instructions further cause the one or more computer processors to:

rank order of the list of recommendations based at least in part on a number of players who are currently playing the games in the list.

17. The non-transitory computer-readable media of claim 13, wherein the instructions further cause the one or more computer processors to:

receive from the first player search criteria for games, and limit the list of recommendations to games that match the search criteria.

18. The non-transitory computer-readable media of claim 13, wherein the instructions further cause the one or more computer processors to:

receive from the first player registration data identifying at least one characteristic of the first player and order the list of recommendations based at least in part on the at least one characteristic of the first player.

19. The non-transitory computer-readable media of claim 13, wherein the at least one characteristic of the first player is selected from the group consisting of a demographic attribute, a gender, an occupation, an income level, and a language of the first player.

20. The non-transitory computer-readable media of claim 13, wherein the pre-determined period of time and the second predetermined period of time are the same and wherein the pre-determined number of times and the second predetermined number of times are the same.

21. A system comprising:

at least one processor; and memory having instructions stored therein that, when executed by the at least one processor, cause the at least one processor to:

store in memory of a computing device data describing play of the first game by players, the data indicating at least one of an amount of time that the first game was played by each of the players and a number of times that the first game was played by each of the players;

based at least in part on determining that the first player has played the first game for longer than the pre-determined period of time or played the first game more than the pre-determined number of times, provide on an electronic display to at least one of the first player and a second player at least one recommendation to play a second game based at least in part on a determination that the second game has a characteristic in common with a characteristic of the first game;

order the at least one recommendation based at least in part on a number of times that an outcome occurs which returns more than a predetermined multiple of an amount bet; and based on receipt of location information of a mobile device of a player, causing enabling or disabling of play of the second game on the mobile device of the player based on the location of the mobile device of the player.

22. The system of claim 21, wherein the instructions further cause the at least one processor to:

store in the memory of the computing device data describing play of a third game by at least one of the players, the data indicating at least one of an amount of time that the third game was played by each of the players that played the third game and a number of times that the third game was played by each of the players that played the third game; and based at least in part on determining that the third player has played the first game for longer than the pre-determined period of time or played the first game more than the pre-determined number of times and has played the third game for longer than the second pre-determined period of time or played the third game more than the second pre-determined number of times, provide on an electronic display to the first player a recommendation to play the third game.

23. The system of claim 21, wherein the instructions further cause the processor to:

provide on an electronic display to the first player a list of recommendations including the second game and at least one other game having a characteristic in common with the characteristic of the first game.

24. The system of claim 23, the instructions further causing the processor to:

rank order the list of recommendations based at least in part on play of the games in the list during a most recent 24-hour period.

25. The system of claim 23, the instructions further causing the processor to:

rank order the list of recommendations based at least in part on a number of times the games in the list are currently in play.

26. The system of claim 23, the instructions further causing the processor to:

rank order of the list of recommendations based at least in part on a number of players who are currently playing the games in the list.

27. The system of claim 23, the instructions further causing the processor to:

receive from the first player search criteria for games, and limit the list of recommendations to games that match the search criteria.

28. The system of claim 23, the instructions further causing the processor to:

receive from the first player registration data identifying at least one characteristic of the first player and order the list of recommendations based at least in part on the at least one characteristic of the first player.

29. The system of claim 23, wherein the at least one characteristic of the first player is selected from the group consisting of a demographic attribute, a gender, an occupation, an income level, and a language of the first player.

30. The system of claim 23, wherein the pre-determined period of time and the second predetermined period of time are the same and wherein the pre-determined number of times and the second predetermined number of times are the same.

* * * * *